US010354615B2

(12) United States Patent
Ikeda et al.

(10) Patent No.: US 10,354,615 B2
(45) Date of Patent: Jul. 16, 2019

(54) DISPLAY DEVICE

(71) Applicant: Japan Display Inc., Tokyo (JP)

(72) Inventors: Kojiro Ikeda, Tokyo (JP); Masaaki Kabe, Tokyo (JP); Akira Sakaigawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 324 days.

(21) Appl. No.: 15/471,562

(22) Filed: Mar. 28, 2017

(65) Prior Publication Data

US 2017/0287438 A1 Oct. 5, 2017

(30) Foreign Application Priority Data

Mar. 31, 2016 (JP) ..... 2016-073036

(51) Int. Cl.
*G09G 5/10* (2006.01)
*G09G 3/20* (2006.01)

(52) U.S. Cl.
CPC ..... *G09G 5/10* (2013.01); *G09G 3/2003* (2013.01); *G09G 3/2074* (2013.01); *G09G 3/2092* (2013.01); *G09G 3/2011* (2013.01); *G09G 2300/0426* (2013.01); *G09G 2300/0452* (2013.01); *G09G 2320/02* (2013.01)

(58) Field of Classification Search
CPC .. G09G 3/2029; G09G 3/2003; G09G 3/2074; G09G 3/2011; G09G 5/10; G09G 2320/02; G09G 2300/0452; G09G 2300/0426
See application file for complete search history.

(56) References Cited

U.S. PATENT DOCUMENTS

2003/0076326 A1 4/2003 Tezuka et al.
2008/0049042 A1* 2/2008 Yang ..... G09G 3/3607 345/589
2009/0097776 A1* 4/2009 Fukamachi ..... H04N 1/405 382/269
2009/0289963 A1* 11/2009 Minami ..... G09G 3/3233 345/690
2009/0322802 A1 12/2009 Noguchi et al.
(Continued)

FOREIGN PATENT DOCUMENTS

JP 2003-131653 A 5/2003
JP 2005-084513 A 3/2005
(Continued)

*Primary Examiner* — Ryan A Lubit
(74) *Attorney, Agent, or Firm* — Michael Best & Friedrich LLP

(57) ABSTRACT

According to an aspect, a display device includes: a display panel including a plurality of pixels; at least three of a first sub-pixel in a first color, a second sub-pixel in a second color, a third sub-pixel in a third color, and a fourth sub-pixel in a fourth color, the three sub-pixels being included in each of the pixels; and a controller configured to input an input signal to the first sub-pixel to the fourth sub-pixel. When display is performed in a plurality of display regions in respective single colors adjacent to each other in the display panel, the controller inputs a signal for lighting a sub-pixel that does not contribute to one of the single colors in a halftone manner, in a pixel included in a boundary section of the adjacent display regions.

12 Claims, 32 Drawing Sheets

(56) References Cited

U.S. PATENT DOCUMENTS

| | | | | |
|---|---|---|---|---|
| 2012/0206512 | A1* | 8/2012 | Kim | G02F 1/133514 345/691 |
| 2012/0242719 | A1* | 9/2012 | Klompenhouwer | G09G 3/2074 345/690 |
| 2013/0235095 | A1* | 9/2013 | Cok | G09G 5/02 345/694 |
| 2014/0168040 | A1* | 6/2014 | Bastani | G09G 3/2059 345/84 |
| 2017/0230643 | A1* | 8/2017 | Guo | H04N 13/32 |

FOREIGN PATENT DOCUMENTS

| | | | |
|---|---|---|---|
| JP | 2005-316169 | A | 11/2005 |
| JP | 2008-051905 | A | 3/2008 |
| JP | 2010-033009 | A | 2/2010 |
| JP | 2010-033014 | A | 2/2010 |

* cited by examiner

DISPLAY DEVICE

CROSS-REFERENCE TO RELATED APPLICATIONS

This application claims priority from Japanese Application No. 2016-073036, filed on Mar. 31, 2016, the contents of which are incorporated by reference herein in its entirety.

BACKGROUND

1. Technical Field

The present invention relates to a display device.

2. Description of the Related Art

In recent years, there are increasing demands for display devices using a liquid crystal display panel or an organic electroluminescence display (OLED) panel using organic electroluminescence emission, as disclosed in Japanese Patent Application Laid-open Publication No. 2008-051905, for example. In a display device disclosed in Japanese Patent Application Laid-open Publications No. 2005-84513, No. 2005-316169, No. 2003-131653, and No. 2010-33014, one pixel includes a plurality of sub-pixels, and the sub-pixels output different colors of light. Combining the colors of the sub-pixels allows the one pixel to display various colors.

When display is performed in a plurality of display regions in respective single colors adjacent to each other, a black streak or a bright streak may appear in a boundary of the display regions. The streak appearing in the boundary is caused by a pixel array.

In the pixels in the boundary, a sub-pixel contributing to the display in the single color is lighted, but a sub-pixel not contributing to the display is unlighted. Therefore, in a case where the sub-pixels contributing to the display in the single color are separated from each other, an unlighted area is visually recognized as the black streak. On the other hand, in a case where the sub-pixels contributing to the display in the single colors are close to each other, to be specific, the sub-pixels are adjacent to each other, the different single colors are mixed with each other and are recognized as the bright streak.

For the foregoing reasons, there is a need for a display device that prevents the occurrence of the streaks in the display regions, thereby improving visibility of a display image.

SUMMARY

According to an aspect, a display device includes: a display panel including a plurality of pixels; at least three of a first sub-pixel in a first color, a second sub-pixel in a second color, a third sub-pixel in a third color, and a fourth sub-pixel in a fourth color, the three sub-pixels being included in each of the pixels; and a controller configured to input an input signal to the first sub-pixel to the fourth sub-pixel. When display is performed in a plurality of display regions in respective single colors adjacent to each other in the display panel, the controller inputs a signal for lighting a sub-pixel that does not contribute to one of the single colors in a halftone manner, in a pixel included in a boundary section of the adjacent display regions.

DETAILED DESCRIPTION

Figure 1:
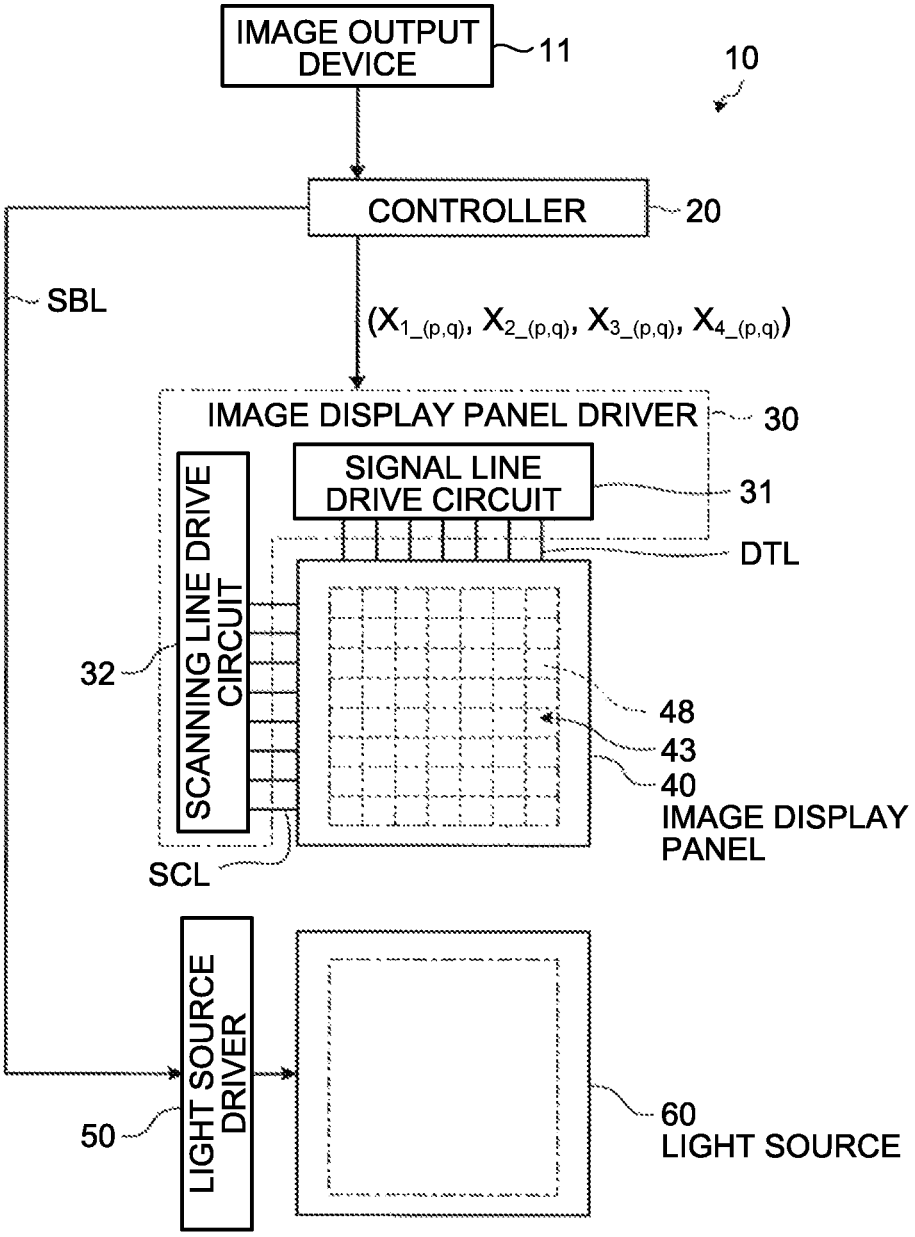
FIG. 1 is a diagram illustrating a first embodiment.

The following describes embodiments of the present invention in detail with reference to the drawings. The disclosure is merely an example, and the present invention naturally encompasses appropriate modifications maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same elements as those described in the drawings that have already been discussed are denoted by the same reference numerals throughout the description and the drawings, and detailed description thereof will not be repeated in some cases.

First Embodiment

A first embodiment will be described with reference to FIGS. 1 to 11.

Overall Configuration of Display Device

FIG. 1 is a block diagram illustrating an example of a configuration of a display device according to the first embodiment. As illustrated in FIG. 1, a display device 10 of the present embodiment includes a controller 20, an image display panel driver 30, an image display panel 40, a light source driver 50, and a light source 60. The controller 20 receives an input signal (RGB data) from an image output device 11, performs predetermined data conversion processing to the input signal, and sends a generated signal to each unit of the display device 10. The image display panel driver 30 controls driving of the image display panel 40 based on the signal from the controller 20. The light source driver 50 controls driving of the light source 60 based on the signal from the controller 20. The light source 60 illuminates the image display panel 40 from the back based on a signal from the light source driver 50. The image display panel 40 displays an image according to a signal from the image display panel driver 30 with the light from the light source 60.

Configuration of Image Display Panel

Figure 2:
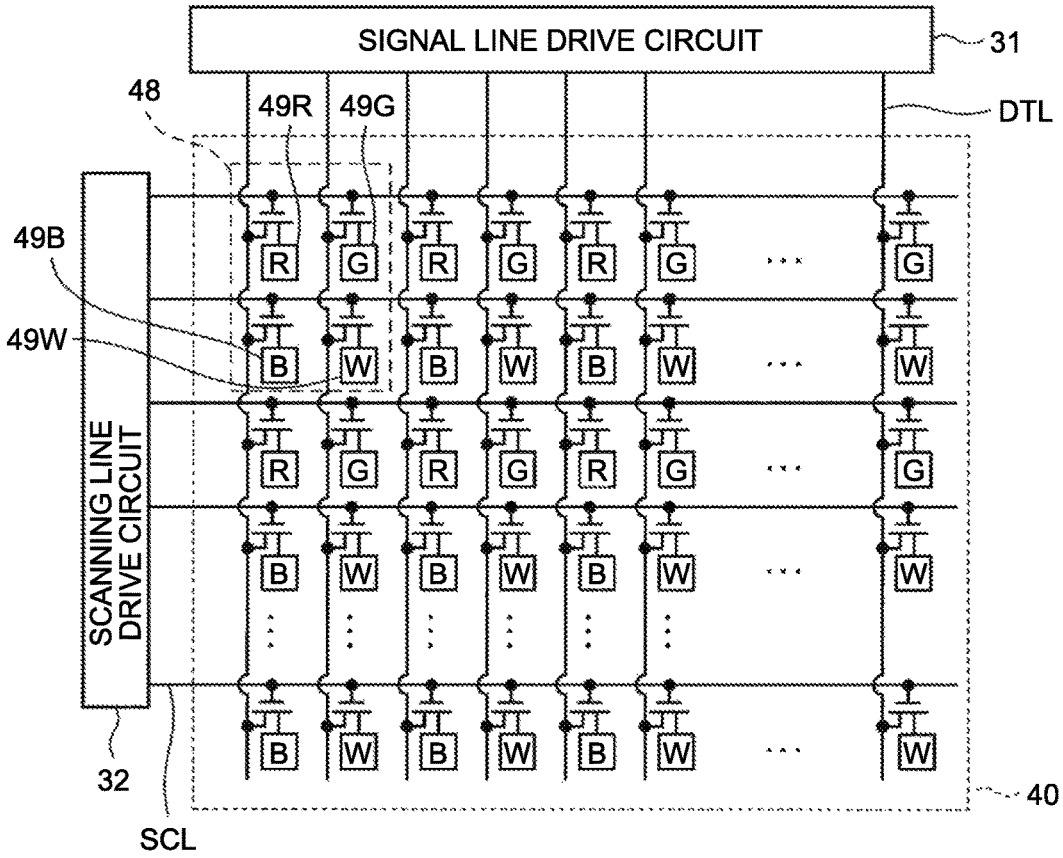
FIG. 2 is a diagram illustrating the first embodiment.
Figure 3:
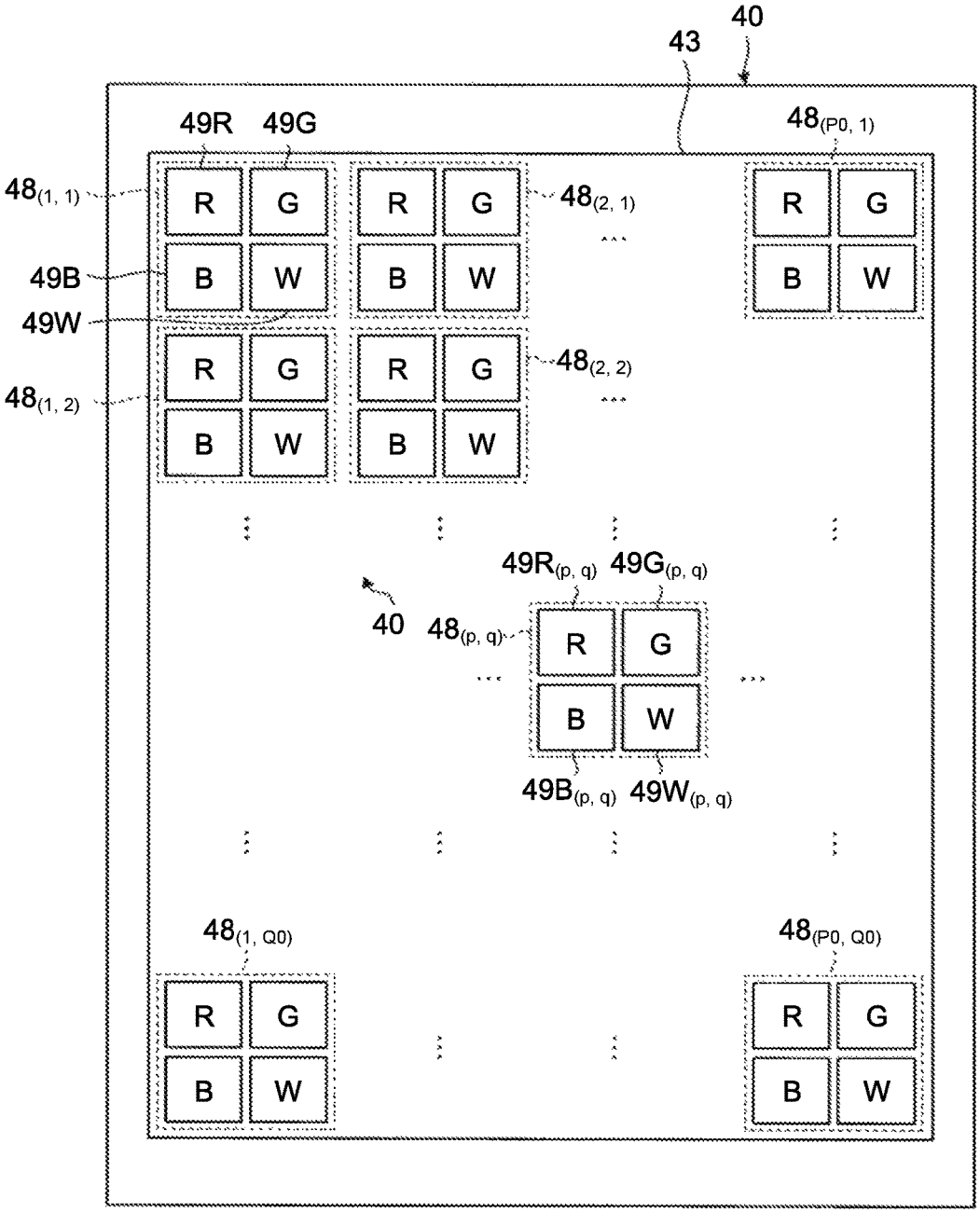
FIG. 3 is a diagram illustrating the first embodiment.

Next, a configuration of the image display panel 40 will be described. FIG. 2 is a conceptual diagram of the image display panel 40 according to the first embodiment. FIG. 3 is a schematic view illustrating an array of sub-pixels according to the first embodiment. As illustrated in FIGS. 1 to 3, the image display panel 40 includes a display panel 43 in which $P_0 \times Q_0$ pixels 48 are arrayed in a two-dimensional matrix manner in an X direction and a Y direction. The X direction is a row direction of an image displayed on the image display panel 40. The Y direction is a direction perpendicular to the X direction, and is a column direction of an image displayed on the image display panel 40. However, the present invention is not limited thereto, and the X direction may be the column direction of an image and the Y direction may be the row direction of an image.

As illustrated in FIGS. 2 and 3, the pixel 48 includes a first sub-pixel 49R, a second sub-pixel 49G, a third sub-pixel 49B, and a fourth sub-pixel 49W. The first sub-pixel 49R displays a first color (e.g., a first primary color such as red). The second sub-pixel 49G displays a second color (e.g., a second primary color such as green). The third sub-pixel 49B displays a third color (e.g., a third primary color such as blue). The fourth sub-pixel 49W displays a fourth color (e.g., white). The first color, the second color, the third color, and the fourth color are not limited to red, green, blue, and white, and may be complementary colors or the like as long as the colors are different from one another. The fourth sub-pixel 49W that displays the fourth color has preferably higher luminance than the first sub-pixel 49R that displays the first color, the second sub-pixel 49G that displays the second color, and the third sub-pixel 49B that displays the third color, when being irradiated with the same light amount from a light source. Hereinafter, when the first sub-pixel 49R, the second sub-pixel 49G, the third sub-pixel 49B, and the fourth sub-pixel 49W do not need to be distinguished from one another, these sub-pixels are referred to as sub-pixels 49. When positions where the sub-pixels are arrayed are distinguished and described, the fourth sub pixel of a pixel $\mathbf{48}_{(p,\ q)}$ is described as a fourth sub-pixel $\mathbf{49}W_{(p,\ q)}$.

As illustrated in FIG. 3, the pixel 48 includes the four sub-pixels 49 arranged in two rows and two columns. The four sub-pixels 49 have the same shape and the same area. The four sub-pixels 49 are the first sub-pixel 49R, the second sub-pixel 49G, the third sub-pixel 49B, and the fourth sub-pixel 49W. In this way, the configuration in which the sub-pixels in two rows and two columns constitute one pixel is called a square pixel (SQ pixel) in the present embodiment. In the present embodiment, the first sub-pixel 49R, the second sub-pixel 49G, the third sub-pixel 49B, the fourth sub-pixel 49W are arranged at positions of upper left, upper right, lower left, and lower right, respectively, in the pixel 48.

Configuration of Image Display Panel Driver

As illustrated in FIGS. 1 and 2, the image display panel driver 30 includes a signal line drive circuit 31 and a scanning line drive circuit 32. The image display panel driver 30 holds video signals (image information) by the signal line drive circuit 31, and sequentially outputs the video signals to the image display panel 40. To be specific, the signal line drive circuit 31 outputs an image output signal having a predetermined potential (gradation) according to an output signal from the controller 20 to the image display panel 40. The signal line drive circuit 31 is electrically coupled to the image display panel 40 by signal lines DTL. The scanning line drive circuit 32 controls ON and OFF of switching elements (e.g., thin film transistors (TFT)) for controlling operations (light transmittance) of the sub-pixels 49 in the image display panel 40. The scanning line drive circuit 32 is electrically coupled to the image display panel 40 by scanning lines SCL.

Configurations of Light Source Driver and Light Source

The light source driver 50 controls the amount of light output from the light source 60. To be specific, the light source driver 50 controls the amount of light (intensity of light) to be emitted to the image display panel 40 by adjusting a voltage to be supplied to the light source 60 and the like by pulse width modulation (PWM) or the like based on a light source drive signal SBL output from the controller 20.

The light source 60 is arranged on the back or the front of the image display panel 40, and irradiates the image display panel 40 with light to illuminate the image display panel 40.

Figure 4:
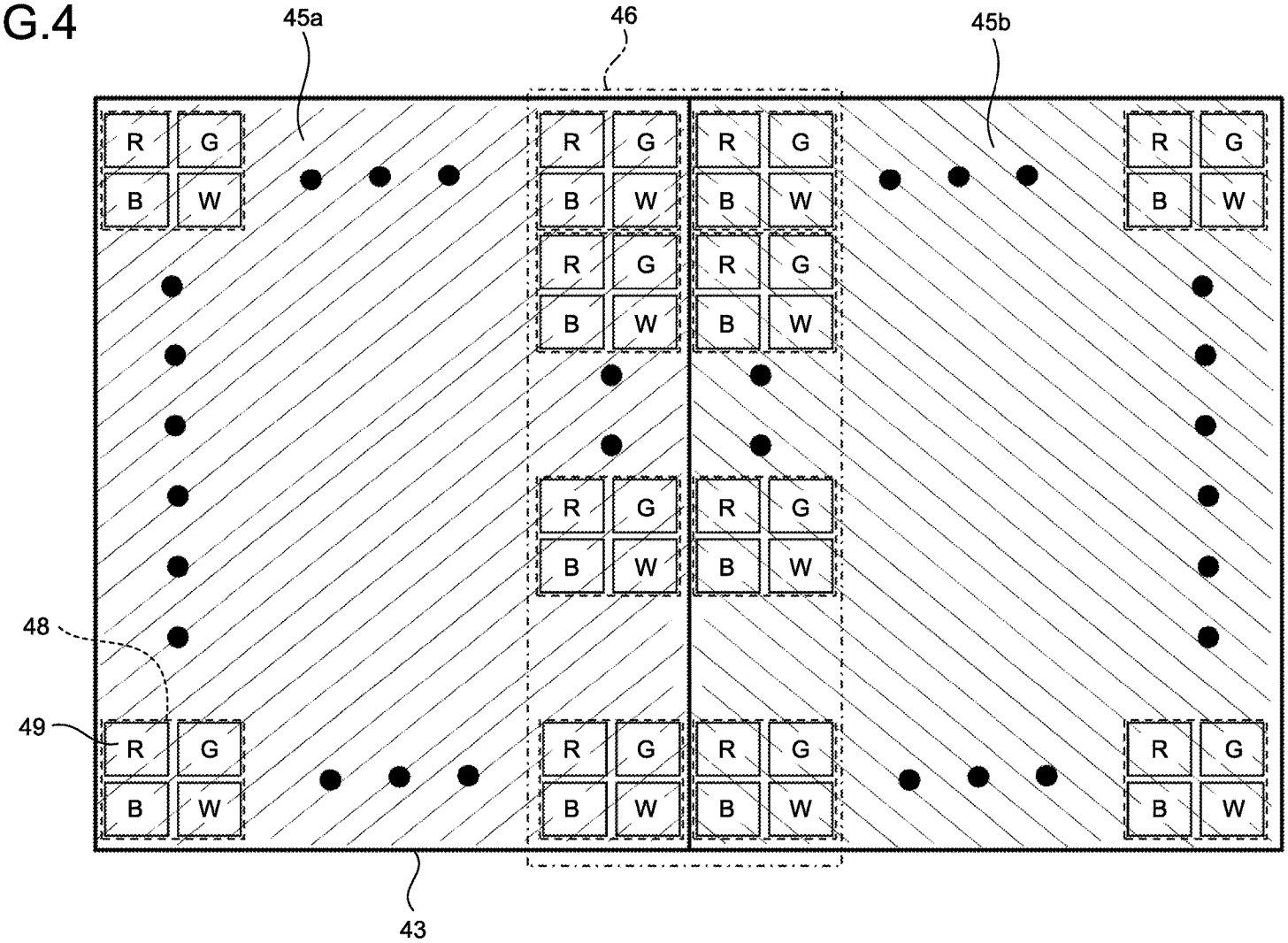
FIG. 4 is a diagram illustrating the first embodiment.

FIG. 4 illustrates an example in which display is performed in display regions 45*a* and 45*b* in different single colors laterally adjacent to each other in plan view in the display panel 43. In FIG. 4, for example, red is displayed in the display region 45*a*, and green is displayed in the display region 45*b*. In the present specification, in the plurality of display regions laterally adjacent to each other, pixel columns closest to the respective adjacent display regions are referred to as a boundary section 46.

In the present embodiment, an example is described in which display is performed in the display regions in different single colors laterally adjacent to each other in plan view. However, the present invention is not limited to the example. Display may be performed in the display regions in different single colors longitudinally adjacent to each other in plan view. In the case where the display regions are longitudinally adjacent to each other, pixel rows closest to the respective display regions are referred to as the boundary section 46.

Further, in the present embodiment, an example is described in which two display regions in single colors are adjacent to each other. However, the present embodiment may also employ an example in which three or more display regions in single colors are adjacent to one another. In other words, according to the present embodiment, the boundary section 46 of one of the display regions is on a pixel row or a pixel column closest to another one of the display regions adjacent and closest to the one of the display regions.

Figure 5:
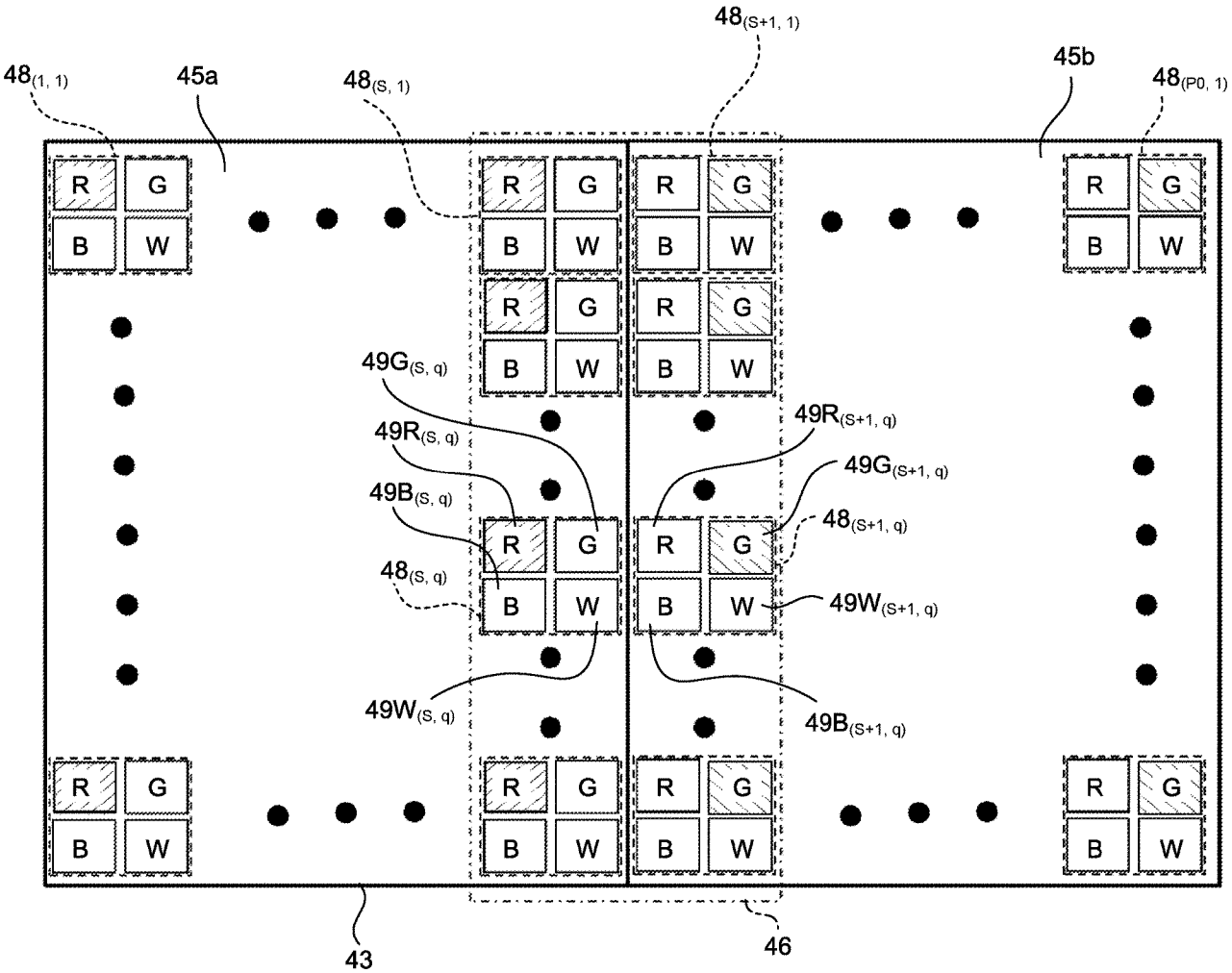
FIG. 5 is a diagram illustrating the first embodiment.

Assume that in the boundary section 46 of the display regions 45*a* and 45*b*, a pixel $\mathbf{48}_{(S,\ q)}$ on an S-th column on the display region 45*a* side and a pixel $\mathbf{48}_{(S+1,\ q)}$ on an (S+1)-th column on the display region 45*b* side are adjacent to each other (S is an integer of 1 or more, and ($P_0$−1) or less) (see FIG. 5). For example, on a q-th row of the boundary section 46, a first sub-pixel $\mathbf{49}R_{(S,\ q)}$ of the pixel $\mathbf{48}_{(S,\ q)}$ is lighted on the display region 45*a* side, and a second sub-pixel $\mathbf{49}G_{(S+1,\ q)}$ of the pixel $\mathbf{48}_{(S+1,\ q)}$ is lighted on the display region 45*b* side.

As illustrated in FIG. 5, a second sub-pixel $\mathbf{49}G_{(S,\ q)}$ of the pixel $\mathbf{48}_{(S,\ q)}$ and a first sub-pixel $\mathbf{49}R_{(S+1,\ q)}$ of the pixel $\mathbf{48}_{(S+1,\ q)}$ are arranged between the lighted first sub-pixel $\mathbf{49}R_{(S,\ q)}$ of the pixel $\mathbf{48}_{(S,\ q)}$ and the lighted second sub-pixel $\mathbf{49}G_{(S+1,\ q)}$ of the pixel $\mathbf{48}_{(S+1,\ q)}$. The second sub-pixel $\mathbf{49}G_{(S,\ q)}$ of the pixel $\mathbf{48}_{(S,\ q)}$ and the first sub-pixel $\mathbf{49}R_{(S+1,\ q)}$ of the pixel $\mathbf{48}_{(S+1,\ q)}$, which are arranged between the lighted sub-pixels 49, are unlighted. Further, a third sub-pixel $\mathbf{49}B_{(S,\ q)}$ and a fourth sub-pixel $\mathbf{49}W_{(S,\ q)}$) of the pixel $\mathbf{48}_{(S,\ q)}$) and a third sub-pixel $\mathbf{49}B_{(S+1,\ q)}$ and a fourth sub-pixel $\mathbf{49}W_{(S+1,\ q)}$ of the pixel $\mathbf{48}_{(S+1,\ q)}$ are also unlighted. These unlighted sub-pixels 49 may be visually recognized in the boundary section 46 where the different single colors are adjacent to each other, as a black streak 41 (see FIG. 6).

Figure 7:
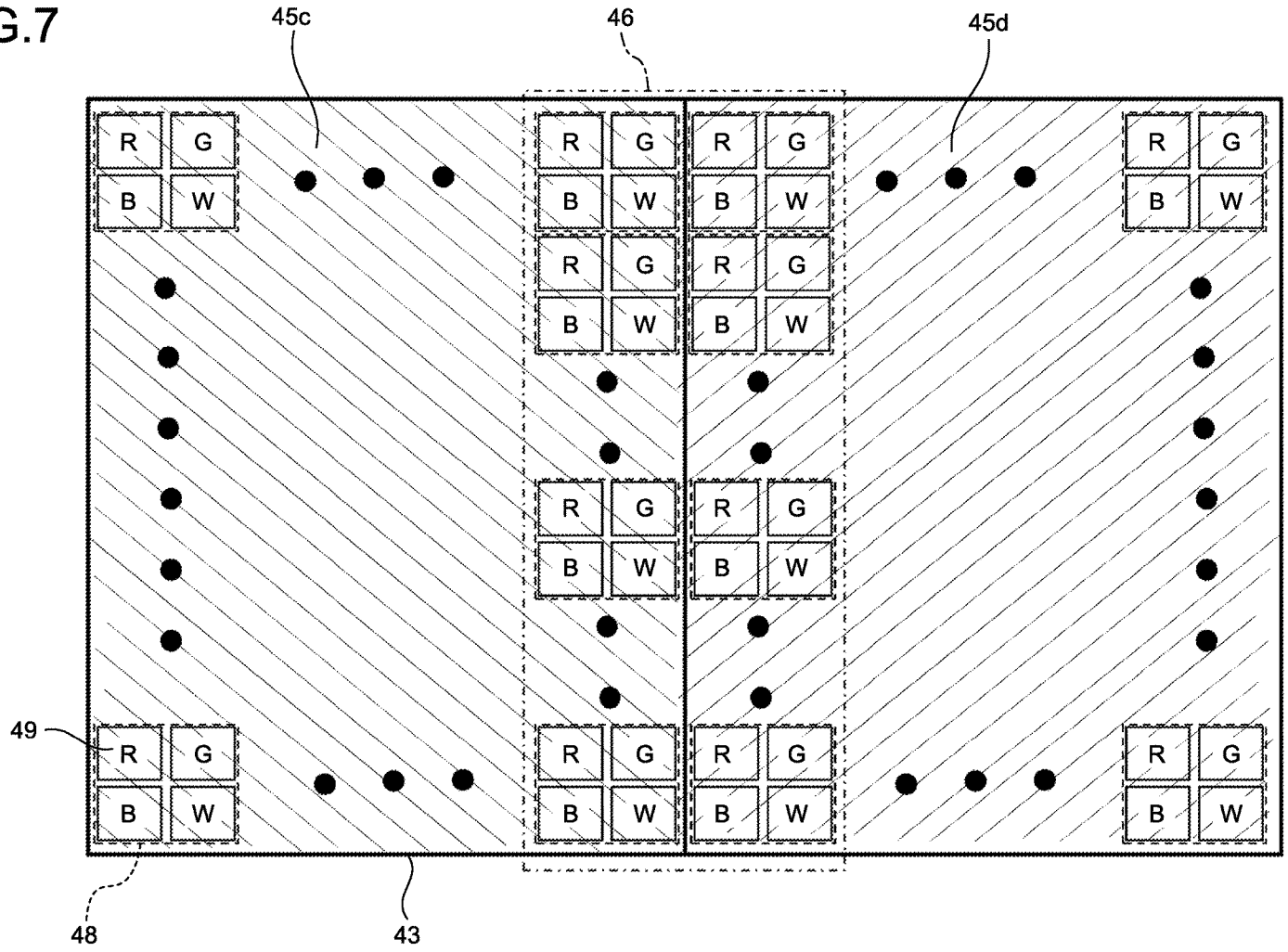
FIG. 7 is a diagram illustrating the first embodiment.

FIG. 7 illustrates an example in which in adjacent display regions 45*c* and 45*d*, green is displayed in the display region 45*c*, and red is displayed in the display region 45*d*, in an opposite manner to the example of FIG. 4.

Figure 8:
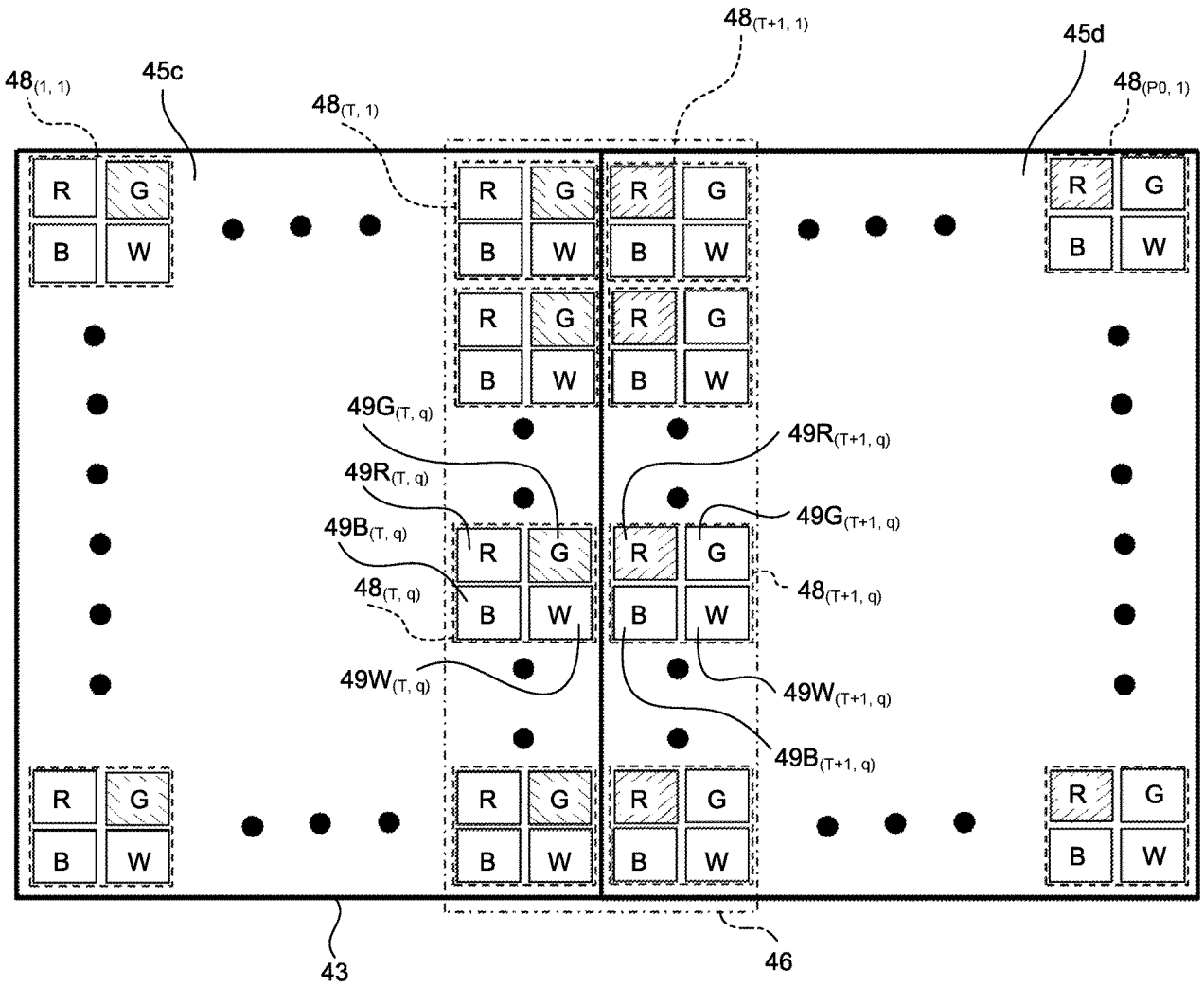
FIG. 8 is a diagram illustrating the first embodiment.

Assume that in the boundary section 46 of the display regions 45*c* and 45*d*, a pixel $\mathbf{48}_{(T,\ q)}$ on a T-th column on the display region 45*c* side and a pixel $\mathbf{48}_{(T+1,\ q)}$ on a (T+1)-th column on the display region 45*d* side are adjacent to each other (T is an integer of 1 or more, and ($P_0$−1) or less) (see FIG. 8). For example, on the q-th row of the boundary section 46, a second sub-pixel $\mathbf{49}G_{(T,\ q)}$ of the pixel $\mathbf{48}_{(T,\ q)}$ is lighted on the display region 45*c* side, and a first sub-pixel $\mathbf{49}R_{(T+1,\ q)}$ of the pixel $\mathbf{48}_{(T+1,\ q)}$ is lighted on the display region 45*d* side.

As illustrated in FIG. 8, the lighted second sub-pixel $\mathbf{49}G_{(T,\ q)}$ of the pixel $\mathbf{48}_{(T,\ q)}$ and the lighted second sub-pixel $\mathbf{49}R_{(T+1,\ q)}$ of the pixel $\mathbf{48}_{(T+1,\ q)}$ are arranged adjacent to each other. Further, the sub-pixels arranged adjacent to the lighted sub-pixels on the opposite side are unlighted. For example, in the case of the second sub-pixel $\mathbf{49}G_{(T,\ q)}$ of the pixel $\mathbf{48}_{(T,\ q)}$, a first sub-pixel $\mathbf{49}R_{(T,\ q)}$ of the pixel $\mathbf{48}_{(T,\ q)}$ is unlighted. Similarly, in the case of the first sub-pixel $\mathbf{49}R_{(T+1,\ q)}$ of the pixel $\mathbf{48}_{(T+1,\ q)}$, a second sub-pixel $\mathbf{49}G_{(T+1,\ q)}$ of the pixel $\mathbf{48}_{(T+1,\ q)}$ is unlighted. In this way, the sub-pixels 49 respectively adjacent to the lighted sub-pixels 49 adjacent to each other are unlighted, and thus the lighted sub-pixels 49 are emphasized.

The lighted sub-pixels 49 are in the respective single colors. Therefore, for example, when the red and green sub-pixels 49 are adjacently lighted, as described above, red and green are mixed with each other, and are visually and brightly recognized.

Figure 9:
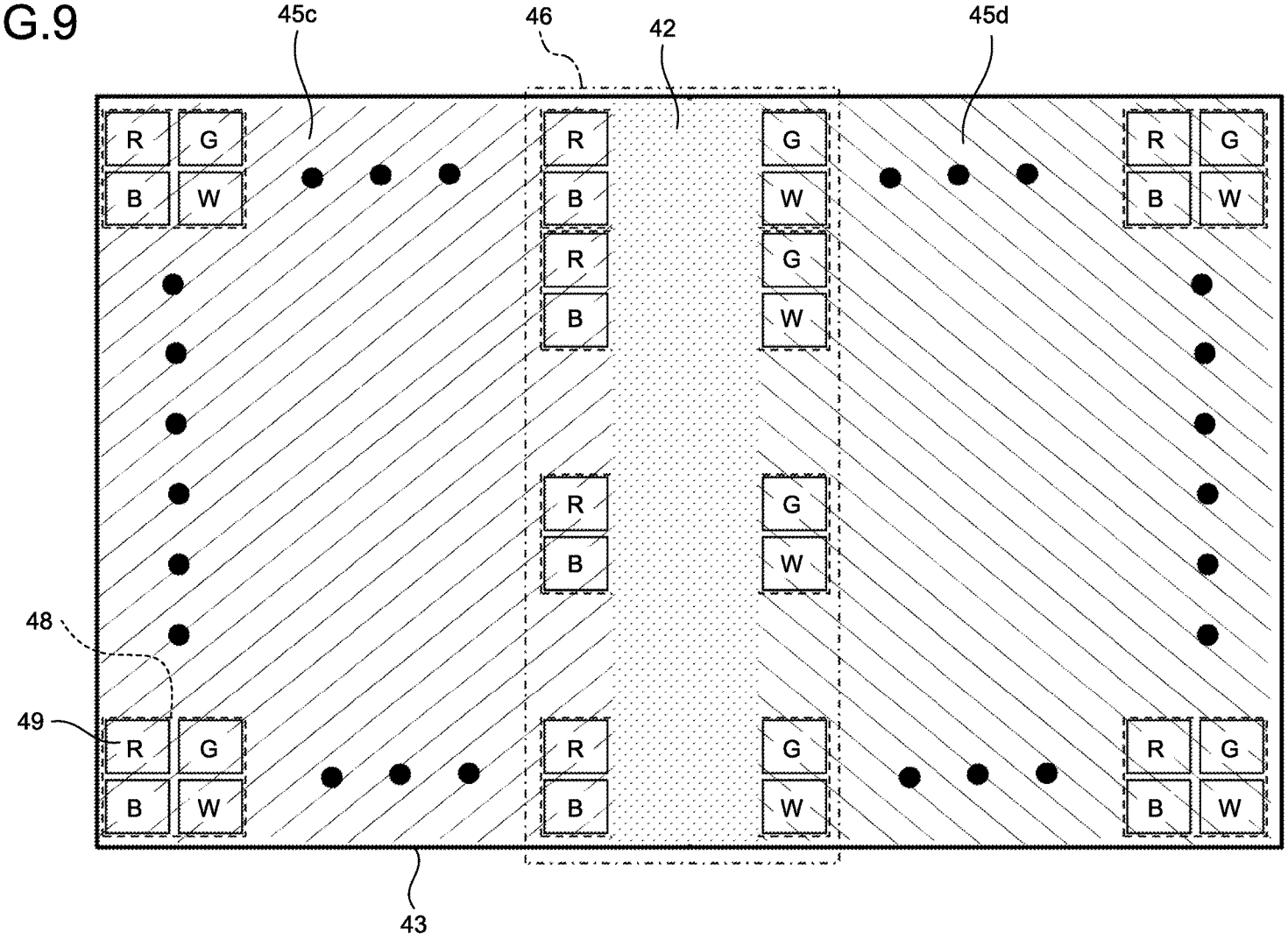
FIG. 9 is a diagram illustrating the first embodiment.

When the lighted sub-pixels 49 are adjacent to each other in this way, a bright streak 42 may be visually recognized in the boundary section 46 where the single colors are adjacent to each other (see FIG. 9).

In FIGS. 4 to 9, examples have been described in which display is performed in the display regions in red and green adjacent to each other. However, the streaks may occur in a case where any two of primary colors (red, green, and blue) having high gradation are displayed adjacently to each other, in a case where any two of complementary colors of the primary colors, i.e., any two of cyan (C), magenta (M), and yellow (Y) are displayed adjacently to each other, or in a case where any two colors that are complementary to each other are displayed adjacently to each other.

As described above, in the case where the display regions in different single colors are displayed adjacently to each other, the black streak occurs when the unlighted sub-pixels are arranged between the lighted sub-pixels, and the bright streak occurs when the lighted sub-pixels are adjacent to each other.

To prevent occurrence of the streaks, in the present embodiment, the sub-pixels not contributing to the single colors to be displayed are lighted in a halftone manner. Further, the sub-pixels contributing to the single colors to be displayed are also lighted in a halftone manner.

Figure 6:
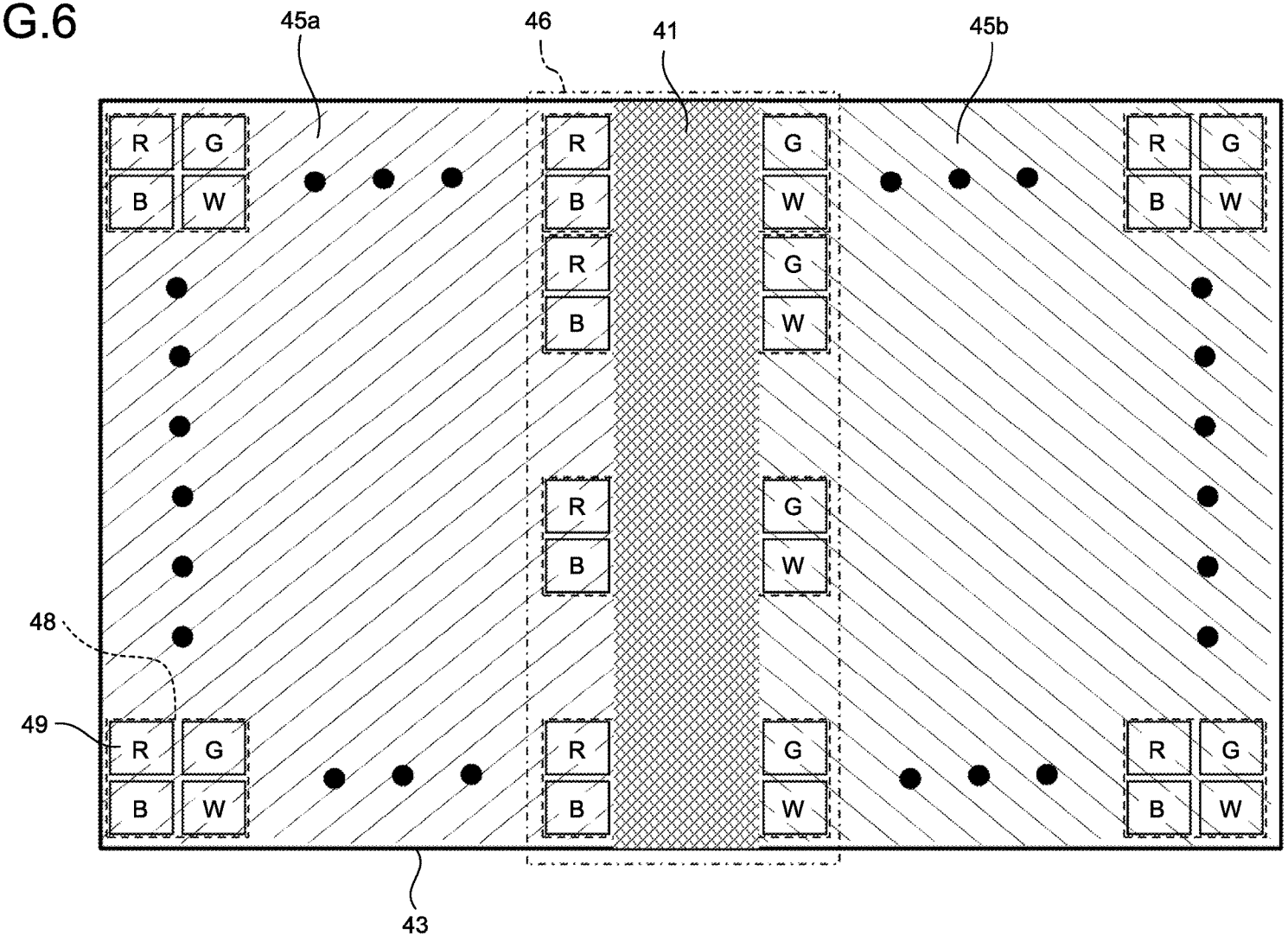
FIG. 6 is a diagram illustrating the first embodiment.
Figure 10:
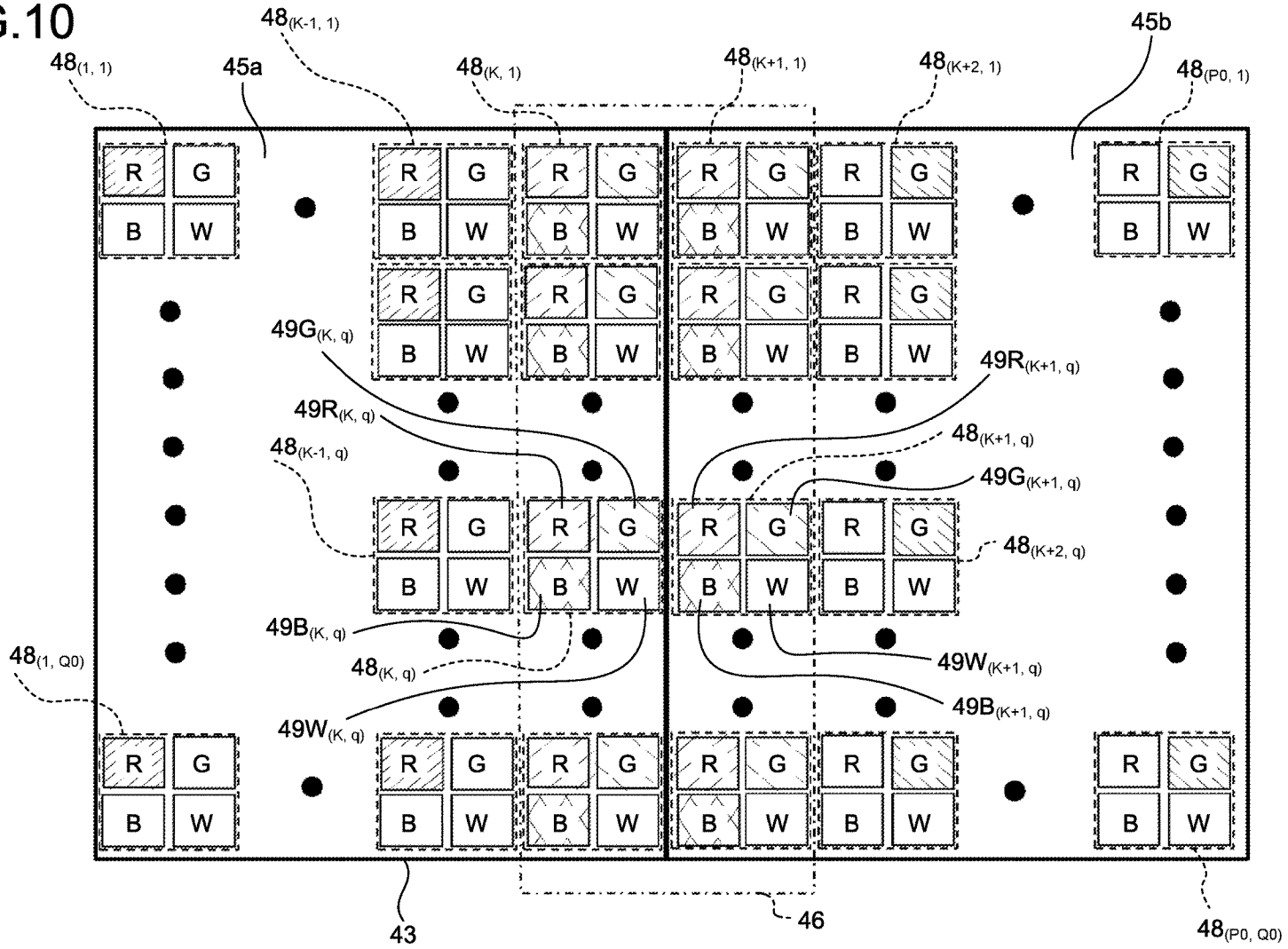
FIG. 10 is a diagram illustrating the first embodiment.

FIG. 10 illustrates an example in which the sub-pixels not contributing to the single colors to be displayed, that is, the sub-pixels that are originally supposed to be unlighted, among the sub-pixels in the boundary sections 46, are lighted in a halftone manner in the display device illustrated in FIGS. 4 to 6. In FIG. 10, assume that a pixel $\mathbf{48}_{(K,\ q)}$ on a K-th column on the display region 45*a* side and a pixel $\mathbf{48}_{(K+1,\ q)}$ on a (K+1)-th column on the display region 45*b* side are adjacent to each other in the boundary section 46 of the display regions 45*a* and 45*b* (K is an integer of 2 or more, and ($P_0$−2) or less).

For example, on the q-th row in the boundary section 46, a second sub-pixel $\mathbf{49}G_{(K,\ q)}$ of the pixel $\mathbf{48}_{(K,\ q)}$ on the display region 45*a* side, which is unlighted in FIG. 5, is lighted in a halftone manner. Further, a third sub-pixel $\mathbf{49}B_{(K,\ q)}$ of the pixel $\mathbf{48}_{(K,\ q)}$, which is unlighted in FIG. 5, is lighted in a halftone manner.

A first sub-pixel $\mathbf{49}R_{(K+1,\ q)}$ of the pixel $\mathbf{48}_{(K+1,\ q)}$ on the display region 45*b* side, which is unlighted in FIG. 5, is lighted in a halftone manner. A third sub-pixel $\mathbf{49}B_{(K+1,\ q)}$ of the pixel $\mathbf{48}_{(K+1,\ q)}$, which is unlighted in FIG. 5, is lighted in a halftone manner.

Further, a first sub-pixel $\mathbf{49}R_{(K,\ q)}$ of the pixel $\mathbf{48}_{(K,\ q)}$ on the display region 45*a* side, which is fully lighted to display red as the single color in FIG. 5, is lighted in a halftone manner. Meanwhile, a second sub-pixel $\mathbf{49}G_{(K+1,\ q)}$ of the pixel $\mathbf{48}_{(K+1,\ q)}$ on the display region 45*b* side, which is fully lighted to display green as the single color in FIG. 5, is lighted in a halftone manner.

That is, in the pixel $\mathbf{48}_{(K,\ q)}$ and the pixel $\mathbf{48}_{(K+1,\ q)}$ adjacent to each other in the boundary section 46, the second sub-pixel $\mathbf{49}G_{(K,\ q)}$, the third sub-pixel $\mathbf{49}B_{(K,\ q)}$, the first sub-pixel $\mathbf{49}R_{(K+1,\ q)}$, and the third sub-pixel $\mathbf{49}B_{(K+1,\ q)}$, which are originally supposed to be unlighted, are lighted in a halftone manner. Further, the first sub-pixel $\mathbf{49}R_{(K,\ q)}$ and the second sub-pixel $\mathbf{49}G_{(K+1,\ q)}$, which are originally supposed to be fully lighted, are lighted in a halftone manner.

As described above, the sub-pixels 49 in the boundary section 46 are lighted in a halftone manner, and thus luminance change in the boundary section is reduced.

Meanwhile, the pixel 48 not included in the boundary section 46, for example, a pixel $\mathbf{48}_{(K-1,\ q)}$ adjacent to the pixel $\mathbf{48}_{(K,\ q)}$ in the display region 45*a* is lighted similarly to FIG. 5. That is, a first sub-pixel $\mathbf{49}R_{(K-1,\ q)}$ of the pixel $\mathbf{48}_{(K-1,\ q)}$ is fully lighted, and a second sub-pixel $\mathbf{49}G_{(K-1,\ q)}$ and a third sub-pixel $\mathbf{49}B_{(K-1,\ q)}$ are unlighted. Similarly, in the display region 45*b*, a pixel $\mathbf{48}_{(K+2,\ q)}$ adjacent to the pixel $\mathbf{48}_{(K+1,\ q)}$ is lighted similarly to FIG. 5. That is, a second sub-pixel $\mathbf{49}G_{(K+2,\ q)}$ of the pixel $\mathbf{48}_{(K+2,\ q)}$ is fully lighted, and a first sub-pixel $\mathbf{49}R_{(K+2,\ q)}$ and a third sub-pixel $\mathbf{49}B_{(K+2,\ q)}$ are unlighted.

The luminance change is reduced between the pixel 48 in the boundary section 46, and the pixel 48 that is not included in the boundary section 46 and that is adjacent to the boundary section 46. For example, in the display region 45*a*, between the pixel $\mathbf{48}_{(K,\ q)}$ in the boundary section 46 and the pixel $\mathbf{48}_{(K-1,\ q)}$ adjacent to the pixel $\mathbf{48}_{(K,\ q)}$, the pixel $\mathbf{48}_{(K,\ q)}$ is lighted in a halftone manner, and the pixel $\mathbf{48}_{(K-1,\ q)}$ is lighted in the single color. To be more specific, the first sub-pixel $\mathbf{49}R_{(K,\ q)}$ of the pixel $\mathbf{48}_{(K,\ q)}$ is lighted in a halftone manner, and the second sub-pixel $\mathbf{49}G_{(K-1,\ q)}$ of the pixel $\mathbf{48}_{(K-1,\ q)}$ is unlighted. The adjacent first sub-pixel $\mathbf{49}R_{(K,\ q)}$ and second sub-pixel $\mathbf{49}G_{(K-1,\ q)}$ are lighted in a halftone manner and unlighted, respectively, and thus the luminance change is gradual.

In FIG. 10, none of the fourth sub-pixels 49W is lighted. Accordingly, the luminance change in the boundary section 46, and the luminance change between the boundary section and the display regions other than the boundary section is reduced, and the black streak is less likely to be visually recognized.

In this way, the unlighted sub-pixels are lighted in a halftone manner, and the fully lighted sub-pixels are lighted in a halftone manner, and therefore the luminance change is reduced, which prevents visual recognition of the streak. As described above, the visibility of a display image can be improved.

A method of lighting the sub-pixel in a halftone manner will be described below. To turn on the sub-pixel 49 in the pixel 48 in a halftone manner, sub-pixel rendering processing is performed. The sub-pixel rendering processing is processing to perform drive and displaying a sub-pixel unit, and change input signals of the sub-pixels 49 belonging to the same pixel 48. Hereinafter, the sub-pixel rendering processing is described as rendering processing as appropriate.

Input signals are input from the controller 20 to the pixels of the image display panel 40 through the image display panel driver 30. To be specific, signals are input from the controller 20 to the image display panel driver 30 with respect to the (p, q)-th pixel $\mathbf{48}_{(p,\ q)}$ ($1 \le p \le P_0$, and $1 \le q \le Q_0$), the signals including an input signal of a first sub-pixel $\mathbf{49}R_{(p,\ q)}$ with a signal value of $X_{1_(p,\ q)}$, an input signal of a second sub-pixel $\mathbf{49}G_{(p,\ q)}$ with a signal value of $X_{2_(p,\ q)}$, and an input signal of a third sub-pixel $\mathbf{49}B_{(p,\ q)}$ with a signal value of $X_{3_(p,\ q)}$. Further, a signal including the input signal of a fourth sub-pixel $\mathbf{49}W_{(p,\ q)}$ with a signal value of $X_{4-(p,\ q)}$ is input to the image display panel driver 30.

The input signal of the first sub-pixel $\mathbf{49}R_{(p,\ q)}$ is a signal for displaying the first color (red, for example) in the first sub-pixel $\mathbf{49}R_{(p,\ q)}$. The input signal of the second sub-pixel $\mathbf{49}G_{(p,\ q)}$ is a signal for displaying the second color (green, for example) in the second sub-pixel $\mathbf{49}G_{(p,\ q)}$. The input signal of the third sub-pixel $\mathbf{49}B_{(p,\ q)}$ is a signal for displaying the third color (blue, for example) in the third sub-pixel $\mathbf{49}B_{(p,\ q)}$. The input signal of the fourth sub-pixel $\mathbf{49}W_{(p,\ q)}$ is a signal for displaying the fourth color (white, for example) in the fourth sub-pixel $\mathbf{49}W_{(p,\ q)}$.

The input signals output from the controller 20 and input to the image display panel driver 30 are further output from the image display panel driver 30 and input to the pixels of the image display panel 40. The signal values of the input signals to the image display panel driver 30 may be changed when the signals are processed in and output from the image display panel driver 30. Assume that the signal value of the input signal to be input to the first sub-pixel $\mathbf{49}R_{(p,\ q)}$ is an input signal value $x_{1_(p,\ q)}$. Similarly, assume that the signal value of the input signal of the second sub-pixel $\mathbf{49}G_{(p,\ q)}$ is an input signal value $x_{2_(p,\ q)}$, the signal value of the input signal of the third sub-pixel $\mathbf{49}B_{(p,\ q)}$ is an input signal value $x_{3_(p,\ q)}$, and the signal value of the input signal of the fourth sub-pixel $\mathbf{49}W_{(p,\ q)}$ is an input signal value $x_{4_(p,\ q)}$.

Figure 11A:
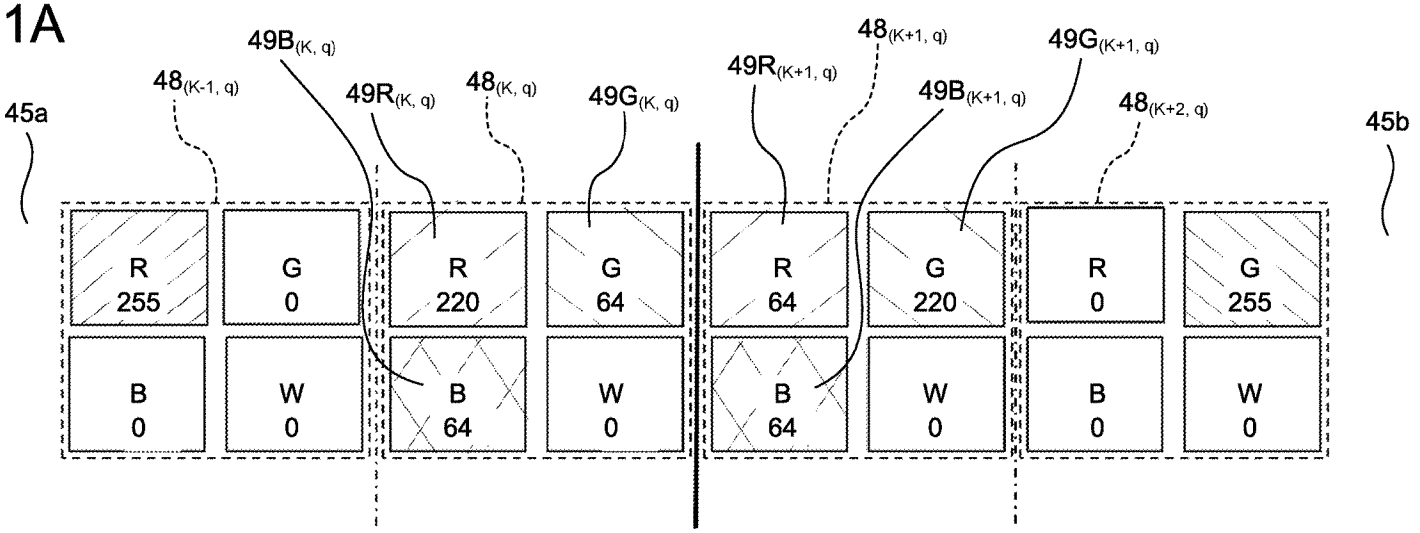
FIGS. 11A and 11B are diagrams illustrating the first embodiment.

FIG. 11A is an enlarged view of the pixels on the q-th row near the boundary section 46 of FIG. 10. FIG. 11A illustrates, from the left side of the drawing sheet, the input signal values of the respective sub-pixels in the pixel $\mathbf{48}_{(K-1,\ q)}$ not included in the boundary section 46 and the pixel $\mathbf{48}_{(K,\ q)}$ in the boundary section 46 in the display region 45*a*, and the pixel $\mathbf{48}_{(K+1,\ q)}$ in the boundary section 46 and the pixel $\mathbf{48}_{(K+2,\ q)}$ not included in the boundary section 46 in the display region 45*b*.

For example, the number 255 described in the pixel $\mathbf{48}_{(K-1,\ q)}$ in FIG. 11A indicates that an input signal value $x_{1_(K-1,\ q)}$ of the first sub-pixel $\mathbf{49}R_{(K-1,\ q)}$ is 255. Similarly, an input signal value $x_{2_(K-1,\ q)}$ of the second sub-pixel $\mathbf{49}G_{(K-1,\ q)}$ is 0. In the first embodiment, the display gradation bit number is 8 (the values of display gradation are 256 gradations from 0 to 255). Therefore, the input signal value x takes an integer value from 0 to 255. To fully turn on the sub-pixel 49, an input signal value x "255" is input. Meanwhile, to turn off the sub-pixel 49, an input signal value x "0" is input.

The first sub-pixel $\mathbf{49}R_{(K-1,\ q)}$ to which the input signal value $x_{1_(K-1,\ q)}$ "255" is input is fully lighted. Meanwhile, the second sub-pixel $\mathbf{49}G_{(K-1,\ q)}$ to which the input signal value $x_{2_(K-1,\ q)}$ "0" is input is unlighted.

In FIG. 11A, the fourth sub-pixels 49W are unlighted. Therefore, the input signal value $x_{4_(p,\ q)}$ to be input to an arbitrary fourth sub-pixel $\mathbf{49}W_{(p,\ q)}$ is 0.

In the example illustrated in FIG. 11A, an input signal value $x_{1_(K,\ q)}$ of the first sub-pixel $\mathbf{49}R_{(K,\ q)}$ is 220, an input signal value $x_{2_(K,\ q)}$ of the second sub-pixel $\mathbf{49}G_{(K,\ q)}$ is 64, and an input signal value $x_{3_(K,\ q)}$ of the third sub-pixel $\mathbf{49}B_{(K,\ q)}$ is 64 in the boundary section 46 on the display region 45*a* side. The first sub-pixel $\mathbf{49}R_{(K,\ q)}$ to which the input signal value $x_{1_(K,\ q)}$ "220" is input is lighted in halftone luminance between an unlighted state and a fully lighted state. The second sub-pixel $\mathbf{49}G_{(K,\ q)}$ to which the input signal value $x_{2_(K,\ q)}$ "64" is input is lighted in the halftone luminance. The third sub-pixel $\mathbf{49}B_{(K,\ q)}$ to which the input signal value $x_{3_(K,\ q)}$ "64" is input is lighted in the halftone luminance.

In this way, by inputting the input signal value x that causes the sub-pixel to be lighted in halftone luminance to the first sub-pixel $\mathbf{49}R_{(K,\ q)}$, the second sub-pixel $\mathbf{49}G_{(K,\ q)}$, and the third sub-pixel $\mathbf{49}B_{(K,\ q)}$, which are the sub-pixels of the pixel $\mathbf{48}_{(K,\ q)}$ in the boundary section 46, the first sub-pixel $\mathbf{49}R_{(K,\ q)}$, the second sub-pixel $\mathbf{49}G_{(K,\ q)}$, and the third sub-pixel $\mathbf{49}B_{(K,\ q)}$ can be lighted in a halftone manner.

Further, the input signal value $x_{1_(K,\ q)}$, the input signal value $x_{2_(K,\ q)}$, and the input signal value $x_{3_(K,\ q)}$ are preferably input in consideration of the sub-pixels originally supposed to be lighted and the sub-pixels originally supposed to be unlighted. That is, the first sub-pixel $\mathbf{49}R_{(K,\ q)}$ is originally supposed to be fully lighted, in other words, an input signal value $x_{1_(K,\ q)}$ "255" is input thereto. The second sub-pixel $\mathbf{49}G_{(K,\ q)}$ is originally supposed to be unlighted, in other words, an input signal value $x_{2_(K,\ q)}$ "0" is input thereto. The third sub-pixel $\mathbf{49}B_{(K,\ q)}$ is originally supposed to be unlighted, in other words, an input signal value $x_{3_(K,\ q)}$ "0" is input thereto.

In view of the foregoing, the input signal value $x_{1_(K,\ q)}$ has preferably a larger signal value than the input signal value $x_{2_(K,\ q)}$ and the input signal value $x_{3_(K,\ (q)}$, even if the sub-pixel is lighted in a halftone manner. As illustrated in FIG. 11A, the input signal value $x_{1_(K,q)}$ "220" is larger than the input signal value $x_{2_(K,q)}$ "64" and the input signal value $x_{3_(K,q)}$ "64", and thus the luminance of the first sub-pixel 49$R_{(K,q)}$ is higher than the luminance of the second sub-pixel 49$G_{(K,q)}$ and the third sub-pixel 49$B_{(K,q)}$. Accordingly, a luminance difference between the boundary section 46 and the display regions other than the boundary section 46 can be further reduced. The input signal values x of the sub-pixels 49 in different colors that are originally supposed to be unlighted may be the same or may be different from each other.

Similarly, in the example illustrated in FIG. 11A, an input signal value $x_{1_(K+1,q)}$ of the first sub-pixel 49$R_{(K+1,q)}$ is 64, an input signal value $x_{2_(K+1,q)}$ of the second sub-pixel 49$G_{(K+1,q)}$ is 220, and an input signal value $x_{3_(K+1,q)}$ of the third sub-pixel 49$B_{(K+1,q)}$ is 64 in the boundary section 46 on the display region 45*b* side. In this way, by inputting the input signal value x that causes the sub-pixel to be lighted in halftone luminance to the first sub-pixel 49$R_{(K+1,q)}$, the second sub-pixel 49$G_{(K+1,q)}$, and the third sub-pixel 49$B_{(K+1,q)}$, which are the sub-pixels of the pixel 48$_{(K+1,q)}$ in the boundary section 46 on the display region 45*b* side, the first sub-pixel 49$R_{(K+1,q)}$, the second sub-pixel 49$G_{(K+1,q)}$, and the third sub-pixel 49$B_{(K+1,q)}$ can be lighted in a halftone manner.

As described above, the sub-pixels 49 in the boundary section 46 are lighted in a halftone manner, and thus the luminance change in the boundary section can be reduced.

In FIG. 11A, the input signal values x that cause the sub-pixels to be lighted in halftone luminance are "220" and "64". However, these values are mere examples. The input signal value x may be any value as long as the value causes the sub-pixel to be lighted in halftone luminance.

By setting the signal values such that the input signal value x of the sub-pixel that is originally supposed to be fully lighted becomes larger than the input signal value x of the sub-pixel that is originally supposed to be unlighted, the luminance difference between the boundary section 46 and the display regions other than the boundary section 46 can be further reduced.

In the pixel 48$_{(K+2,q)}$ not included in the boundary section 46 on the display region 45*b* side, the second sub-pixel 49$G_{(K+2,q)}$ to which an input signal value $x_{2_(K+2,q)}$ "255" is input is fully lighted. Meanwhile, the first sub-pixel 49$R_{(K+2,q)}$ to which an input signal value $x_{1_(K+2,q)}$ "0" is input is unlighted. The third sub-pixel 49$B_{(K+2,q)}$ to which an input signal value $x_{3_(K+2,q)}$ "0" is input is unlighted.

As described with reference to FIG. 11A, in the boundary section 46, the input signal value to cause the sub-pixels that are originally supposed to be unlighted to display in a halftone manner is input thereto. Further, the input signal value to cause the sub-pixels that are originally supposed to be fully lighted to display in a halftone manner is also input thereto. Accordingly, the luminance change in the boundary section, and the luminance change between the boundary section and the display regions other than the boundary section are reduced, which prevents visual recognition of the black streak.

Further, the input signal value to be input to the sub-pixel that is originally supposed to be fully lighted is preferably made larger than the input signal value to be input to the sub-pixel that is originally supposed to be unlighted in the boundary section 46. By setting the input signal values in this way, the luminance change between the boundary section 46 and the display regions other than the boundary section 46 can be further reduced.

As described above, the visibility of a display image can be improved.

Figure 11B:
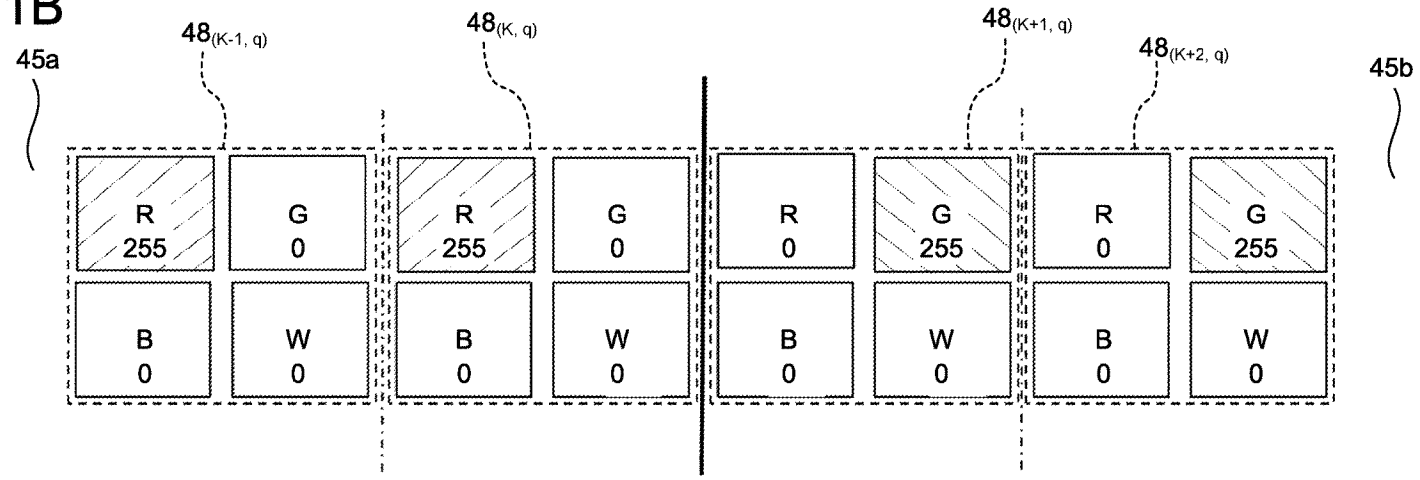

FIG. 11B is an enlarged view of the pixels on the q-th row near the boundary section 46 in FIG. 5. In FIG. 11B, the pixels included in the boundary section 46 are the pixel 48$_{(K,q)}$ and the pixel 48$_{(K+1,q)}$.

In FIG. 11B, the input signal value $x_{1_(K,q)}$ "255" is input to the first sub-pixel 49$R_{(K,q)}$, the input signal value $x_{2_(K,q)}$ "0" is input to the second sub-pixel 49$G_{(K,q)}$, and the input signal value $x_{3_(K,q)}$ "0" is input to the third sub-pixel 49$B_{(K,q)}$ in the pixel 48$_{(K,q)}$ in the boundary section 46 on the display region 45*a* side. Therefore, the first sub-pixel 49$R_{(K,q)}$ is fully lighted, and the second sub-pixel 49$G_{(K,q)}$ and the third sub-pixel 49$B_{(K,q)}$ are unlighted.

An input signal value $x_{2_(K+1,q)}$ "255" is input to the second sub-pixel 49$G_{(K+1,q)}$, an input signal value $x_{1_(K+1,q)}$ "0" is input to the first sub-pixel 49$R_{(K+1,q)}$, and an input signal value $x_{3_(K+1,q)}$ "0" is input to the third sub-pixel 49$B_{(K+1,q)}$ in the pixel 48$_{(K+1,q)}$ in the boundary section 46 on the display region 45*b* side. The first sub-pixel 49$R_{(K+1,q)}$ and the third sub-pixel 49$B_{(K+1,q)}$ are unlighted, and the second sub-pixel 49$G_{(K+1,q)}$ is fully lighted.

As illustrated in FIG. 11B, the second sub-pixel 49$G_{(K,q)}$ and the first sub-pixel 49$R_{(K+1,q)}$ are unlighted, which are arranged between the first sub-pixel 49$R_{(K,q)}$ and the second sub-pixel 49$G_{(K+1,q)}$ that are fully lighted. Neither the third sub-pixel 49$B_{(K,q)}$ nor the third sub-pixel 49$B_{(K+1,q)}$ is lighted. Such unlighted sub-pixels 49 are visually recognized as the black streak in the boundary section 46 where the different single colors are adjacent to each other.

Figure 29:
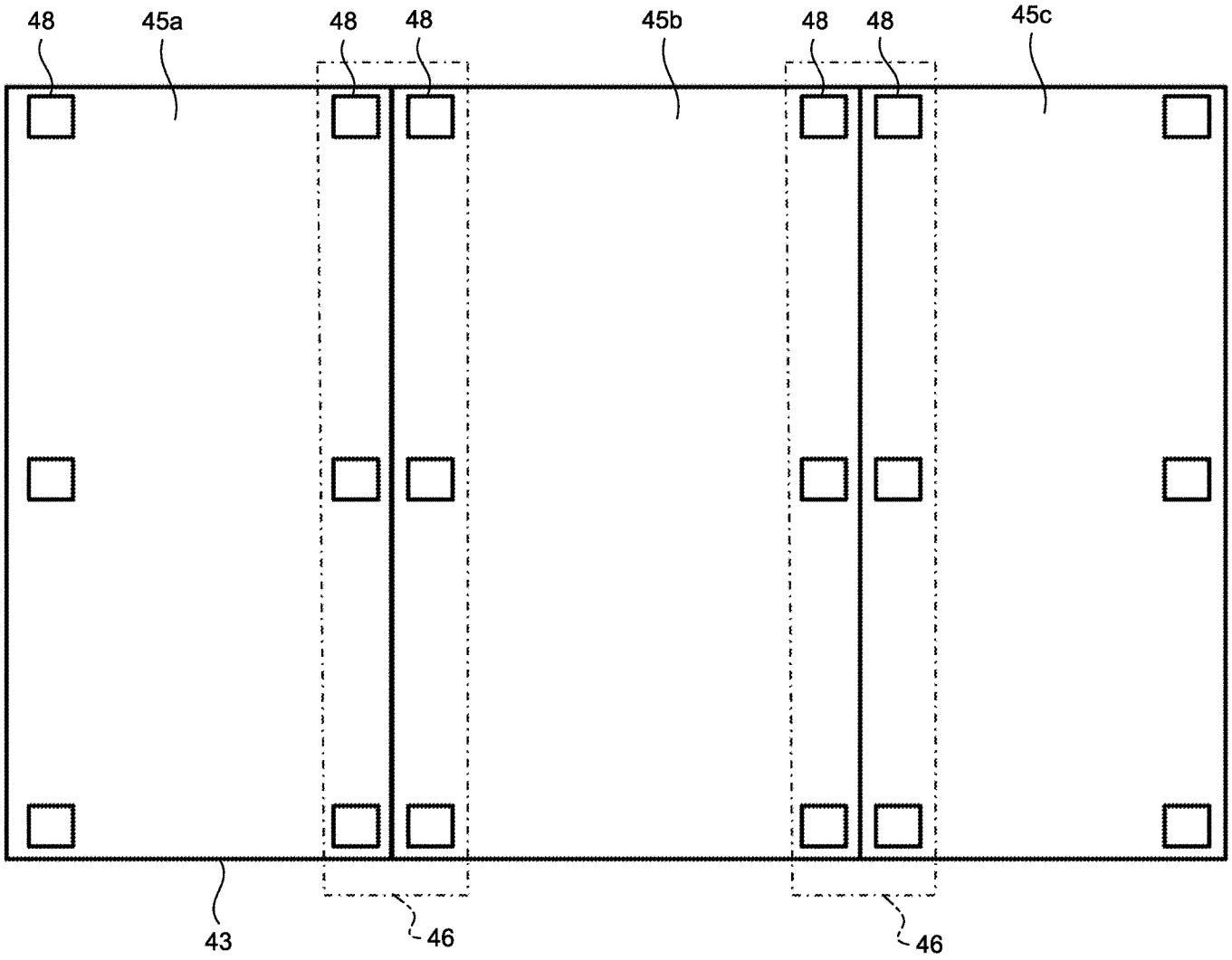
FIG. 29 is a diagram illustrating the first embodiment.

FIG. 29 illustrates an example in which three or more display regions 45 in single colors are adjacent to one another.

In FIG. 29, three display regions 45*a*, 45*b*, and 45*c* in single colors are arranged side by side, and pixel columns where the display region 45*a* and the display region 45*b* are adjacent to each other and pixel columns where the display region 45*b* and the display region 45*c* are adjacent to each other are the boundary sections 46.

Causing the pixels 48 included in the boundary sections 46 to be lighted in a halftone manner, as described above, prevents the boundary sections 46 from being visually recognized as streaks.

First Modification of First Embodiment

In FIGS. 10 and 11A, an example to prevent occurrence of the black streak illustrated in FIGS. 4 to 6 has been described. Hereinafter, an example to prevent occurrence of the bright streak illustrated in FIGS. 7 to 9 will be described.

A first modification will be described using FIGS. 12 and 13.

Figure 12:
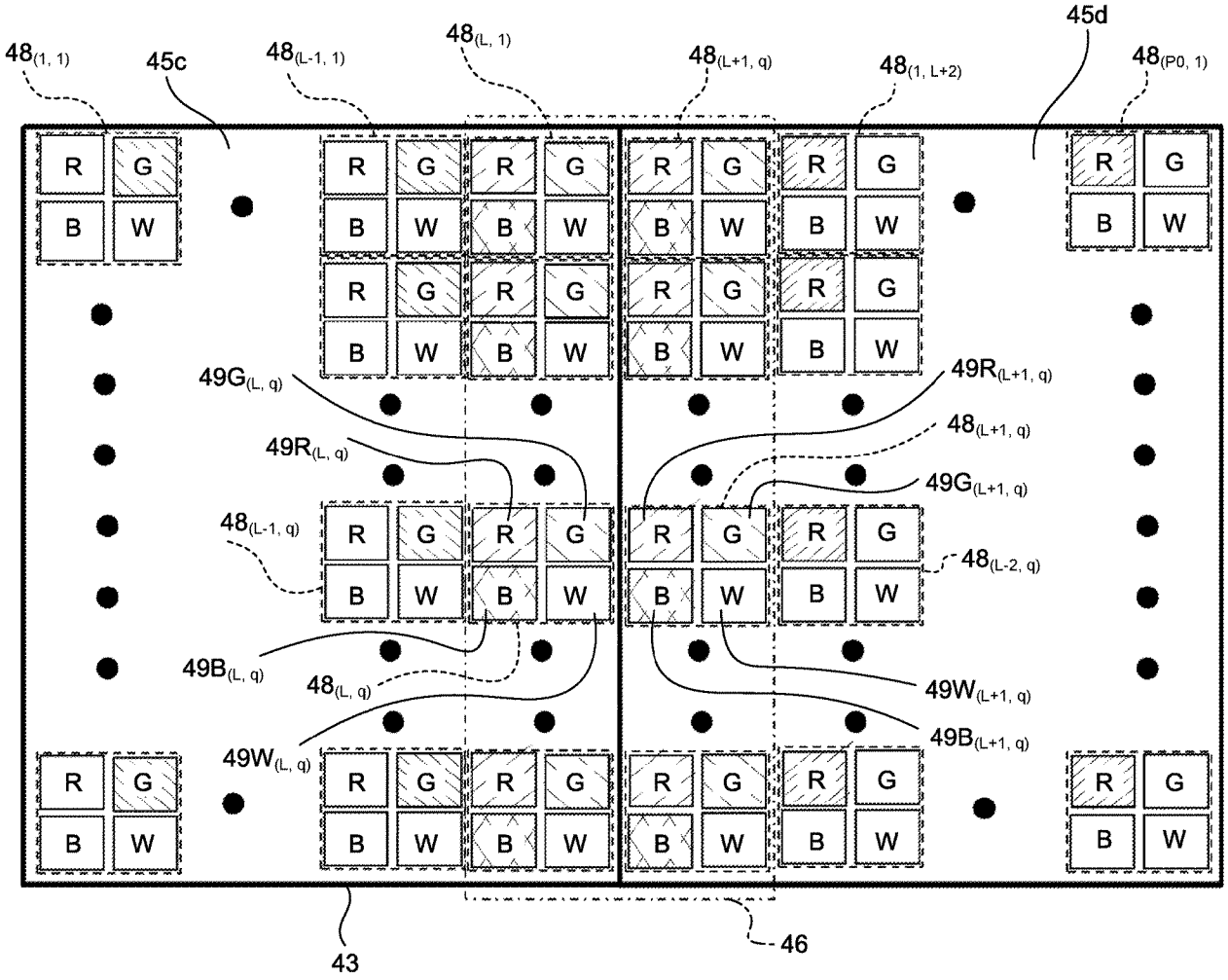
FIG. 12 is a diagram illustrating a first modification of the first embodiment.

FIG. 12 illustrates an example in which sub-pixels that are originally supposed to be unlighted, among sub-pixels in a boundary section 46, are lighted in a halftone manner in a display device illustrated in FIGS. 7 to 9. In FIG. 12, a pixel 48$_{(L,q)}$ on an L-th column on a display region 45*c* side and a pixel 48$_{(L+1,q)}$ on an (L+1)-th column on a display region 45*d* side are adjacent to each other in the boundary section 46 of the display regions 45*c* and 45*d* (L is an integer of 2 or more, and ($P_0$−2) or less).

For example, on a q-th row of the boundary section 46, a first sub-pixel 49$R_{(L,q)}$ and a third sub-pixel 49$B_{(L,q)}$ of the pixel 48$_{(L,q)}$ on the display region 45*c* side, which are unlighted in FIG. 8, are lighted in a halftone manner. A second sub-pixel 49$G_{(L+1,q)}$ and a third sub-pixel 49$B_{(L+1,q)}$ of the pixel $48_{(L+1,\ q)}$ on the display region 45*d* side, which are unlighted in FIG. 8, are lighted in a halftone manner.

Further, a second sub-pixel $49G_{(L,\ q)}$ of the pixel $48_{(L,\ q)}$ on the display region 45*c* side, which is fully lighted to display green in FIG. 8, is lighted in a halftone manner. Meanwhile, a first sub-pixel $49R_{(L+1,\ q)}$ of the pixel $48_{(L+1,\ q)}$ on the display region 45*d* side, which is fully lighted to display red in FIG. 8, is lighted in a halftone manner.

That is, in the pixel $48_{(L,\ q)}$ and the pixel $48_{(L+1,\ q)}$ adjacent to each other in the boundary section 46, the adjacent second sub-pixel $49G_{(L,\ q)}$ and first sub-pixel $49R_{(L+1,\ q)}$ that are originally supposed to be fully lighted are lighted in a halftone manner. Further, the first sub-pixel $49R_{(L,\ q)}$, the third sub-pixel $49B_{(L,\ q)}$, the second sub-pixel $49G_{(L+1,\ q)}$, and the third sub-pixel $49B_{(L+1,\ q)}$ that are originally supposed to be unlighted are lighted in a halftone manner. As described above, the sub-pixels 49 in the boundary section 46 are lighted in a halftone manner, and thus luminance change in the boundary section is reduced.

Meanwhile, in the pixel 48 not included in the boundary section 46, for example, in the display region 45*c*, a pixel $48_{(L-1,\ q)}$ adjacent to the pixel $48_{(L,\ q)}$ is lighted similarly to FIG. 8. That is, a first sub-pixel $49R_{(L-1,\ q)}$ and a third sub-pixel $49B_{(L-1,\ q)}$ of the pixel $48_{(L-1,\ q)}$ are unlighted, and a second sub-pixel $49G_{(L-1,\ q)}$ is fully lighted. Similarly, in the display region 45*d*, a pixel $48_{(L+2,\ q)}$ adjacent to the pixel $48_{(L+1,\ q)}$ is lighted similarly to FIG. 8. That is, a first sub-pixel $49R_{(L+2,\ q)}$ is fully lighted, and a second sub-pixel $49G_{(L+2,\ q)}$ and a third sub-pixel $49B_{(L+2,\ q)}$ of the pixel $48_{(L+2,\ q)}$ are unlighted.

Luminance change is reduced between the pixel 48 in the boundary section 46, and the pixel 48 that is not included in the boundary section 46 and that is adjacent to the boundary section 46. For example, in the display region 45*c*, between the pixel $48_{(L,\ q)}$ in the boundary section 46 and the pixel $48_{(L-1,\ q)}$ adjacent to the pixel $48_{(L,\ q)}$, the pixel $48_{(L,\ q)}$ is lighted in a halftone manner, and the pixel $48_{(L-1,\ q)}$ is lighted in a single color. To be more specific, the first sub-pixel $49R_{(L,\ q)}$ of the pixel $48_{(L,\ q)}$ is lighted in a halftone manner, and the second sub-pixel $49G_{(L-1,\ q)}$ of the pixel $48_{(L-1,\ q)}$ is fully lighted. The adjacent first sub-pixel $49R_{(L,\ q)}$ and second sub-pixel $49G_{(L-1,\ q)}$ are lighted in a halftone manner and fully lighted, respectively, and thus the luminance change is gradual.

In this way, the adjacent sub-pixels that are originally supposed to be fully lighted are lighted in a halftone manner, and the sub-pixels that are adjacent to the adjacent sub-pixels, and that are originally supposed to be unlighted are also lighted in a halftone manner. Therefore, the luminance change is reduced, which prevents a bright streak from being visually recognized. As described above, the visibility of a display image can be improved.

Figure 13A:
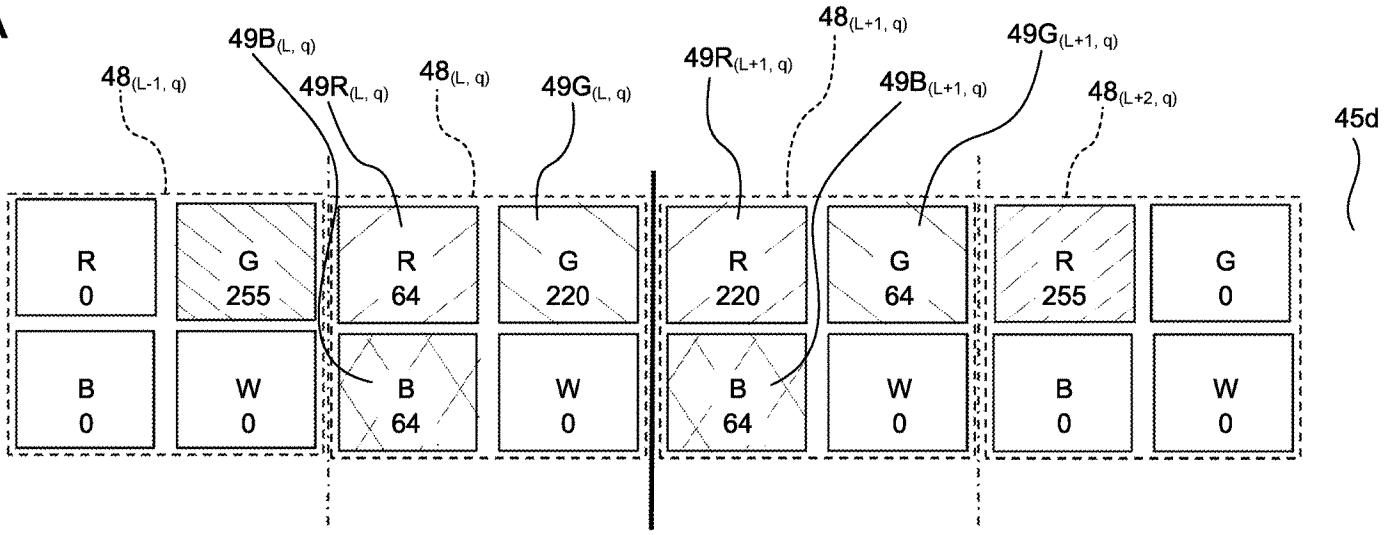
FIGS. 13A and 13B are diagrams illustrating the first modification of the first embodiment.

FIG. 13A is an enlarged view of the pixels on the q-th row near the boundary section 46 of FIG. 12. FIG. 13A illustrates, from the left side on the drawing sheet, input signal values of the respective sub-pixels in the pixel $48_{(L-1,\ q)}$ not included in the boundary section 46 and the pixel $48_{(L,\ q)}$ in the boundary section 46 in the display region 45*c*, and the pixel $48_{(L+1,\ q)}$ in the boundary section 46 and the pixel $48_{(L+2,\ q)}$ not included in the boundary section 46 in the display region 45*d*.

The first sub-pixel $49R_{(L-1,\ q)}$ to which an input signal value $x_{1_(L-1,\ q)}$ "0" is input is unlighted. The third sub-pixel $49B_{(L-1,\ q)}$ to which an input signal value $x_{3_(L-1,\ q)}$ "0" is input is unlighted. Meanwhile, the second sub-pixel $49G_{(L-1,\ q)}$ to which an input signal value $x_{2_L-1,\ q)}$ "255" is input is fully lighted.

In FIG. 13A, fourth sub-pixels 49W are unlighted. Therefore, an input signal value $x_{4_(p,\ q)}$ to be input to an arbitrary fourth sub-pixel $49W_{(p,\ q)}$ is 0.

In the example illustrated in FIG. 13A, an input signal value $x_{1_(L,\ q)}$ of the first sub-pixel $49R_{(L,\ q)}$ is 64, an input signal value $x_{2_(L,\ q)}$ of the second sub-pixel $49G_{(L,\ q)}$ is 220, and an input signal value $x_{3_(L,\ q)}$ of the third sub-pixel $49B_{(L,\ q)}$ is 64 in the boundary section 46 on the display region 45*c* side. The first sub-pixel $49R_{(L,\ q)}$ to which the input signal value $x_{1_(L,\ q)}$ "64" is input is lighted in halftone luminance. The second sub-pixel $49G_{(L,\ q)}$ to which the input signal value $x_{2_(L,\ q)}$ "220" is input is lighted in halftone luminance. The third sub-pixel $49B_{(L,\ q)}$ to which the input signal value $x_{3_(L,\ q)}$ "64" is input is lighted in halftone luminance.

In this way, by inputting the input signal value x that causes the sub-pixel to be lighted in halftone luminance to the first sub-pixel $49R_{(L,\ q)}$, the second sub-pixel $49G_{(L,\ q)}$, and the third sub-pixel $49B_{(L,\ q)}$, which are the sub-pixels of the pixel $48_{(L,\ q)}$ in the boundary section 46, the first sub-pixel $49R_{(L,\ q)}$, the second sub-pixel $49G_{(L,\ q)}$, and the third sub-pixel $49B_{(L,\ q)}$ can be lighted in a halftone manner.

The input signal value $x_{1_(L,\ q)}$, the input signal value $x_{2_(L,\ q)}$, and the input signal value $x_{3_(L,\ q)}$ are preferably input in consideration of the sub-pixels that are originally supposed to be lighted and the sub-pixels that are originally supposed to be unlighted. That is, the first sub-pixel $49R_{(L,\ q)}$ is originally supposed to be unlighted, in other words, an input signal value $x_{1_(L,\ q)}$ "0" is input thereto. The second sub-pixel $49G_{(L,\ q)}$ is originally supposed to be fully lighted, in other words, an input signal value $x_{1_(L,\ q)}$ "255" is input thereto. The third sub-pixel $49B_{(L,\ q)}$ is originally supposed to be unlighted, in other words, an input signal value $x_{3_(L,\ q)}$ "0" is input thereto.

In view of the foregoing, the input signal value $x_{1_(L,\ q)}$ and the input signal value $x_{3_(L,\ q)}$ are preferably smaller than the input signal value $x_{2_(L,\ q)}$ even if the sub-pixel is lighted in a halftone manner. As illustrated in FIG. 13A, the input signal value $x_{1_(L,\ q)}$ and the input signal value $x_{3_(L,\ q)}$ "64" are smaller than the input signal value $x_{2_(L,\ q)}$ "220". Therefore, the luminance of the first sub-pixel $49R_{(L,\ q)}$ and the third sub-pixel $49B_{(L,\ q)}$ is lower than the luminance of the second sub-pixel $49G_{(L,\ q)}$. Accordingly, a luminance difference between the boundary section 46 and the display regions other than the boundary section 46 can be further reduced.

Similarly, in the example illustrated in FIG. 13A, an input signal value $x_{1_(L+1,\ q)}$ of the first sub-pixel $49R_{(L+1,\ q)}$ is 220, an input signal value $x_{2_(L+1,\ q)}$ of the second sub-pixel $49G_{(L+1,\ q)}$ is 64, and an input signal value $x_{3_(L+1,\ q)}$ of the third sub-pixel $49B_{(L+1,\ q)}$ is 64 in the boundary section 46 on the display region 45*d* side. In this way, by inputting the input signal value x that causes the sub-pixel to be lighted in halftone luminance to the first sub-pixel $49R_{(L+1,\ q)}$, the second sub-pixel $49G_{(L+1,\ q)}$, and the third sub-pixel $49B_{(L+1,\ q)}$, which are the sub-pixels of the pixel $48_{(L+1,\ q)}$ in the boundary section 46 on the display region 45*d* side, the first sub-pixel $49R_{(L+1,\ q)}$, the second sub-pixel $49G_{(L+1,\ q)}$, and the third sub-pixel $49B_{(L+1,\ q)}$ can be lighted in a halftone manner.

As described above, the sub-pixels 49 in the boundary section 46 are lighted in a halftone manner, and thus the luminance change in the boundary section can be reduced.

In FIG. 13A, the input signal values x that cause the sub-pixels to be lighted in halftone luminance are "220" and "64". However, these values are mere examples. The input signal value x may be any value as long as the value causes the sub-pixel to be lighted in halftone luminance.

By setting the signal values such that the input signal value x of the sub-pixel that is originally supposed to be unlighted becomes smaller than the input signal value x of the sub-pixel that is originally supposed to be fully lighted, the luminance difference between the boundary section 46 and the display regions other than the boundary section 46 can be further reduced.

The first sub-pixel 49$R_{(L+2,\ q)}$ to which an input signal value $x_{1_(L+2,\ q)}$ "255" is input is fully lighted in the pixel 48$_{(L+2,\ q)}$ not included in the boundary section 46 on the display region 45*d* side. Meanwhile, the second sub-pixel 49$G_{(L+2,\ q)}$ to which an input signal value $x_{2_(L+2,\ q)}$ "0" is input is unlighted. Further, the third sub-pixel 49$B_{(L+2,\ q)}$ to which an input signal value $x_{3_(L+2,\ q)}$ "0" is input is unlighted.

As described with reference to FIG. 13A, in the boundary section 46, the input signal value to cause the sub-pixels that are originally supposed to be fully lighted to display in a halftone manner is input thereto. Further, the input signal value to cause the sub-pixels that are originally supposed to be unlighted to display in a halftone manner is also input thereto. Accordingly, the luminance change in the boundary section, and the luminance change between the boundary section and the display regions other than the boundary section are reduced, which prevents the bright streak from being visually recognized.

Further, the input signal value to be input to the sub-pixel that is originally supposed to be unlighted is preferably made smaller than the input signal value to be input to the sub-pixel that is originally supposed to be fully lighted in the boundary section 46. By setting input signal values in this way, the luminance change between the boundary section 46 and the display regions other than the boundary section 46 can be further reduced.

As described above, the visibility of a display image can be improved.

Figure 13B:
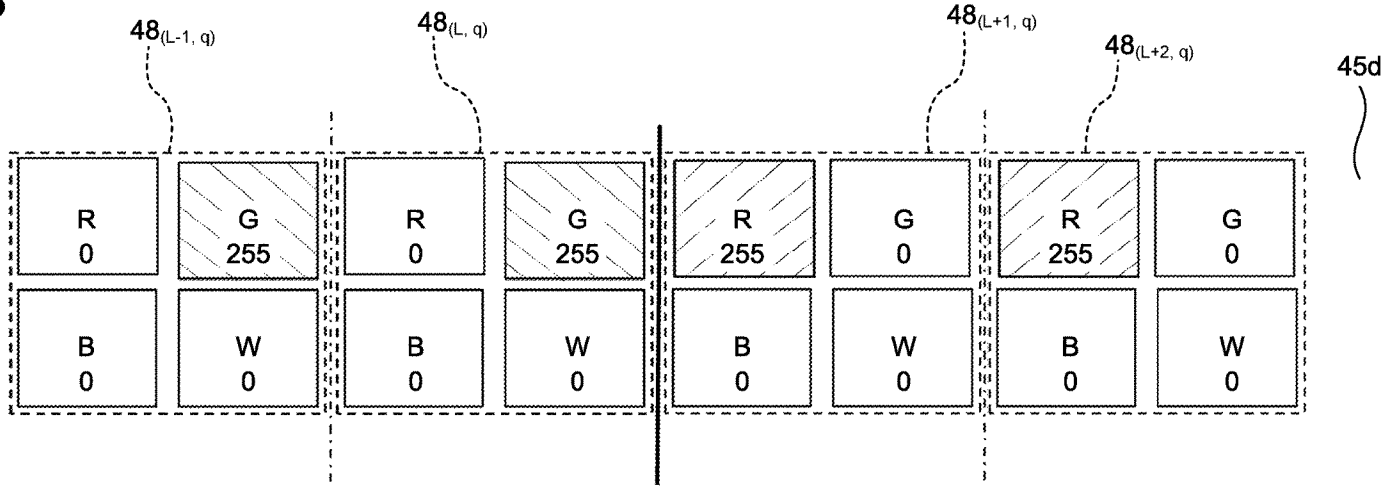

FIG. 13B is an enlarged view of the pixels on the q-th row near the boundary section 46 in FIG. 8. In FIG. 13B, the pixels included in the boundary section 46 are the pixel 48$_{(L,\ q)}$ and the pixel 48$_{(L+1,\ q)}$.

In FIG. 13B, in the pixel 48$_{(L,\ q)}$ in the boundary section 46 on the display region 45*c* side, the input signal value $x_{1_(L,\ q)}$ "0" is input to the first sub-pixel 49$R_{(L,\ q)}$, the input signal value $x_{2_(L,\ q)}$ "255" is input to the second sub-pixel 49$G_{(L,\ q)}$, and the input signal value $x_{3_(L,\ q)}$ "0" is input to the third sub-pixel 49$B_{(L,\ q)}$. Therefore, the first sub-pixel 49$R_{(L,\ q)}$ and the third sub-pixel 49$B_{(L,\ q)}$ are unlighted, and the second sub-pixel 49$G_{(L,\ q)}$ is fully lighted.

In the pixel 48$_{(L+1,\ q)}$ in the boundary section 46 on the display region 45*d* side, the input signal value $x_{1_(L+1,\ q)}$ "255" is input to the first sub-pixel 49$R_{(L+1,\ q)}$, the input signal value $x_{2_(L+1,\ q)}$ "0" is input to the second sub-pixel 49$G_{(L+1,\ q)}$, and the input signal value $x_{3_(L+1,\ q)}$ "0" is input to the third sub-pixel 49$B_{(L+1,\ q)}$. The first sub-pixel 49$R_{(L+1,\ q)}$ is fully lighted, and the second sub-pixel 49$G_{(L+1,\ q)}$ and the third sub-pixel 49$B_{(L+1,\ q)}$ are unlighted.

As illustrated in FIG. 13B, the adjacent second sub-pixel 49$G_{(L,\ q)}$ and first sub-pixel 49$R_{(L+1,\ q)}$ are fully lighted. Further, the first sub-pixel 49$R_{(L,\ q)}$ of the pixel 48$_{(L,\ q)}$, and the second sub-pixel 49$G_{(L+1,\ q)}$ of the pixel 48$_{(L+1,\ q)}$ are unlighted. Neither the third sub-pixel 49$B_{(L,\ q)}$ nor the third sub-pixel 49$B_{(L+^{1,\ q})}$ is lighted. In this way, in the boundary section 46 where different single colors are displayed, the single colors are mixed with each other, and are visually recognized as a bright streak.

The present modification is applicable to a configuration of having three or more display regions, as described in the first embodiment.

Second Modification of First Embodiment

In the first embodiment and the first modification thereof, an example of displaying the primary colors of the single colors adjacent to each other has been described. In a second modification of the first embodiment, an example of displaying complementary colors of primary colors, for example, an example of displaying any two of cyan (C), magenta (M), yellow (Y) adjacent to each other will be described.

The second modification will be described with reference to FIGS. 14 and 15.

Figure 14:
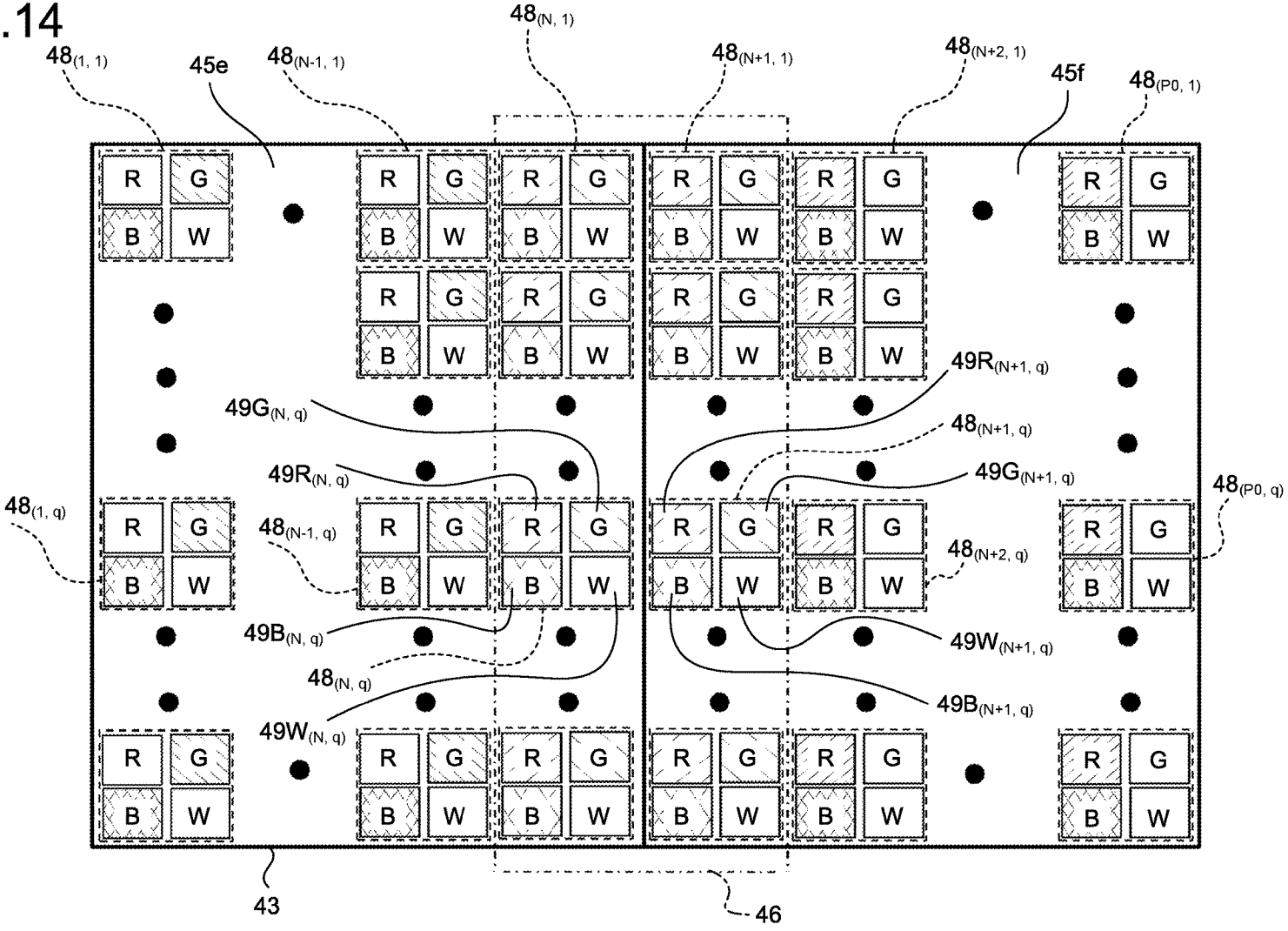
FIG. 14 is a diagram illustrating a second modification of the first embodiment.

FIG. 14 illustrates an example of displaying cyan and magenta adjacent to each other as single colors. In FIG. 14, in a boundary section 46 of a display region 45*e* in which cyan is displayed and a display region 45*f* where magenta is displayed, a pixel 48$_{(N,\ q)}$ on an N-th column on the display region 45*e* side and a pixel 48$_{(N+1,\ q)}$ on an (N+1)-th column on the display region 45*f* side are adjacent to each other (N is an integer of two or more, and ($P_0$−2) or less).

To display cyan, a second sub-pixel 49G and a third sub-pixel 49B may be lighted. To display magenta, a first sub-pixel 49R and a third sub-pixel 49B may be lighted.

Therefore, regarding the pixels 48 not included in the boundary section 46, the second sub-pixels 49G and the third sub-pixels 49B are fully lighted, and the first sub-pixel 49R and fourth sub-pixel 49W are unlighted in a pixel 48$_{(1,\ q)}$ to a pixel 48$_{(N-1,\ q)}$ in the display region 45*e*. Similarly, regarding the pixels 48 not included in the boundary section 46, the first sub-pixels 49R and the third sub-pixels 49B are fully lighted, and the second sub-pixels 49G and the fourth sub-pixels 49W are unlighted in a pixel 48$_{(N+2,\ q)}$ to a pixel 48$_{(P0,\ q)}$ in the display region 45*f*.

In the boundary section 46, the pixel 48$_{(N,\ q)}$ on the display region 45*e* side and the pixel 48$_{(N+1,\ q)}$ on the display region 45*f* side are lighted in a halftone manner. More specific example will be described below.

For example, on a q-th row in the boundary section 46, a first sub-pixel 49$R_{(N,\ q)}$ of the pixel 48$_{(N,\ q)}$ on the display region 45*e* side, which is originally supposed to be unlighted, is lighted in a halftone manner.

Further, a second sub-pixel 49$G_{(N,\ q)}$ and a third sub-pixel 49$B_{(N,\ q)}$ of the pixel 48$_{(N,\ q)}$ on the display region 45*e* side, which are originally supposed to be fully lighted, are lighted in a halftone manner.

A second sub-pixel 49$G_{(N+1,\ q)}$ of the pixel 48$_{(N+1,\ q)}$ on the display region 45*f* side, which is originally supposed to be unlighted, is lighted in a halftone manner.

Further, a first sub-pixel 49$R_{(N+1,\ q)}$ and a third sub-pixel 49$B_{(N+1,\ q)}$ of the pixel 48$_{(N+1,\ q)}$ on the display region 45*f* side, which are originally supposed to be fully lighted, are lighted in a halftone manner.

In FIG. 14, none of the fourth sub-pixels 49W is lighted.

As described above, the sub-pixels 49 in the boundary section 46 are lighted in a halftone manner, and thus luminance change in the boundary section is reduced.

The luminance change is reduced between the pixel 48 in the boundary section 46, and the pixel 48 that is not included in the boundary section 46 and that is adjacent to the boundary section 46. For example, in the display region 45*e*, the pixel 48$_{(N,\ q)}$ is lighted in a halftone manner and the pixel 48$_{(N-1,\ q)}$ is fully lighted between the pixel 48$_{(N,\ q)}$ in the boundary section 46 and the pixel 48$_{(N-1,\ q)}$ adjacent to the pixel $48_{(N, q)}$. Accordingly, the luminance change in the boundary section 46 and the regions other than the boundary section 46 is reduced.

Accordingly, the luminance change in the boundary section 46, and the luminance change between the boundary section and the display regions other than the boundary section are reduced, which prevents a streak in the boundary section from being visually recognized.

In this way, the sub-pixels that are originally supposed to be unlighted are lighted in a halftone manner, and the sub-pixels that are originally supposed to be fully lighted are also lighted in a halftone manner. Therefore, the luminance change is reduced, which prevents the streak from being visually recognized. As described above, the visibility of a display image can be improved.

Figure 15:
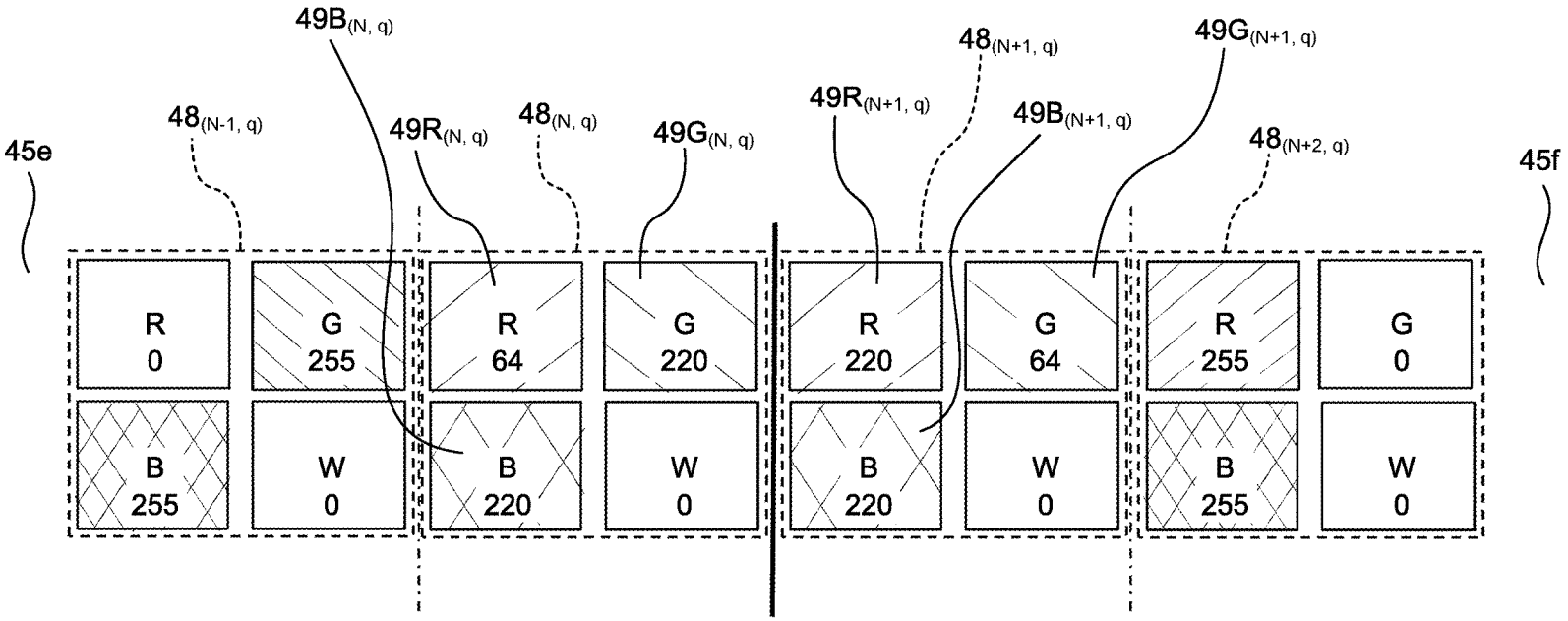
FIG. 15 is a diagram illustrating the second modification of the first embodiment.

FIG. 15 is an enlarged view of the pixels on the q-th row near the boundary section 46 of FIG. 14. FIG. 15 illustrates, from the left side on the drawing sheet, input signal values of the respective sub-pixels in the pixel $48_{(N-1, q)}$ not included in the boundary section 46 and the pixel $48_{(N, q)}$ in the boundary section 46 in the display region 45*e*, and the pixel $48_{(N+1, q)}$ in the boundary section 46 and the pixel $48_{(N+2, q)}$ not included in the boundary section 46 in the display region 45*f*.

A second sub-pixel $49G_{(N-1, q)}$ to which an input signal value $x_{2_(N-q)}$ "255" is input is fully lighted. A third sub-pixel $49B_{(N-1, q)}$ to which an input signal value $x_{3_(N-1, q)}$ "255" is input is fully lighted. Meanwhile, a first sub-pixel $49R_{(N-1, q)}$ to which an input signal value $x_{1_(N-1, q)}$ "0" is input is unlighted.

In FIG. 15, the fourth sub-pixels 49W are unlighted. Therefore, an input signal value $x_{4_(p, q)}$ to be input to an arbitrary fourth sub-pixel $49W_{(p, q)}$ is 0.

In the example illustrated in FIG. 15, an input signal value $x_{1_(N, q)}$ of the first sub-pixel $49R_{(N, q)}$ is 64, an input signal value $x_{2_(N, q)}$ of the second sub-pixel $49G_{(N, q)}$ is 220, and an input signal value $x_{3_(N, q)}$ of the third sub-pixel $49B_{(N, q)}$ is 220 in the boundary section 46 on the display region 45*e* side. The first sub-pixel $49R_{(N, q)}$ to which the input signal value $x_{1_(N, q)}$ "64" is input is lighted in halftone luminance. The second sub-pixel $49G_{(N, q)}$ to which the input signal value $x_{2_(N, q)}$ "220" is input is lighted in halftone luminance. The third sub-pixel $49B_{(N, q)}$ to which the input signal value $x_{3_(N, q)}$ "220" is input is lighted in halftone luminance.

In this way, by inputting the input signal value x that causes the sub-pixel to be lighted in halftone luminance to the first sub-pixel $49R_{(N, q)}$, the second sub-pixel $49G_{(N, q)}$, and the third sub-pixel $49B_{(N, q)}$, which are the sub-pixels of the pixel $48_{(N, q)}$ in the boundary section 46, the first sub-pixel $49R_{(N, q)}$, the second sub-pixel $49G_{(N, q)}$, and the third sub-pixel $49B_{(N, q)}$ are lighted in a halftone manner.

Further, the input signal value $x_{1_(N, q)}$, the input signal value $x_{2_(N, q)}$, and the input signal value $x_{3_(N, q)}$ are preferably input in consideration of the sub-pixels that are originally supposed to be lighted and the sub-pixels that are originally supposed to be unlighted. That is, the first sub-pixel $49R_{(N, q)}$ is originally supposed to be unlighted, in other words, an input signal value $x_{1_(N, q)}$ "0" is input thereto. The second sub-pixel $49G_{(N, q)}$ is originally supposed to be fully lighted, in other words, an input signal value $x_{2_(N, q)}$ "255" is input thereto. The third sub-pixel $49B_{(N, q)}$ is originally supposed to be fully lighted, in other words, an input signal value $x_{3_(N, q)}$ "255" is input thereto. In view of the foregoing, the input signal value x for causing the sub-pixel to be lighted in a halftone manner is preferably input in consideration of the input signal value x that is originally supposed to be input.

Similarly, in the example illustrated in FIG. 15, an input signal value $x_{1_(N+1, q)}$ of the first sub-pixel $49R_{(N+1, q)}$ is 220, an input signal value $x_{2_(N+1, q)}$ of the second sub-pixel $49G_{(N+1, q)}$ is 64, and an input signal value $x_{3_(N+1, q)}$ of the third sub-pixel $49B_{(N+1, q)}$ is 220 in the boundary section 46 on the display region 45*f* side. In this way, by inputting the input signal value x that causes the sub-pixel to be lighted in halftone luminance to the first sub-pixel $49R_{(N+1, q)}$, the second sub-pixel $49G_{(N+1, q)}$, and the third sub-pixel $49B_{(N+1, q)}$, which are the sub-pixels of the pixel $48_{(N+1, q)}$ in the boundary section 46 on the display region 45*f* side, the first sub-pixel $49R_{(N+1, q)}$, the second sub-pixel $49G_{(N+1, q)}$, and the third sub-pixel $49B_{(N+1, q)}$ can be lighted in a halftone manner.

As described above, the sub-pixels 49 in the boundary section 46 are lighted in a halftone manner, and thus the luminance change in the boundary section can be reduced.

In FIG. 15, the input signal values x that cause the sub-pixels to be lighted in halftone luminance are "220" and "64". However, these values are mere examples. The input signal value x may be any value as long as the value causes the sub-pixel to be lighted in halftone luminance.

As described in the first embodiment and its first modification, by setting the signal values such that the input signal value x of the sub-pixel that is originally supposed to be fully lighted becomes larger than the input signal value x of the sub-pixel that is originally supposed to be unlighted, a luminance difference between the boundary section 46 and the display regions other than the boundary section 46 can be further reduced.

In the pixel $48_{(N+2, q)}$ not included in the boundary section 46 on the display region 45*f* side, a first sub-pixel $49R_{(N+2, q)}$ to which an input signal value $x_{1_(N+2, q)}$ "255" is input is fully lighted. A third sub-pixel $49B_{(N+2, q)}$ to which an input signal value $x_{3_(N+2, q)}$ "255" is input is fully lighted. Meanwhile, a second sub-pixel $49G_{(N+2, q)}$ to which an input signal value $x_{2_(N+2, q)}$ "0" is input is unlighted.

As described using FIG. 15, in the boundary section 46, the input signal value to cause the sub-pixels that are originally supposed to be unlighted to display in a halftone manner is input thereto. Further, the input signal value to cause the sub-pixels that are originally supposed to be fully lighted to display in a halftone manner is also input thereto. Accordingly, the luminance change in the boundary section, and the luminance change between the boundary section and the display regions other than the boundary section are reduced, which prevents the streak from being visually recognized.

As described above, the visibility of a display image can be improved.

In the second modification, as an example of displaying the complementary colors of primary colors, an example of displaying cyan in the display region 45*e* and magenta in the display region 45*f* has been described. However, even in a case of displaying the complementary colors of other primary colors, the visual recognition of the streak can be eliminated, and the visibility of a display image can be improved.

Especially, as a combination of colors in the display region 45*e* (left side) and the display region 45*f* (right side), a combination of yellow (Y) and cyan (C), that of yellow (Y) and magenta (M), that of cyan (C) and yellow (Y), and that of cyan (C) and magenta (M) provide significant effects.

The present modification is applicable to a configuration of having three or more display regions, as described in the first embodiment.

Third Modification of First Embodiment

In a third modification of the first embodiment, an example of displaying a primary color and its complementary color adjacent to each other, for example, an example of displaying red (R) and cyan (C), green (G) and magenta (M), blue (B) and yellow (Y), respectively adjacent to each other, will be described.

The third modification will be described with reference to FIGS. 16 and 17.

Figure 16:
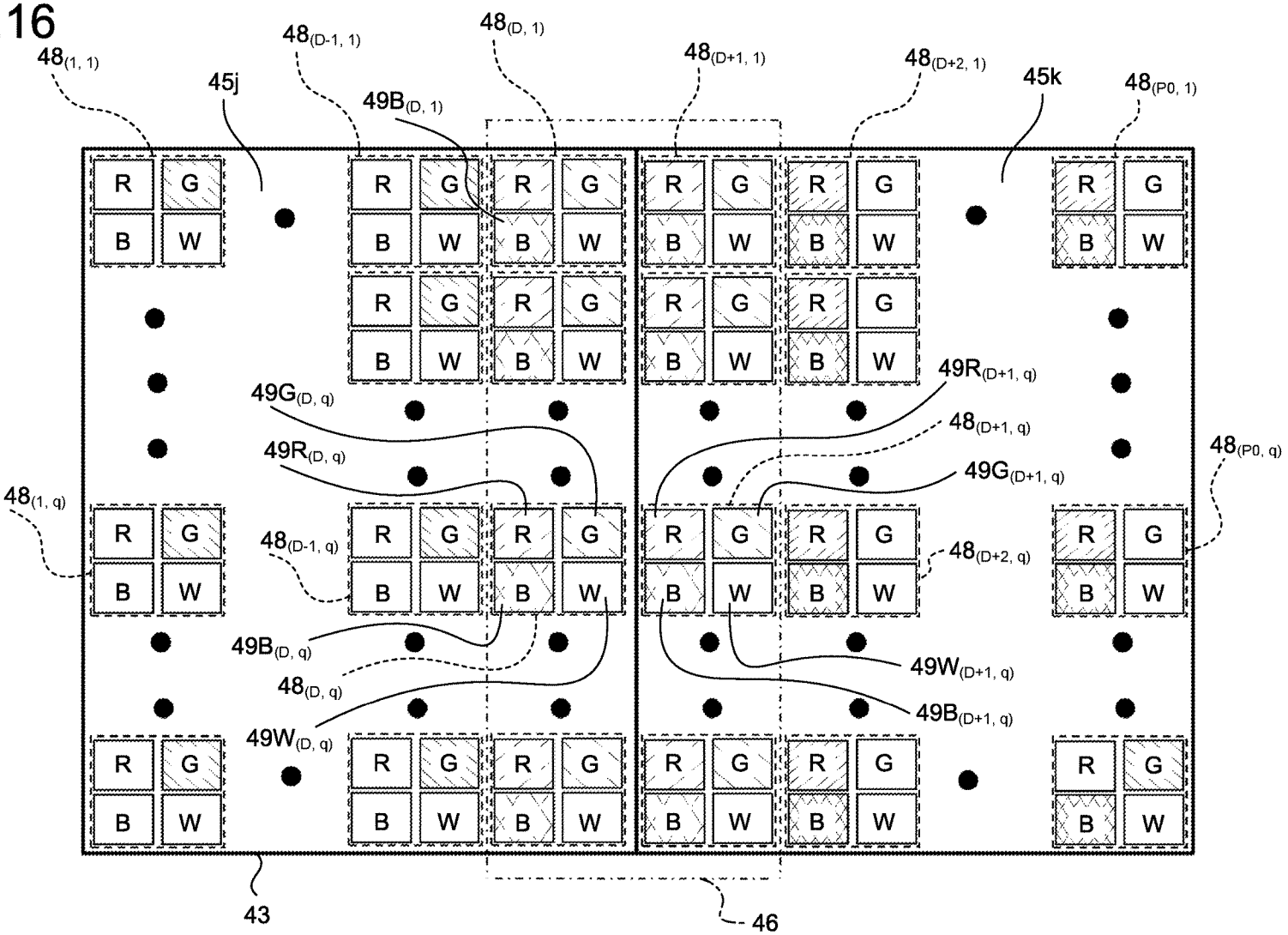
FIG. 16 is a diagram illustrating a third modification of the first embodiment.

FIG. 16 illustrates an example of displaying green and magenta adjacent to each other as single colors. In FIG. 16, assume that in a boundary section 46 of a display region 45*j* where green is displayed and a display region 45*k* where magenta is displayed, a pixel $\mathbf{48}_{(D,\ q)}$ on a D-th column on the display region 45*j* side and a pixel $\mathbf{48}_{(D+1,\ q)}$ on a (D+1)-th column on the display region 45*k* side are adjacent to each other (D is an integer of 2 or more, and ($P_0$−2) or less).

To display green, a second sub-pixel 49G may be lighted. To display magenta, a first sub-pixel 49R and a third sub-pixel 49B may be lighted.

Therefore, regarding the pixels 48 not included in the boundary section 46, the second sub-pixels 49G are fully lighted, and the first sub-pixels 49R, the third sub-pixels 49B, and fourth sub-pixels 49W are unlighted in a pixel $\mathbf{48}_{(1,\ q)}$ to a pixel $\mathbf{48}_{(D-1,\ q)}$ in the display region 45*j*. Similarly, regarding the pixels 48 not included in the boundary section 46, the first sub-pixels 49R and the third sub-pixels 49B are fully lighted, and the second sub-pixels 49G and the fourth sub-pixels 49W are unlighted in a pixel $\mathbf{48}_{(D+2,\ q)}$ to a pixel $\mathbf{48}_{(P0,\ q)}$ in the display region 45*k*.

In the boundary section 46, the pixel $\mathbf{48}_{(D,\ q)}$ on the display region 45*j* side and the pixel $\mathbf{48}_{(D+1,\ q)}$ on the display region 45*k* side are lighted in a halftone manner. More specific example will be described below.

For example, on a q-th row in the boundary section 46, a first sub-pixel $\mathbf{49}R_{(D,\ q)}$ and a third sub-pixel $\mathbf{49}B_{(D,\ q)}$ of the pixel $\mathbf{48}_{(D,\ q)}$ on the display region 45*j* side, which are originally supposed to be unlighted, are lighted in a halftone manner.

Further, a second sub-pixel $\mathbf{49}G_{(D,\ q)}$ of the pixel $\mathbf{48}_{(D,\ q)}$ on the display region 45*j* side, which is originally supposed to be fully lighted, is lighted in a halftone manner.

A second sub-pixel $\mathbf{49}G_{(D+1,\ q)}$ of the pixel $\mathbf{48}_{(D+1,\ q)}$ on the display region 45*k* side, which is originally supposed to be unlighted, is lighted in a halftone manner.

Further, a first sub-pixel $\mathbf{49}R_{(D+1,\ q)}$ and a third sub-pixel $\mathbf{49}B_{(D+1,\ q)}$ of the pixel $\mathbf{48}_{(D+1,\ q)}$ on the display region 45*k* side, which are originally supposed to be fully lighted, are lighted in a halftone manner.

In FIG. 16, the fourth sub-pixels 49W are unlighted.

As described above, the sub-pixels 49 in the boundary section 46 are lighted in a halftone manner, and thus luminance change in the boundary section is reduced.

The luminance change is reduced between the pixel 48 in the boundary section 46, and the pixel 48 that is not included in the boundary section 46 and that is adjacent to the boundary section 46. For example, in the display region 45*j*, the pixel $\mathbf{48}_{(D,\ q)}$ is lighted in a halftone manner, and the pixel $\mathbf{48}_{(D-1,\ q)}$ is lighted in the single color between the pixel $\mathbf{48}_{(D,\ q)}$ in the boundary section 46 and the pixel $\mathbf{48}_{(D-1,\ q)}$ adjacent to the pixel $\mathbf{48}_{(D,\ q)}$. Accordingly, the luminance change in the boundary section 46 and the regions other than the boundary section 46 is reduced.

Accordingly, the luminance change in the boundary section 46, and the luminance change between the boundary section and the display regions other than the boundary section are reduced, which prevents a streak in the boundary section from being visually recognized.

In this way, the sub-pixels that are originally supposed to be unlighted are lighted in a halftone manner, and the sub-pixels that are originally supposed to be fully lighted are also lighted in a halftone manner. Therefore, the luminance change is reduced, which prevents the streak from being visually recognized. As described above, the visibility of a display image can be improved.

Figure 17:
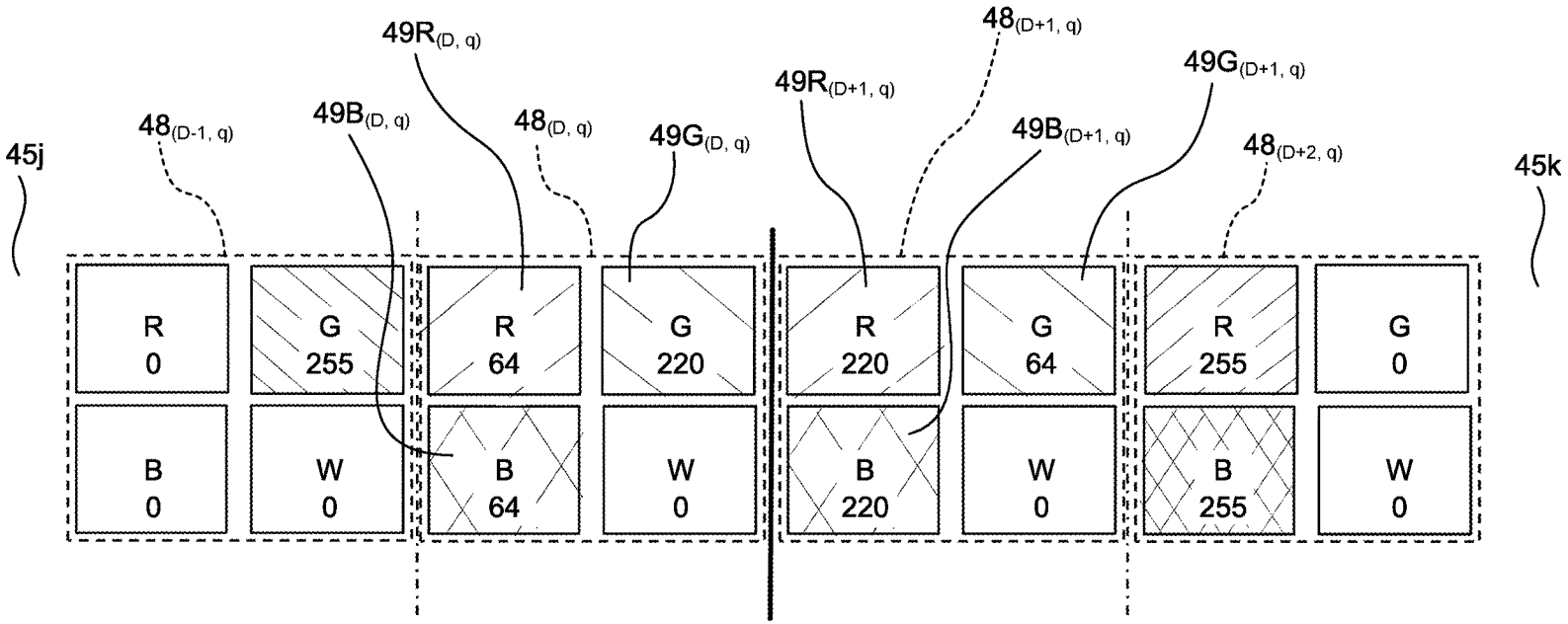
FIG. 17 is a diagram illustrating the third modification of the first embodiment.

FIG. 17 is an enlarged view of the pixels on the q-th row near the boundary section 46 of FIG. 16. FIG. 17 illustrates, from the left side on the drawing sheet, input signal values of the respective sub-pixels in the pixel $\mathbf{48}_{(D-1,\ q)}$ not included in the boundary section 46 and the pixel $\mathbf{48}_{(D,\ q)}$ in the boundary section 46 in the display region 45*j*, and the pixel $\mathbf{48}_{(D+1,\ q)}$ in the boundary section 46 and the pixel $\mathbf{48}_{(D+2,\ q)}$ not included in the boundary section 46 in the display region 45*k*.

A first sub-pixel $\mathbf{49}R_{(D-1,\ q)}$ to which an input signal value $x_{1_(D-1,\ q)}$ "0" is input is unlighted. Meanwhile, a second sub-pixel $\mathbf{49}G_{(D-1,\ q)}$ to which an input signal value $x_{2_(D-1,\ q)}$ "255" is input is fully lighted. A third sub-pixel $\mathbf{49}B_{(D-1,\ q)}$ to which an input signal value $x_{3_(D-1,\ q)}$ "0" is input is unlighted.

In FIG. 17, the fourth sub-pixels 49W are unlighted. Therefore, an input signal value $x_{4_(p,\ q)}$ to be input to an arbitrary fourth sub-pixel $\mathbf{49}W_{(p,\ q)}$ is 0.

In the example illustrated in FIG. 17, an input signal value $x_{1_(D,\ q)}$ of the first sub-pixel $\mathbf{49}R_{(D,\ q)}$ is 64, an input signal value $x_{2_(D,\ q)}$ of the second sub-pixel $\mathbf{49}G_{(D,\ q)}$ is 220, and an input signal value $x_{3_(D,\ q)}$ of the third sub-pixel $\mathbf{49}B_{(D,\ q)}$ is 64 in the boundary section 46 on the display region 45*j* side. The first sub-pixel $\mathbf{49}R_{(D,\ q)}$ to which the input signal value $x_{1_(D,\ q)}$ "64" is input is lighted in halftone luminance. The second sub-pixel $\mathbf{49}G_{(D,\ q)}$ to which the input signal value $x_{2_(D,\ q)}$ "220" is input is lighted in halftone luminance. The third sub-pixel $\mathbf{49}B_{(D,\ q)}$ to which the input signal value $x_{3_(D,\ q)}$ "64" is input is lighted in halftone luminance.

In this way, by inputting the input signal value x that causes the sub-pixel to be lighted in halftone luminance to the first sub-pixel $\mathbf{49}R_{(D,\ q)}$, the second sub-pixel $\mathbf{49}G_{(D,\ q)}$, and the third sub-pixel $\mathbf{49}B_{(D,\ q)}$, which are the sub-pixels of the pixel $\mathbf{48}_{(D,\ q)}$ in the boundary section 46, the first sub-pixel $\mathbf{49}R_{(D,\ q)}$, the second sub-pixel $\mathbf{49}G_{(D,\ q)}$, and the third sub-pixel $\mathbf{49}B_{(D,\ q)}$ are lighted in a halftone manner.

Further, the input signal value $x_{1_(D,\ q)}$, the input signal value $x_{2_(D,\ q)}$, and the input signal value $x_{3_(D,\ q)}$ are preferably input in consideration of the sub-pixels that are originally supposed to be lighted and the sub-pixels that are originally supposed to be unlighted. That is, the first sub-pixel $\mathbf{49}R_{(D,\ q)}$ is originally supposed to be unlighted, in other words, an input signal value $x_{1_(D,\ q)}$ "0" is input thereto. The second sub-pixel $\mathbf{49}G_{(D,\ q)}$ is originally supposed to be fully lighted, in other words, an input signal value $x_{2_(D,\ q)}$ "255" is input thereto. The third sub-pixel $\mathbf{49}B_{(D,\ q)}$ is originally supposed to be unlighted, in other words, an input signal value $x_{3_(D,\ q)}$ "0" is input thereto. In view of the foregoing, the input signal value x for causing the sub-pixel to be lighted in a halftone manner is preferably input in consideration of the input signal value x that is originally supposed to be input.

Similarly, in the example illustrated in FIG. 17, an input signal value $x_{1_(D+1,\ q)}$ of the first sub-pixel $\mathbf{49}R_{(D+1,\ q)}$ is 220, an input signal value $x_{2_(D+1,\ q)}$ of the second sub-pixel $\mathbf{49}G_{(D+1,\ q)}$ is 64, and an input signal value $x_{3_(D+1,\ q)}$ of the third sub-pixel $\mathbf{49}B_{(D+1,\ q)}$ is 220 in the boundary section 46 on the display region 45*k* side. In this way, by inputting the input signal value x that causes the sub-pixel to be lighted in halftone luminance to the first sub-pixel 49$R_{(D+1,\ q)}$, the second sub-pixel 49$G_{(D+1,\ q)}$, and the third sub-pixel 49$B_{(D+1,\ q)}$, which are the sub-pixels of the pixel 48$_{(D+1,\ q)}$ in the boundary section 46 on the display region 45*k* side, the first sub-pixel 49$R_{(D+1,\ q)}$, the second sub-pixel 49$G_{(D+1,\ q)}$, and the third sub-pixel 49$B_{(D+1,\ q)}$ can be lighted in a halftone manner.

As described above, the sub-pixels 49 in the boundary section 46 are lighted in a halftone manner, and thus the luminance change in the boundary section can be reduced.

In FIG. 17, the input signal values x that cause the sub-pixels to be lighted in halftone luminance are "220" and "64". However, these values are mere examples. The input signal value x may be any value as long as the value causes the sub-pixel to be lighted in halftone luminance.

As described in the first embodiment and the first and second modifications thereof, by setting the signal values such that the input signal value x of the sub-pixel that is originally supposed to be fully lighted becomes larger than the input signal value x of the sub-pixel that is originally supposed to be unlighted, a luminance difference between the boundary section 46 and the display regions other than the boundary section 46 can be further reduced.

In the pixel 48$_{(D+2,\ q)}$ not included in the boundary section 46 on the display region 45*k* side, a first sub-pixel 49$R_{(D+2,\ q)}$ to which an input signal value $x_{1_(D+2,\ q)}$ "255" is input is fully lighted. A third sub-pixel 49$B_{(D+2,\ q)}$ to which an input signal value $x_{3_(D+2,\ q)}$ "255" is input is fully lighted. Meanwhile, a second sub-pixel 49$G_{(D+2,\ q)}$ to which an input signal value $x_{2_(D+2,\ q)}$ "0" is input is unlighted.

As described with reference to FIG. 17, in the boundary section 46, the input signal value to cause the sub-pixels that are originally supposed to be unlighted to display in a halftone manner is input thereto. Further, the input signal value to cause the sub-pixels that are originally supposed to be fully lighted to display in a halftone manner is also input thereto. Accordingly, the luminance change in the boundary section, and the luminance change between the boundary section and the display regions other than the boundary section are reduced, which prevents the streak from being visually recognized.

As described above, the visibility of a display image can be improved.

In the third modification, an example of displaying green in the display region 45*j* and magenta in the display region 45*k* has been described. However, similar effect can be obtained even if the colors to be displayed are reversed. That is, even if magenta is displayed in the display region 45*j* and green is displayed in the display region 45*k*, the visual recognition of the streak can be prevented, and the visibility of a display image can be improved. Further, as described above, the same can be applied to a case where another primary color and its complementary color are displayed.

Especially, as a combination of colors in the display region 45*j* (left side) and the display region 45*k* (right side), a combination of cyan (C) and red (R), that of green (G) and magenta (M), that of magenta (M) and green (G), and that of yellow (Y) and blue (B) provide significant effects.

The present modification is applicable to a configuration having three or more display regions, as described in the first embodiment.

Fourth Modification of First Embodiment

In the first embodiment and the first to third modifications thereof, an example of laterally arranging the display regions in the single colors and complementary colors in plan view has been described. In a fourth modification of the first embodiment, an example of longitudinally arranging display regions in plan view will be described.

The fourth modification will be described with reference to FIGS. 30 and 31.

Figure 30:
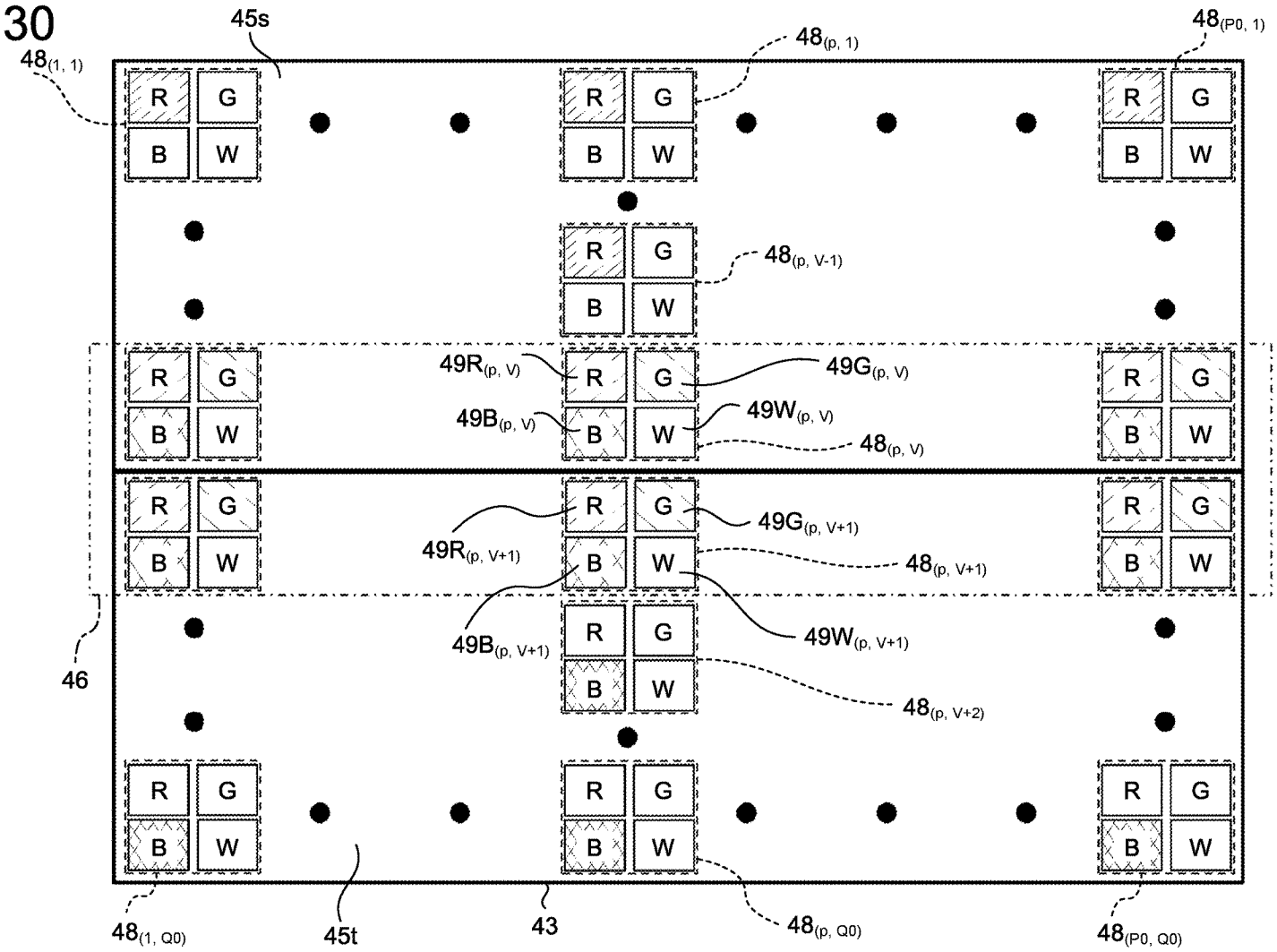
FIG. 30 is a diagram illustrating a fourth modification of the first embodiment.

FIG. 30 illustrates an example of displaying red and blue longitudinally adjacent to each other as single colors. In FIG. 30, assume that in a boundary section 46 of a display region 45*s* where red is displayed and a display region 45*t* where blue is displayed, a pixel 48$_{(p,\ V)}$ on a V-th row on the display region 45*s* side and a pixel 48$_{(p,\ V+1)}$ on a (V+1)-th row on the display region 45*t* side are adjacent to each other (V is an integer of ($Q_0$−1) or less).

To display red, a first sub-pixel 49R may be lighted. To display blue, a third sub-pixel 49B may be lighted.

Therefore, regarding the pixels 48 not included in the boundary section 46, the first sub-pixels 49R are fully lighted, and the second sub-pixels 49G, the third sub-pixels 49B, and the fourth sub-pixels 49W are unlighted in a pixel 48$_{(p,\ 1)}$ to a pixel 48$_{(p,\ V-1)}$ in the display region 45*s*. Similarly, regarding the pixels 48 not included in the boundary section 46, the third sub-pixels 49B are fully lighted, and the first sub-pixels 49R, the second sub-pixels 49G, and the fourth sub-pixels 49W are unlighted in a pixel 48$_{(p,\ V+2)}$ to a pixel 48$_{(p,\ Q0)}$ in the display region 45*t*.

In the boundary section 46, the pixel 48$_{(p,\ V)}$ on the display region 45*s* side and the pixel 48$_{(p,\ V+1)}$ on the display region 45*t* side are lighted in a halftone manner. More specific example will be described below.

For example, on a p-th column in the boundary section 46, a second sub-pixel 49$G_{(p,\ V)}$ and a third sub-pixel 49$B_{(p,\ V)}$ of the pixel 48$_{(p,\ V)}$ on the display region 45*s* side, which are originally supposed to be unlighted, are lighted in a halftone manner.

Further, a first sub-pixel 49$R_{(p,\ V)}$ of the pixel 48$_{(p,\ V)}$ on the display region 45*s* side, which is originally supposed to be fully lighted, is lighted in a halftone manner.

A first sub-pixel 49$R_{(p,\ V+1)}$ and a second sub-pixel 49$G_{(p,\ V+1)}$ of the pixel 48$_{(p,\ V+1)}$ on the display region 45*t* side, which are originally supposed to be unlighted, are lighted in a halftone manner.

Further, a third sub-pixel 49$B_{(p,\ V+1)}$ of the pixel 48$_{(p,\ V+1)}$ on the display region 45*t* side, which is originally supposed to be fully lighted, is lighted in a halftone manner.

In FIG. 30, the fourth sub-pixels 49W are unlighted.

As described above, the sub-pixels 49 in the boundary section 46 are lighted in a halftone manner, and thus luminance change in the boundary section is reduced.

The luminance change is reduced between the pixel 48 in the boundary section 46, and the pixel 48 that is not included in the boundary section 46 and that is adjacent to the boundary section 46. For example, in the display region 45*s*, the pixel 48$_{(p,\ V)}$ is lighted in a halftone manner, and the pixel 48$_{(p,\ V-1)}$ is lighted in the single color between the pixel 48$_{(p,\ V)}$ in the boundary section 46, and the pixel 48$_{(p,\ V-1)}$ adjacent to the pixel 48$_{(p,\ V)}$. Accordingly, the luminance change in the boundary section 46 and the regions other than the boundary section 46 is reduced. Similarly, in the display region 45*t*, a third sub-pixel 49$B_{(p,\ V+2)}$ is fully lighted, and a first sub-pixel 49$R_{(p,\ V+2)}$ and a second sub-pixel 49$G_{(p,\ V+2)}$ are unlighted in the pixel 48$_{(p,\ V+2)}$ adjacent to the pixel 48$_{(p,\ V+1)}$.

Accordingly, the luminance change in the boundary section 46, and the luminance change between the boundary section and the display regions other than the boundary section are reduced, which prevents a streak in the boundary section from being visually recognized.

In this way, the sub-pixels that are originally supposed to be unlighted are lighted in a halftone manner, and the sub-pixels that are originally supposed to be fully lighted are also lighted in a halftone manner. Therefore, the luminance change is reduced, which prevents the streak from being visually recognized. As described above, the visibility of a display image can be improved.

Figure 31:
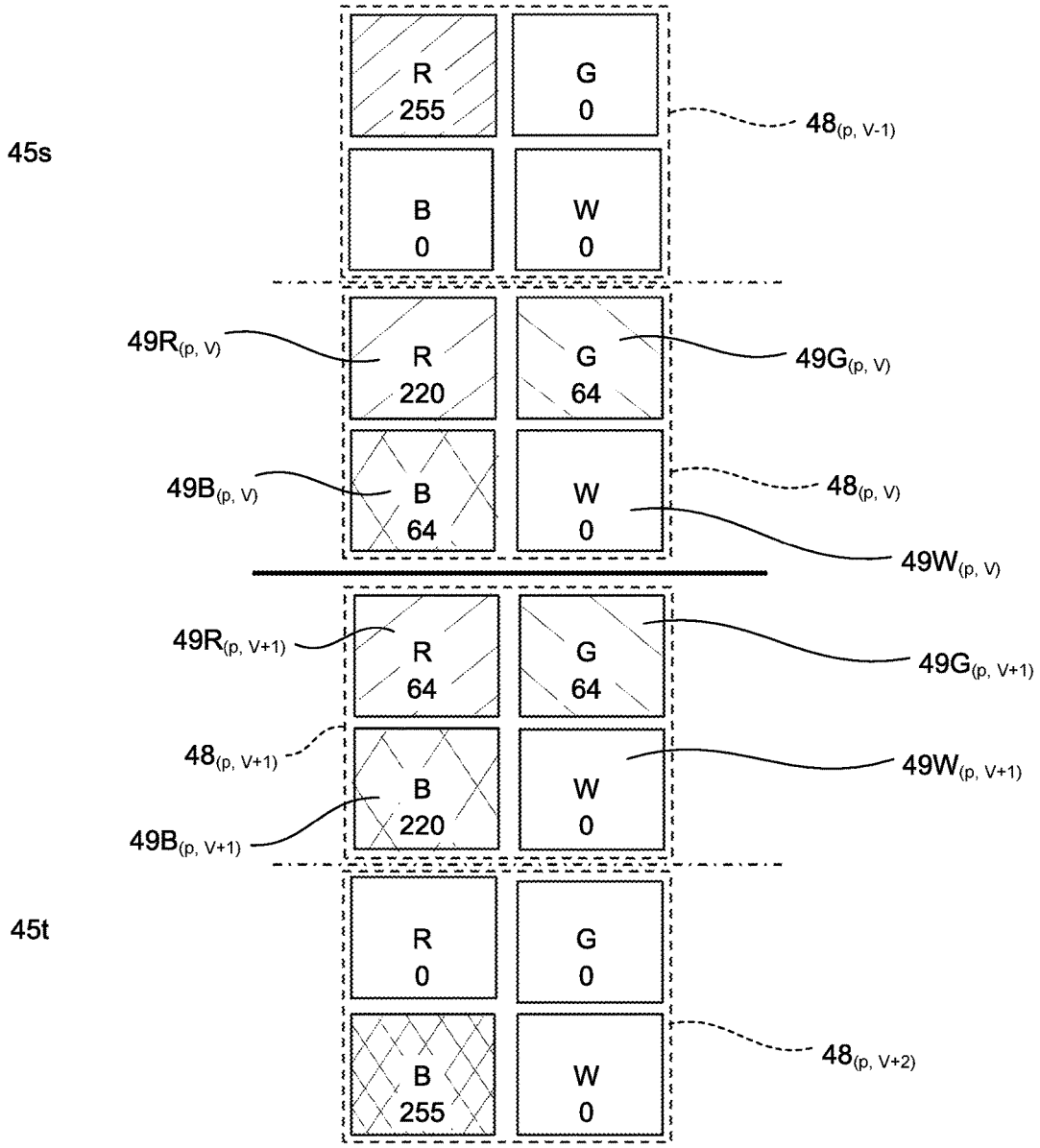
FIG. 31 is a diagram illustrating the fourth modification of the first embodiment.

FIG. 31 is an enlarged view of the pixels on the p-th column near the boundary section 46 of FIG. 30. FIG. 31 illustrates, from the upper side on the drawing sheet, input signal values of the respective sub-pixels in the pixel $\mathbf{48}_{(p,\ v-1)}$ not included in the boundary section 46 and the pixel $\mathbf{48}_{(p,\ v)}$ in the boundary section 46 in the display region 45*s*, and the pixel $\mathbf{48}_{(p,\ v+1)}$ in the boundary section 46 and the pixel $\mathbf{48}_{(p,\ v+2)}$ not included in the boundary section 46 in the display region 45*t*.

A first sub-pixel $\mathbf{49}R_{(p,\ v-1)}$ to which an input signal value $x_{1_(p,\ v-1)}$ "255" is input is fully lighted. Meanwhile, a second sub-pixel $\mathbf{49}G_{(p,\ v-1)}$ to which an input signal value $x_{2_(p,\ v-1)}$ "0" is input is unlighted. A third sub-pixel $\mathbf{49}B_{(p,\ v-1)}$) to which an input signal value $x_{3_(p,\ v-1)}$ "0" is input is unlighted.

In FIG. 31, the fourth sub-pixels 49W are unlighted. Therefore, an input signal value $x_{4_(p,\ q)}$ to be input to an arbitrary fourth sub-pixel $\mathbf{49}W_{(p,\ q)}$ is 0.

In the example illustrated in FIG. 31, an input signal value $x_{1_(p,\ v)}$) of the first sub-pixel $\mathbf{49}R_{(p,\ v)}$ is 220, an input signal value $x_{2_(p,\ v)}$ of the second sub-pixel $\mathbf{49}G_{(p,\ v)}$ is 64, and an input signal value $x_{3_(p,\ v)}$ of the third sub-pixel $\mathbf{49}B_{(p,\ v)}$ is 64 in the boundary section 46 on the display region 45*s* side. The first sub-pixel $\mathbf{49}R_{(p,\ v)}$ to which the input signal value $x_{1_(p,\ v)}$ "220" is input is lighted in halftone luminance. The second sub-pixel $\mathbf{49}G_{(p,\ v)}$ to which the input signal value $x_{2_(p,\ v)}$ "64" is input is lighted in halftone luminance. The third sub-pixel $\mathbf{49}B_{(p,\ v)}$ to which the input signal value $x_{3_(p,\ v)}$ "64" is input is lighted in halftone luminance.

In this way, by inputting the input signal value x that causes the sub-pixel to be lighted in halftone luminance to the first sub-pixel $\mathbf{49}R_{(p,\ v)}$, the second sub-pixel $\mathbf{49}G_{(p,\ v)}$, and the third sub-pixel $\mathbf{49}B_{(p,\ v)}$, which are the sub-pixels of the pixel $\mathbf{48}_{(p,\ v)}$ in the boundary section 46, the first sub-pixel $\mathbf{49}R_{(p,\ v)}$, the second sub-pixel $\mathbf{49}G_{(p,\ v)}$, and the third sub-pixel $\mathbf{49}B_{(p,\ v)}$ can be lighted in a halftone manner.

Further, the input signal value $x_{1_(p,\ v)}$, the input signal value $x_{2_(p,\ v)}$, and the input signal value $x_{3_(p,\ v)}$ are preferably input in consideration of the sub-pixels that are originally supposed to be lighted and the sub-pixels that are originally supposed to be unlighted. That is, the first sub-pixel $\mathbf{49}R_{(p,\ v)}$ is originally supposed to be fully lighted, in other words, an input signal value $x_{1_(p,\ v)}$ "255" is input thereto. The second sub-pixel $\mathbf{49}G_{(p,\ v)}$ is originally supposed to be unlighted, in other words, an input signal value $x_{2_(p,\ v)}$ "0" is input thereto. The third sub-pixel $\mathbf{49}B_{(p,\ v)}$ is originally supposed to be unlighted, in other words, an input signal value $x_{3_(p,\ v)}$ "0" is input thereto. In view of the foregoing, the input signal value x for causing the sub-pixel to be lighted in a halftone manner is preferably input in consideration of the input signal value x that is originally supposed to be input.

Similarly, in the example illustrated in FIG. 31, an input signal value $x_{1_(p,\ v+1)}$ of the first sub-pixel $\mathbf{49}R_{(p,\ v+1)}$ is 64, an input signal value $x_{2_(p,\ v+1)}$ of the second sub-pixel $\mathbf{49}G_{(p,\ v+1)}$ is 64, and an input signal value $x_{3_(p,\ v+1)}$ of the third sub-pixel $\mathbf{49}B_{(p,\ v+1)}$ is 220 in the boundary section 46 on the display region 45*t* side. In this way, by inputting the input signal value x that causes the sub-pixel to be lighted in halftone luminance to the first sub-pixel $\mathbf{49}R_{(p,\ v+1)}$, the second sub-pixel $\mathbf{49}G_{(p,\ v+1)}$, and the third sub-pixel $\mathbf{49}B_{(p,\ v+1)}$, which are the sub-pixels of the pixel $\mathbf{48}_{(p,\ v+1)}$ in the boundary section 46 on the display region 45*t* side, the first sub-pixel $\mathbf{49}R_{(p,\ v+1)}$, the second sub-pixel $\mathbf{49}G_{(p,\ v+1)}$, and the third sub-pixel $\mathbf{49}B_{(p,\ v+1)}$ can be lighted in a halftone manner.

As described above, the sub-pixels 49 in the boundary section 46 are lighted in a halftone manner, and thus the luminance change in the boundary section can be reduced.

In FIG. 31, the input signal values x that cause the sub-pixels to be lighted in halftone luminance are "220" and "64". However, these values are mere examples. The input signal value x may be any value as long as the value causes the sub-pixel to be lighted in halftone luminance.

As described in the first embodiment and the first and second modifications thereof, by setting the signal values such that the input signal value x of the sub-pixel that is originally supposed to be fully lighted becomes larger than the input signal value x of the sub-pixel that is originally supposed to be unlighted, the luminance difference between the boundary section 46 and the display regions other than the boundary section 46 can be further reduced.

In the pixel $\mathbf{48}_{(p,\ v+2)}$ not included in the boundary section 46 on the display region 45*t* side, the third sub-pixel $\mathbf{49}B_{(p,\ v+2)}$ to which the input signal value $x_{3_(p,\ v+2)}$ "255" is input is fully lighted. Meanwhile, the first sub-pixel $\mathbf{49}R_{(p,\ v+2)}$ to which the input signal value $x_{1_(p,\ v+2)}$ "0" is input is unlighted. The second sub-pixel $\mathbf{49}G_{(p,\ v+2)}$ to which the input signal value $x_{2_(p,\ v+2)}$ "0" is input is unlighted.

As described using FIG. 31, in the boundary section 46, the input signal value to cause the sub-pixels that are originally supposed to be unlighted to display in a halftone manner is input thereto. Further, the input signal value to cause the sub-pixels that are originally supposed to be fully lighted to display in a halftone manner is also input thereto. Accordingly, the luminance change in the boundary section, and the luminance change between the boundary section and the display regions other than the boundary section are reduced, which prevents the streak from being visually recognized.

As described above, the visibility of a display image can be improved.

In the fourth modification, an example of displaying red in the display region 45*s* and blue in the display region 45*t* has been described. However, similar effect can be obtained if the colors to be displayed are reversed. That is, the visual recognition of the streak can be prevented, and the visibility of a display image can be improved even in a case where blue is displayed in the display region 45*s* and red is displayed in the display region 45*t*. Further, as described above, the same applies to cases where other primary colors, complementary colors of primary colors, and a primary color and its complementary color are displayed.

Especially, as a combination of colors in the display region 45*s* (upper side) and the display region 45*t* (lower side), a combination of red (R) and blue (B), that of blue (B) and red (R), that of blue (B) and green (B), and that of green (B) and blue (B) provide significant effects.

The present modification is applicable to a configuration having three or more display regions, as described in the first embodiment.

The present modification is applicable to the first embodiment, the first to third modifications thereof, and other embodiments described below. That is, the display regions in single colors may be longitudinally and laterally arranged in plan view, and the pixels in the boundary section may be lighted in a halftone manner.

Second Embodiment

In a second embodiment, an example will be described in which in a display panel that displays a plurality of display regions in single colors adjacent to one another, pixels are caused to display in a halftone manner only in one display region, in a boundary section of adjacent display regions.

The second embodiment will be described with reference to FIGS. 18 and 19.

In the first embodiment, the example of causing both the pixel $\mathbf{48}_{(S,\ q)}$ on the display region 45*a*-side and the pixel $\mathbf{48}_{(S+1,\ q)}$ on display region 45*b*-side of the boundary section 46 to display in a halftone manner has been described. In the second embodiment, an example will be described in which one pixel on the display region 45*a* side or the display region 45*b* side is caused to display in a halftone manner, and the other pixel is left in its original state, i.e., a lighted or unlighted state without causing the pixel to display in a halftone manner.

Figure 18:
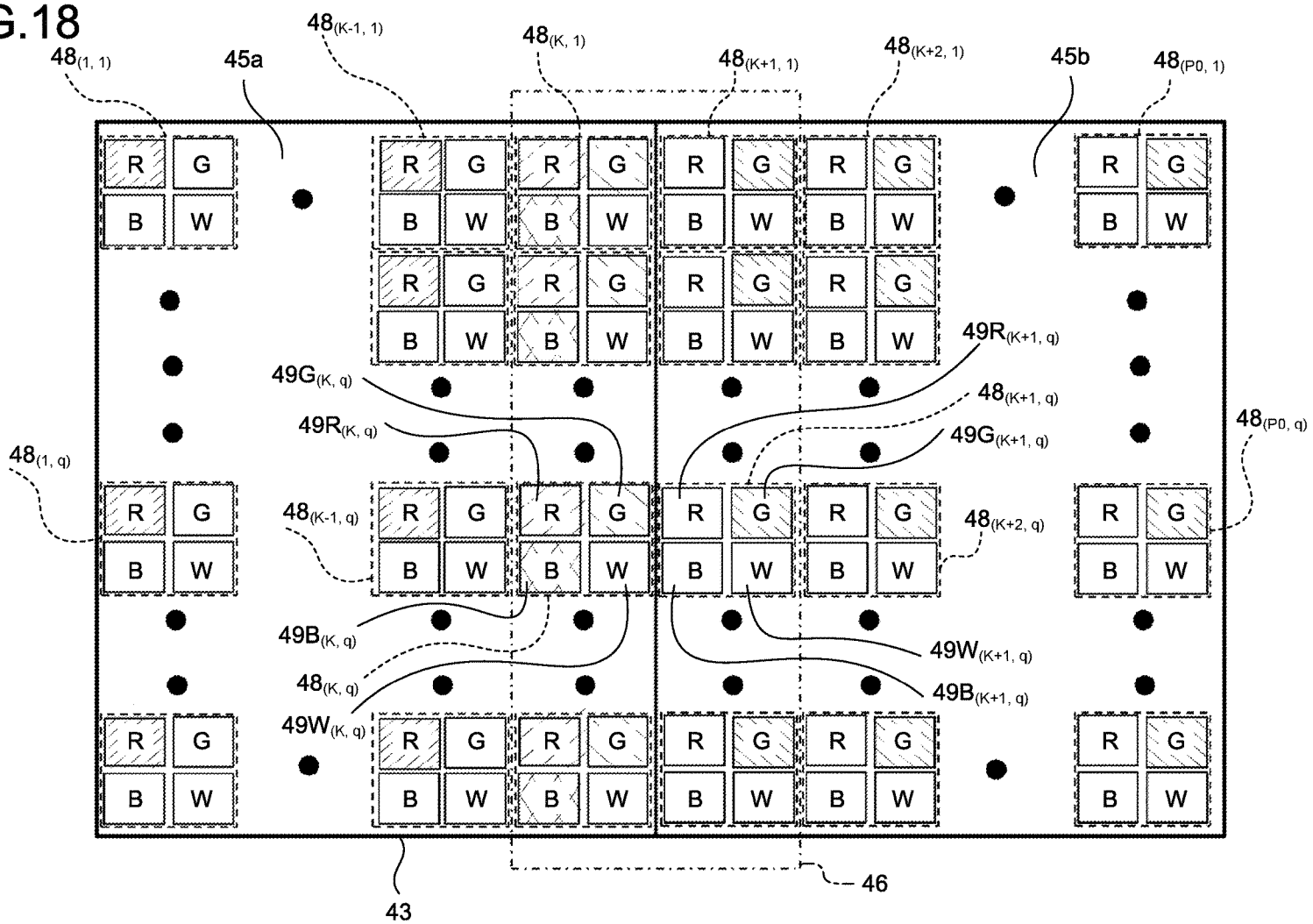
FIG. 18 is a diagram illustrating a second embodiment.

FIG. 18 illustrates an example of displaying red and green adjacent to each other as single colors, similarly to the first embodiment. In FIG. 18, assume that in a boundary section 46 of the display region 45*a* where red is displayed and the display region 45*b* where green is displayed, a pixel $\mathbf{48}_{(K,\ q)}$ on a K-th column on the display region 45*a* side and a pixel $\mathbf{48}_{(K+1,\ q)}$ on a (K+1)-th column on the display region 45*b* side are adjacent to each other (K is an integer of 2 or more, and $(P_0-2)$ or less).

Regarding pixels 48 not included in the boundary section 46, the first sub-pixels 49R are fully lighted, and the second sub-pixels 49G, the third sub-pixels 49B, and the fourth sub-pixels 49W are unlighted in a pixel $\mathbf{48}_{(1,\ q)}$ to a pixel $\mathbf{48}_{(K-1,\ q)}$ in the display region 45*a*. Similarly, regarding the pixels 48 not included in the boundary section 46, the second sub-pixels 49G are fully lighted, and the first sub-pixels 49R, the third sub-pixels 49B, and the fourth sub-pixels 49W are unlighted in a pixel $\mathbf{48}_{(K+2,\ q)}$ to a pixel $\mathbf{48}_{(P0,\ q)}$ in the display region 45*b*.

In the boundary section 46, only the pixel $\mathbf{48}_{(K,\ q)}$ on the display region 45*a* side is lighted in a halftone manner, and the pixel $\mathbf{48}_{(K+1,\ q)}$ on the display region 45*b* side is lighted in the same manner as the pixels not included in the boundary section 46. In a case where a pixel lighted in a halftone manner is the pixel $\mathbf{48}_{(K+1,\ q)}$ on the display region 45*b* side, and a pixel lighted in the same manner as the pixels not included in the boundary section 46 is the pixel $\mathbf{48}_{(K,\ q)}$ on the display region 45*a* side, the pixel $\mathbf{48}_{(K,\ q)}$ and the pixel $\mathbf{48}_{(K+1,\ q)}$ may just be interpreted the other way around.

For example, on a q-th row in the boundary section 46, a second sub-pixel $\mathbf{49}G_{(K,\ q)}$ and a third sub-pixel $\mathbf{49}B_{(K,\ q)}$ of the pixel $\mathbf{48}_{(K,\ q)}$ on the display region 45*a* side, which are originally supposed to be unlighted, are lighted in a halftone manner.

Further, a first sub-pixel $\mathbf{49}R_{(K,\ q)}$ of the pixel $\mathbf{48}_{(K,\ q)}$ on the display region 45*a* side, which is originally supposed to be fully lighted, is lighted in a halftone manner.

Meanwhile, a second sub-pixel $\mathbf{49}G_{(K+1,\ q)}$ is fully lighted, and a first sub-pixel $\mathbf{49}R_{(K+1,\ q)}$ and a third sub-pixel $\mathbf{49}B_{(1,\ K+1)}$ are unlighted, in the pixel $\mathbf{48}_{(K+1,\ q)}$ on the display region 45*b* side, in the same manner as the pixels 48 in the regions other than the boundary section 46.

In FIG. 18, the fourth sub-pixels 49W are unlighted.

In a case where one pixel (the pixel $\mathbf{48}_{(K,\ q)}$ in FIG. 18) of the two pixels in the boundary section 46 is lighted in a halftone manner, a luminance difference between the pixel $\mathbf{48}_{(K,\ q)}$ lighted in a halftone manner, and the pixel $\mathbf{48}_{(K+1,\ q)}$ lighted in a single color (green in FIG. 18) is small. Therefore, luminance change in the boundary section 46 can be reduced according to the second embodiment.

The luminance change is reduced between the pixel 48 in the boundary section 46, and the pixel 48 that is not included in the boundary section 46 and that is adjacent to the boundary section 46. For example, in the display region 45*a*, the pixel $\mathbf{48}_{(K,\ q)}$ is lighted in a halftone manner, and the pixel $\mathbf{48}_{(K-1,\ q)}$ is lighted in the single color between the pixel $\mathbf{48}_{(K,\ q)}$ in the boundary section 46, and the pixel $\mathbf{48}_{(K-1,\ q)}$ adjacent to the pixel $\mathbf{48}_{(K,\ q)}$. Accordingly, the luminance change in the boundary section 46 and the regions other than the boundary section 46 is reduced.

Accordingly, the luminance change in the boundary section 46, and the luminance change between the boundary section and the display regions other than the boundary section are reduced, which prevents a streak in the boundary section from being visually recognized.

In this way, the sub-pixels that are originally supposed to be unlighted are lighted in a halftone manner, and the sub-pixels that are originally supposed to be fully lighted are also lighted in a halftone manner. Therefore, the luminance change is reduced, which prevents the streak from being visually recognized. As described above, the visibility of a display image can be improved.

Figure 19:
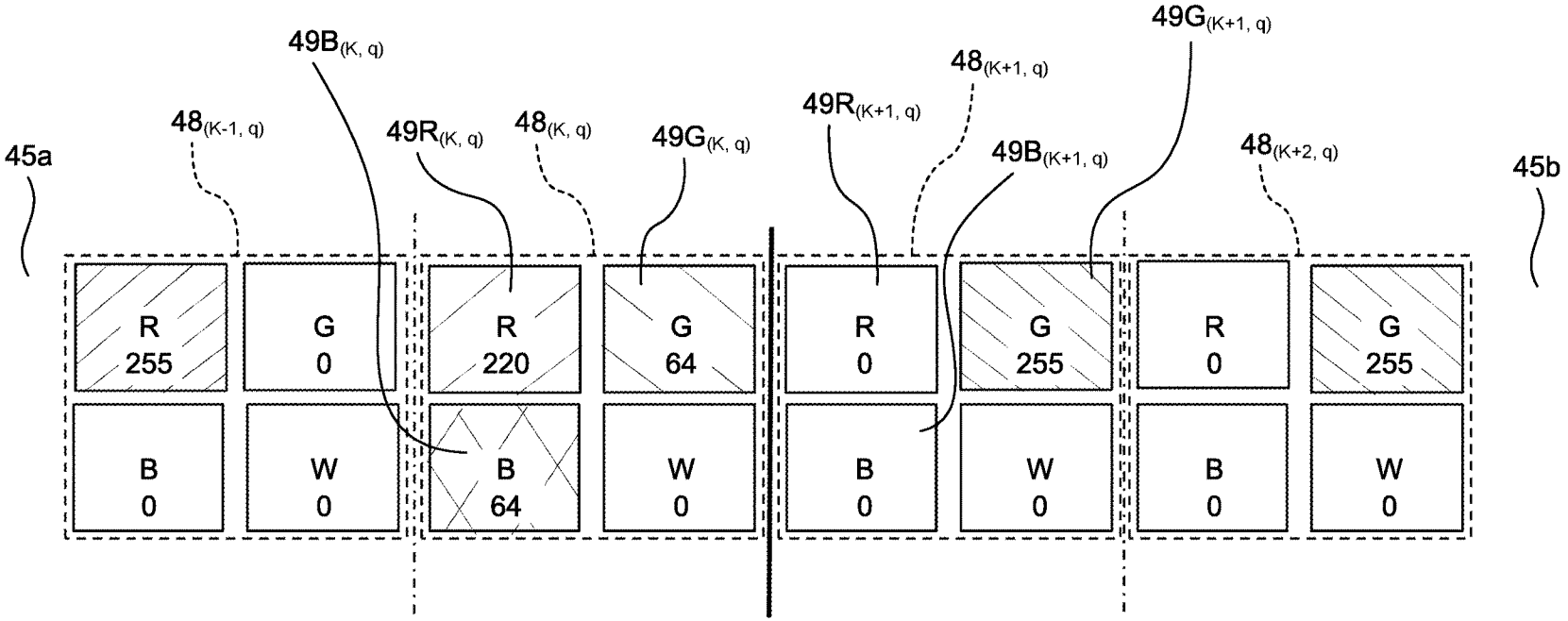
FIG. 19 is a diagram illustrating the second embodiment.

FIG. 19 is an enlarged view of the pixels on the q-th row near the boundary section 46 in FIG. 18.

A first sub-pixel $\mathbf{49}R_{(K-1,\ q)}$ to which an input signal value $x_{1_(K-1,\ q)}$ "255" is input is fully lighted. Meanwhile, a second sub-pixel $\mathbf{49}G_{(K-1,\ q)}$ to which an input signal value $x_{2_(K-1,\ q)}$ "0" is input is unlighted. A third sub-pixel $\mathbf{49}B_{(K-1,\ q)}$ to which an input signal value $x_{3_(K-1,\ q)}$ "0" is input is unlighted.

In FIG. 19, the fourth sub-pixels 49W are unlighted. Therefore, an input signal value $x_{4_(p,\ q)}$ to be input to an arbitrary fourth sub-pixel $\mathbf{49}W_{(p,\ q)}$ is 0.

In the example illustrated in FIG. 19, an input signal value $x_{1_(K,\ q)}$ of the first sub-pixel $\mathbf{49}R_{(K,\ q)}$ is 220, an input signal value $x_{2_(K,\ q)}$ of the second sub-pixel $\mathbf{49}G_{(K,\ q)}$ is 64, and an input signal value $x_{3_(K,\ q)}$ of the third sub-pixel $\mathbf{49}B_{(K,\ q)}$ is 64 in the boundary section 46 on the display region 45*a* side. The first sub-pixel $\mathbf{49}R_{(K,\ q)}$ to which the input signal value $x_{1_(K,\ q)}$ "220" is input is lighted in halftone luminance. The second sub-pixel $\mathbf{49}G_{(K,\ q)}$ to which the input signal value $x_{2_(K,\ q)}$ "64" is input is lighted in halftone luminance. The third sub-pixel $\mathbf{49}B_{(K,\ q)}$ to which the input signal value $x_{3_(K,\ q)}$ "64" is input is lighted in halftone luminance.

In this way, by inputting the input signal value x that causes the sub-pixel to be lighted in halftone luminance to the first sub-pixel $\mathbf{49}R_{(K,\ q)}$, the second sub-pixel $\mathbf{49}G_{(K,\ q)}$, and the third sub-pixel $\mathbf{49}B_{(K,\ q)}$, which are the sub-pixels of the pixel $\mathbf{48}_{(K,\ q)}$ in the boundary section 46, the first sub-pixel $\mathbf{49}R_{(K,\ q)}$, the second sub-pixel $\mathbf{49}G_{(K,\ q)}$, and the third sub-pixel $\mathbf{49}B_{(K,\ q)}$ can be lighted in a halftone manner.

Further, the input signal value $x_{1_(K,\ q)}$, the input signal value $x_{2_(K,\ q)}$, and the input signal value $x_{3_(K,\ q)}$ are preferably input in consideration of the sub-pixels that are originally supposed to be lighted and the sub-pixels that are originally supposed to be unlighted. That is, the first sub-pixel $\mathbf{49}R_{(K,\ q)}$ is originally supposed to be fully lighted, in other words, an input signal value $x_{1_(K,\ q)}$ "255" is input thereto. The second sub-pixel $\mathbf{49}G_{(K,\ q)}$ is originally supposed to be unlighted, in other words, an input signal value $x_{2_(K,\ q)}$ "0" is input thereto. The third sub-pixel 49$B_{(K,\ q)}$ is originally supposed to be unlighted, in other words, an input signal value $x_{3_(K,\ q)}$ "0" is input thereto. In view of the foregoing, the input signal value x for causing the sub-pixel to be lighted in a halftone manner is preferably input in consideration of the input signal value x that is originally supposed to be input. The input signal values x of the sub-pixels 49 in different colors that are originally supposed to be unlighted may be the same or may be different.

In the example illustrated in FIG. 19, an input signal value $x_{1_(K+1,\ q)}$ of the first sub-pixel 49$R_{(K+1,\ q)}$ is 0, an input signal value $x_{2_(K+1,\ q)}$ of the second sub-pixel 49$G_{(K+1,\ q)}$ is 255, and an input signal value $x_{3_(K+1,\ q)}$ of the third sub-pixel 49$B_{(K+1,\ q)}$ is 0 in the boundary section 46 on the display region 45*b* side.

As described above, one pixel of the two pixels in the boundary section 46 is lighted in a halftone manner, whereby the luminance change in the boundary section can be reduced.

In FIG. 19, the input signal values x that cause the sub-pixels to be lighted in halftone luminance are "220" and "64". However, these values are mere examples. The input signal value x may be any value as long as the value causes the sub-pixel to be lighted in halftone luminance.

As described in the first embodiment and the first to third modifications thereof, by setting the signal values such that the input signal value x of the sub-pixel that is originally supposed to be fully lighted becomes larger than the input signal value x of the sub-pixel that is originally supposed to be unlighted, the luminance difference between the boundary section 46 and the display regions other than the boundary section 46 can be further reduced.

In the pixel 48$_{(K+2,\ q)}$ not included in the boundary section 46 on the display region 45*b* side, an input signal value $x_{1_(K+2,\ q)}$, an input signal value $x_{2_(K+2,\ q)}$, and an input signal value $x_{3_(K+2,\ q)}$ are the same as the input signal value $x_{1_(K+1,\ q)}$, the input signal value $x_{2_(K+1,\ q)}$, and the input signal value $x_{3_(K+1,\ q)}$, respectively.

As described with reference to FIG. 19, in the pixels of one column of the boundary section 46, the input signal value x to cause the sub-pixels 49 that are originally supposed to be unlighted to display in a halftone manner is input thereto. Further, the input signal value x to cause the sub-pixels 49 that are originally supposed to be fully lighted to display in a halftone manner is input thereto. Accordingly, the luminance change in the boundary section 46, and the luminance change between the boundary section 46 and the display regions other than the boundary section 46 are reduced, which prevents the streak from being visually recognized.

Further, in the pixels 48 in the column to be lighted in a halftone manner in the boundary section 46, the input signal value x to be input to the sub-pixel 49 that is originally supposed to be fully lighted is preferably made larger than the input signal value x to be input to the sub-pixel 49 that is originally supposed to be unlighted. By setting the input signal values x in this way, the luminance change between the pixels 48 in the columns to be lighted in a halftone manner in the boundary section 46, and the pixels 48 in the display regions other than the aforementioned display regions can be further reduced.

As described above, the visibility of a display image can be improved.

The second embodiment is applicable to the case of displaying the single colors as primary colors adjacent to each other, described in the first embodiment and the first modification thereof, the case of displaying the single colors as complementary colors of primary colors adjacent to each other, described in the second modification of the first embodiment, and the case of displaying the single colors as a primary color and its complementary color, described in the third modification of the first embodiment.

Third Embodiment

In a third embodiment, an example to turn on a sub-pixel that displays white, in addition to sub-pixels that are originally supposed to be fully lighted, in a boundary section where single colors are displayed adjacent to each other, will be described.

The present embodiment will be described with reference to FIGS. 20 and 21.

Figure 20:
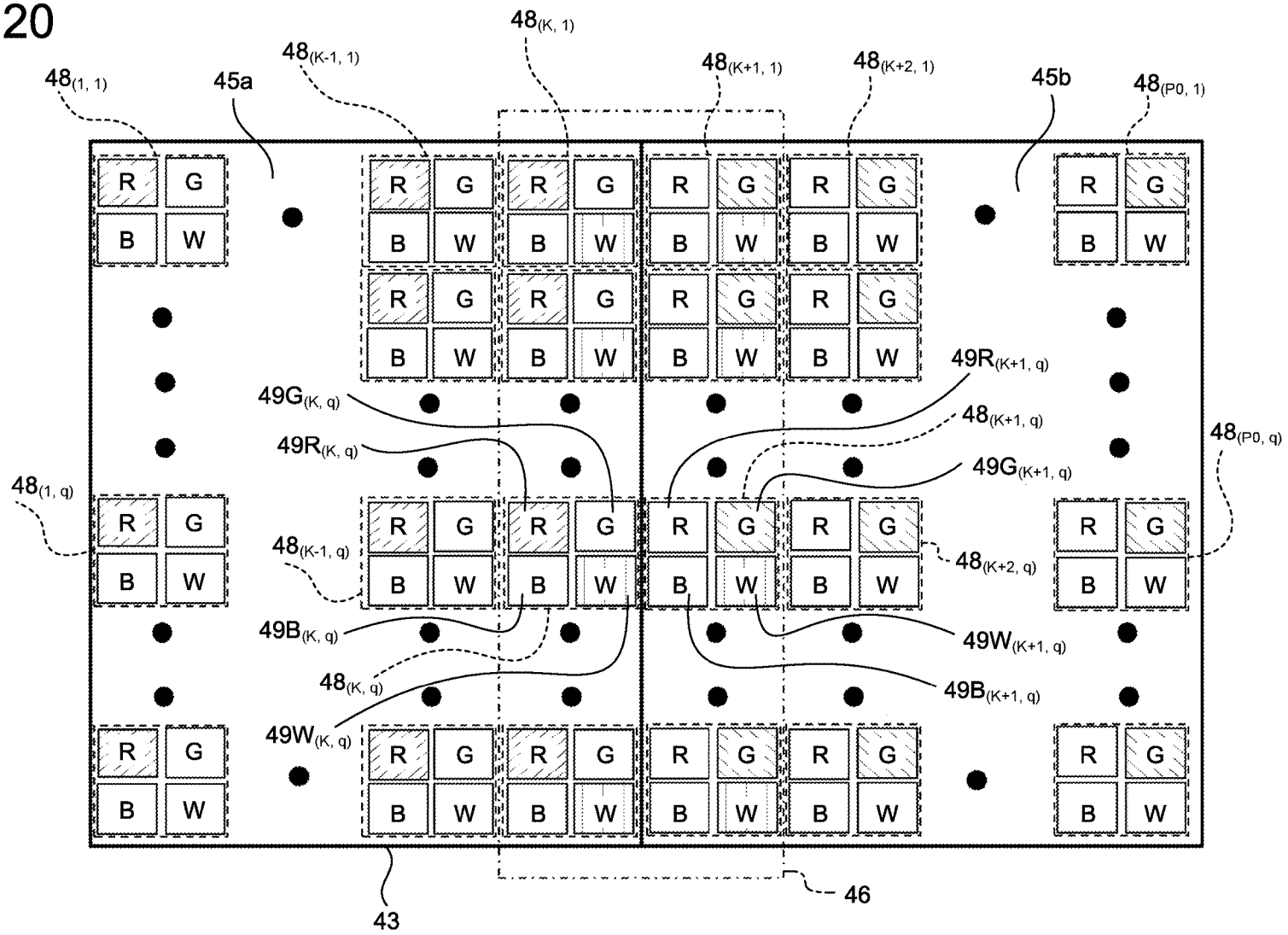
FIG. 20 is a diagram illustrating a third embodiment.

FIG. 20 illustrates an example of displaying red and green adjacent to each other as single colors, similarly to the first embodiment. In FIG. 20, assume that in a boundary section 46 of a display region 45*a* where red is displayed and a display region 45*b* where green is displayed, a pixel 48$_{(K,\ q)}$ on a K-th column on the display region 45*a* side and a pixel 48$_{(K+1,\ q)}$ on a (K+1)-th column on the display region 45*b* side are adjacent to each other (K is an integer of 2 or more, and ($P_0$−2) or less).

In the present embodiment, regarding pixels 48 not included in the boundary section 46, the first sub-pixels 49R are fully lighted, and the second sub-pixels 49G, the third sub-pixels 49B, and the fourth sub-pixels 49W are unlighted in a pixel 48$_{(1,\ q)}$ to a pixel 48$_{(K-1,\ q)}$ in the display region 45*a*. Similarly, regarding the pixels 48 not included in the boundary section 46, the second sub-pixels 49G are fully lighted, and the first sub-pixels 49R, the third sub-pixels 49B, and the fourth sub-pixels 49W are unlighted in a pixel 48$_{(K+2,\ q)}$ to a pixel 48$_{(P0,\ q)}$ in the display region 45*b*.

In the boundary section 46, a first sub-pixel 49$R_{(K,\ q)}$ is fully lighted and a fourth sub-pixel 49$W_{(K,\ q)}$ is lighted in a halftone manner in the pixel 48$_{(K,\ q)}$ on the display region 45*a* side. A second sub-pixel 49$G_{(K,\ q)}$ and a third sub-pixel 49$B_{(K,\ q)}$ are unlighted.

Similarly, in the boundary section 46, a second sub-pixel 49$G_{(K+1,\ q)}$ is fully lighted and a fourth sub-pixel 49$W_{(K+1,\ q)}$ is lighted in a halftone manner in the pixel 48$_{(K+1,\ q)}$ on the display region 45*b* side. A first sub-pixel 49$R_{(K+1,\ q)}$ and a third sub-pixel 49$B_{(K+1,\ q)}$ are unlighted.

As illustrated in FIGS. 4 to 6 of the first embodiment, a black streak occurs between the display regions 45*a* and 45*b* where single colors are displayed. Therefore, as described in the present embodiment, the fourth sub-pixels 49W in the boundary section 46, where the black streak occurs, are lighted in a halftone manner, whereby luminance in the boundary section 46 can be increased. Accordingly, occurrence of the black streak can be prevented, and the visibility of a display image can be improved.

Figure 21:
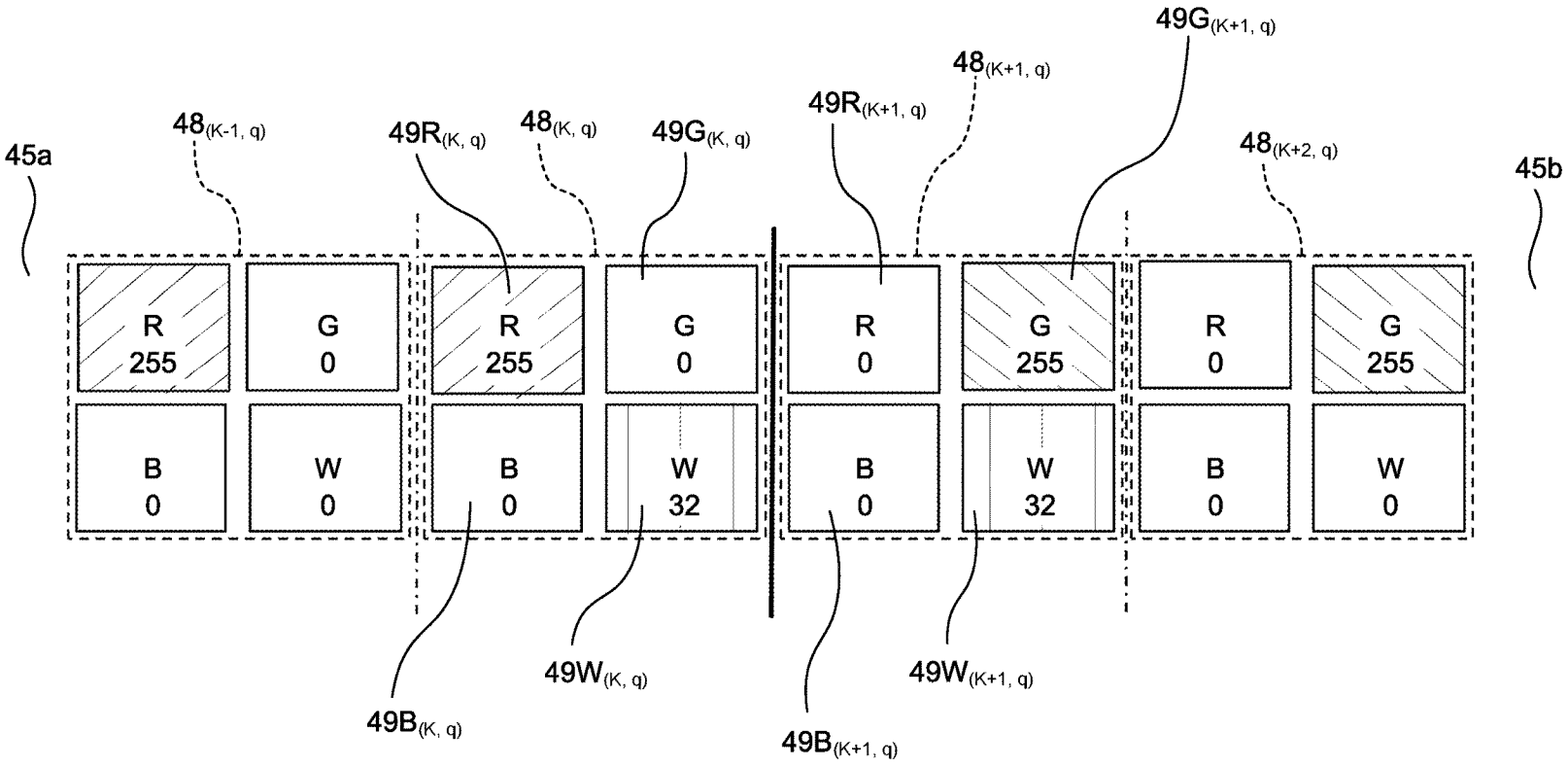
FIG. 21 is a diagram illustrating the third embodiment.

FIG. 21 is an enlarged view of the pixels on a q-th row near the boundary section 46 in FIG. 20.

A first sub-pixel 49$R_{(K-1,\ q)}$ to which an input signal value $x_{1_(K-1,\ q)}$ "255" is input is fully lighted. Meanwhile, a second sub-pixel 49$G_{(K-1,\ q)}$ to which an input signal value $x_{2_(K-1,\ q)}$ "0" is input is unlighted. A third sub-pixel 49$B_{(K-1,\ q)}$ to which an input signal value $x_{3_(K-1,\ q)}$ "0" is input is unlighted. A fourth sub-pixel 49$W_{(K-1,\ q)}$ to which an input signal value $x_{4_(K-1,\ q)}$ "0" is input is unlighted.

In the example illustrated in FIG. 21, an input signal value $x_{1_(K,\ q)}$ of the first sub-pixel 49$R_{(K,\ q)}$ is 255, an input signal value $x_{2_(K,\ q)}$ of the second sub-pixel 49$G_{(K,\ q)}$ is 0, an input signal value $x_{3_(K,\ q)}$ of the third sub-pixel 49$B_{(K,\ q)}$ is 0, and an input signal value $x_{4_(K,\ q)}$ of the fourth sub-pixel $49W_{(K, q)}$ is 32 in the boundary section 46 on the display region 45*a* side. The fourth sub-pixel $49W_{(K, q)}$ to which the input signal value $x_{4_(K, q)}$ "32" is input is lighted in halftone luminance between an unlighted state and a fully lighted state.

In the example illustrated in FIG. 21, an input signal value $x_{1_(K+1, q)}$ of the first sub-pixel $49R_{(K+1, q)}$ is 0, an input signal value $x_{2_(K+1, q)}$ of the second sub-pixel $49G_{(K+1, q)}$ is 255, an input signal value $x_{3_(K+1, q)}$ of the third sub-pixel $49B_{(K+1, q)}$ is 0, and an input signal value $x_{4_(K+1, q)}$ of the fourth sub-pixel $49W_{(K+1, q)}$ is 32 in the boundary section 46 on the display region 45*b* side.

In FIG. 21, the input signal value x that causes the sub-pixel to be lighted in halftone luminance is "32". However, this is a mere example. The input signal value x may be any value as long as the value causes the sub-pixel to be lighted in halftone luminance.

In the pixel $48_{(K+2, q)}$ not included in the boundary section 46 on the display region 45*b* side, an input signal value $x_{1_(K+2}$, q) "0" is input to a first sub-pixel $49R_{(K+2, q)}$ to be unlighted. An input signal value $x_{2_(K+2, q)}$ "255" is input to a second sub-pixel $49G_{(K+2, q)}$ to be fully lighted. An input signal value $x_{3_(K+2, q)}$ "0" is input to a third sub-pixel $49B_{(K+2, q)}$ to be unlighted. An input signal value $x_{4_(K+2, q)}$ "0" is input to a fourth sub-pixel $49W_{(K+2, q)}$ to be unlighted.

As described above, according to the present embodiment, occurrence of the streak is prevented, and the visibility of a display image can be improved.

The third embodiment is applicable to the case of displaying the single colors as primary colors adjacent to each other, described in the first embodiment, the case of displaying the single colors as complementary colors of primary colors adjacent to each other, described in the second modification of the first embodiment, and the case of displaying the single colors as a primary color and its complementary color, described in the third modification of the first embodiment.

The third embodiment can be applied to the second embodiment. That is, the sub-pixels that display white are lighted in a halftone manner in either one of the adjacent display regions that display the single colors, whereby occurrence of the streak is prevented, and the visibility of a display image can be improved.

Fourth Embodiment

In a fourth embodiment, an example of turning on a sub-pixel that displays white, in a boundary section where single colors are displayed adjacent to each other, will be described.

The present embodiment will be described with reference to FIGS. 22 and 23.

Figure 22:
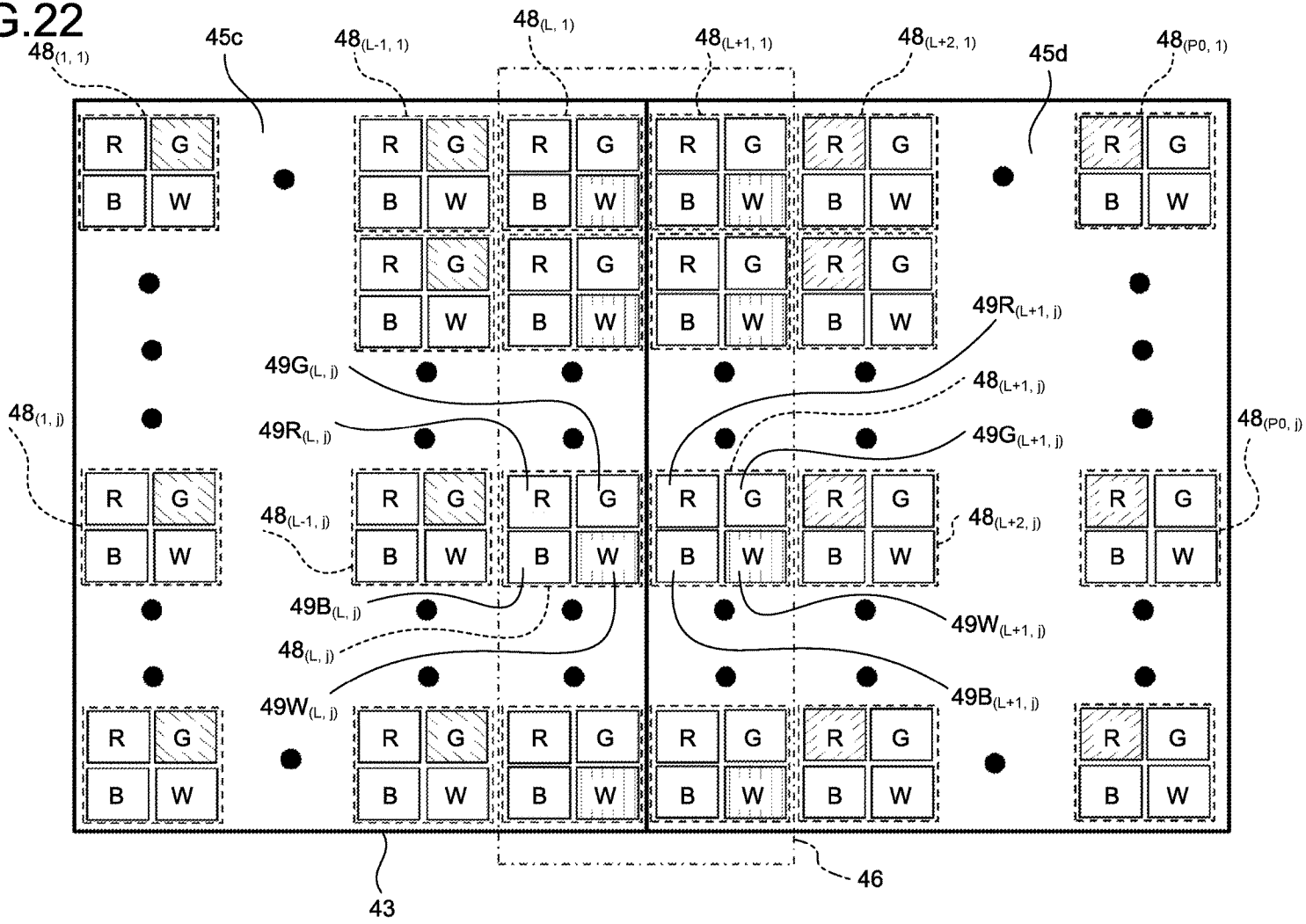
FIG. 22 is a diagram illustrating a fourth embodiment.

FIG. 22 illustrates an example of displaying green and red adjacent to each other as single colors, similarly to the first modification of the first embodiment. In FIG. 22, assume that in a boundary section 46 of a display region 45*c* where green is displayed and a display region 45*d* where red is displayed, a pixel $48_{(L, j)}$ on an L-th column on the display region 45*c* side, and a pixel $48_{(L+1, j)}$ on an (L+1)-th column on the display region 45*d* side are adjacent to each other (L is an integer of 2 or more, and $(P_0-2)$ or less, and j is an integer of $(Q_0-1)$ or less).

In the present embodiment, regarding pixels 48 not included in the boundary section 46, the second sub-pixels 49G are fully lighted, and the first sub-pixels 49R, the third sub-pixels 49B, and the fourth sub-pixels 49W are unlighted in a pixel $48_{(1, j)}$ to a pixel $48_{(L-1, j)}$ in the display region 45*c*.

Similarly, regarding the pixels 48 not included in the boundary section 46, the first sub-pixels 49R are fully lighted, and the second sub-pixels 49G, the third sub-pixels 49B, and the fourth sub-pixels 49W are unlighted in a pixel $48_{(L+2, j)}$ to a pixel $48_{(P0, j)}$ in the display region 45*d*.

In the pixel $48_{(L, j)}$ on the display region 45*c* side, only a fourth sub-pixel $49W_{(L, j)}$ is lighted in a halftone manner, and a first sub-pixel $49R_{(L, j)}$, a second sub-pixel $49G_{(L, j)}$, and a third sub-pixel $49B_{(L, j)}$ are unlighted.

Similarly, in the boundary section 46, in the pixel $48_{(L+1, j)}$ on the display region 45*f* side, only a fourth sub-pixel $49W_{(L+1, j)}$ is lighted in a halftone manner, and a first sub-pixel $49R_{(L+1, j)}$ a second sub-pixel $49G_{(L+1, j)}$, and a third sub-pixel $49B_{(L+1, j)}$ are unlighted.

As illustrated in FIGS. 7 to 9 of the first embodiment, a bright streak occurs between the display regions 45*c* and 45*d* where the single colors are displayed. Therefore, as described in the present embodiment, the first sub-pixels 49R to the third sub-pixels 49B including the sub-pixels that display the single colors are unlighted. Instead, to compensate luminance, the fourth sub-pixels 49W that display white are lighted in a halftone manner.

As described above, according to the present embodiment, occurrence of the streak is prevented, and the visibility of a display image can be improved.

Figure 23:
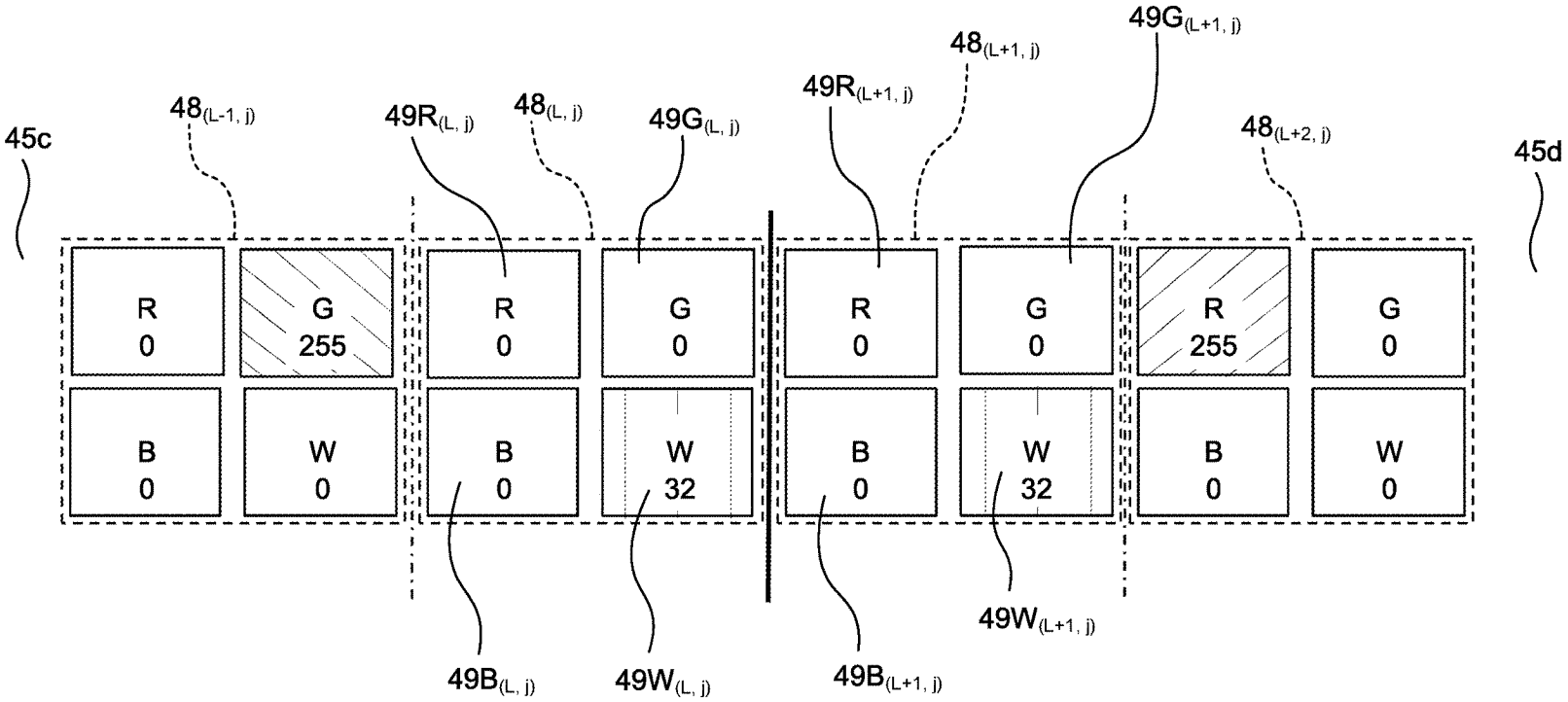
FIG. 23 is a diagram illustrating the fourth embodiment.

FIG. 23 is an enlarged view of the pixels on a j-th row near the boundary section 46 of FIG. 22.

A second sub-pixel $49G_{(L-j)}$ to which an input signal value $x_{2_(L-1, j)}$ "255" is input is fully lighted. Meanwhile, a first sub-pixel $49R_{(L-1, j)}$ to which an input signal value $x_{1_(L-1, j)}$ "0" is input is unlighted. A third sub-pixel $49B_{(L-1, j)}$ to which an input signal value $x_{3_(L-1, j)}$ "0" is input is unlighted. A fourth sub-pixel $49W_{(L-1, j)}$ to which an input signal value $x_{4_(L-1, j)}$ "0" is input is unlighted.

In the example illustrated in FIG. 23, an input signal value $x_{1_(L, j)}$ of the first sub-pixel $49R_{(L, j)}$ is 0, an input signal value $x_{2_(L, j)}$ of the second sub-pixel $49G_{(L, j)}$ is 0, an input signal value $x_{3_(L, j)}$ of the third sub-pixel $49B_{(L, j)}$ is 0, and an input signal value $x_{4_(L, j)}$ of the fourth sub-pixel $49W_{(L, j)}$ is 32 in the boundary section 46 on the display region 45*c* side. The fourth sub-pixel $49W_{(L, j)}$ to which the input signal value $x_{4_(L, j)}$ "32" is input is lighted in halftone luminance.

In the example illustrated in FIG. 23, an input signal value $x_{1_(L+1, j)}$ of the first sub-pixel $49R_{(L+1, j)}$ is 0, an input signal value $x_{2_(L+1, j)}$ of the second sub-pixel $49G_{(L+1, j)}$ is 0, an input signal value $x_{3_(L+1, j)}$ of the third sub-pixel $49B_{(L+1, j)}$ is 0, and an input signal value $x_{4_(L+1, j)}$ of the fourth sub-pixel $49W_{(L+1, j)}$ is 32 in the boundary section 46 on the display region 45*d* side.

In FIG. 23, the input signal value x that causes the sub-pixel to be lighted in halftone luminance is "32". However, this is a mere example. The input signal value x may be any value as long as the value causes the sub-pixel to be lighted in halftone luminance.

In the pixel $48_{(L+2, j)}$ not included in the boundary section 46 on the display region 45*d* side, an input signal value $x_{1_(L+2, j)}$ "255" is input to a first sub-pixel $49R_{(L+2, j}$ to be fully lighted. An input signal value $x_{2_(L+2, j)}$ "0" is input to a second sub-pixel $49G_{(L+2, j)}$ to be unlighted. An input signal value $x_{3_(L+2, j)}$ "0" is input to a third sub-pixel $49B_{(L+2, j)}$ to be unlighted. An input signal value $x_{4_(L+2, j)}$ "0" is input to a fourth sub-pixel $49W_{(L+2, j)}$ to be unlighted.

According to the present embodiment, occurrence of the streak is prevented, and the visibility of a display image can be improved.

The fourth embodiment is applicable to the case of displaying the single colors as primary colors adjacent to each other, described in the first modification of the first embodiment, the case of displaying the single colors as complementary colors of primary colors adjacent to each other, described in the second modification of the first embodiment, and the case of displaying the single colors as a primary color and its complementary color, described in the third modification of the first embodiment.

The fourth embodiment can be applied to the second embodiment. That is, the sub-pixels that display white are lighted in a halftone manner in either one of the adjacent display regions that display the single colors, whereby occurrence of the streak is prevented, and the visibility of a display image can be improved.

Modification of Fourth Embodiment

In a modification of the fourth embodiment, an example to rearrange sub-pixels, and turn on sub-pixels that display white among the rearranged sub-pixels, in a boundary section where single colors are displayed adjacent to each other, will be described.

The present embodiment will be described with reference to FIGS. 24 and 32.

Figure 24:
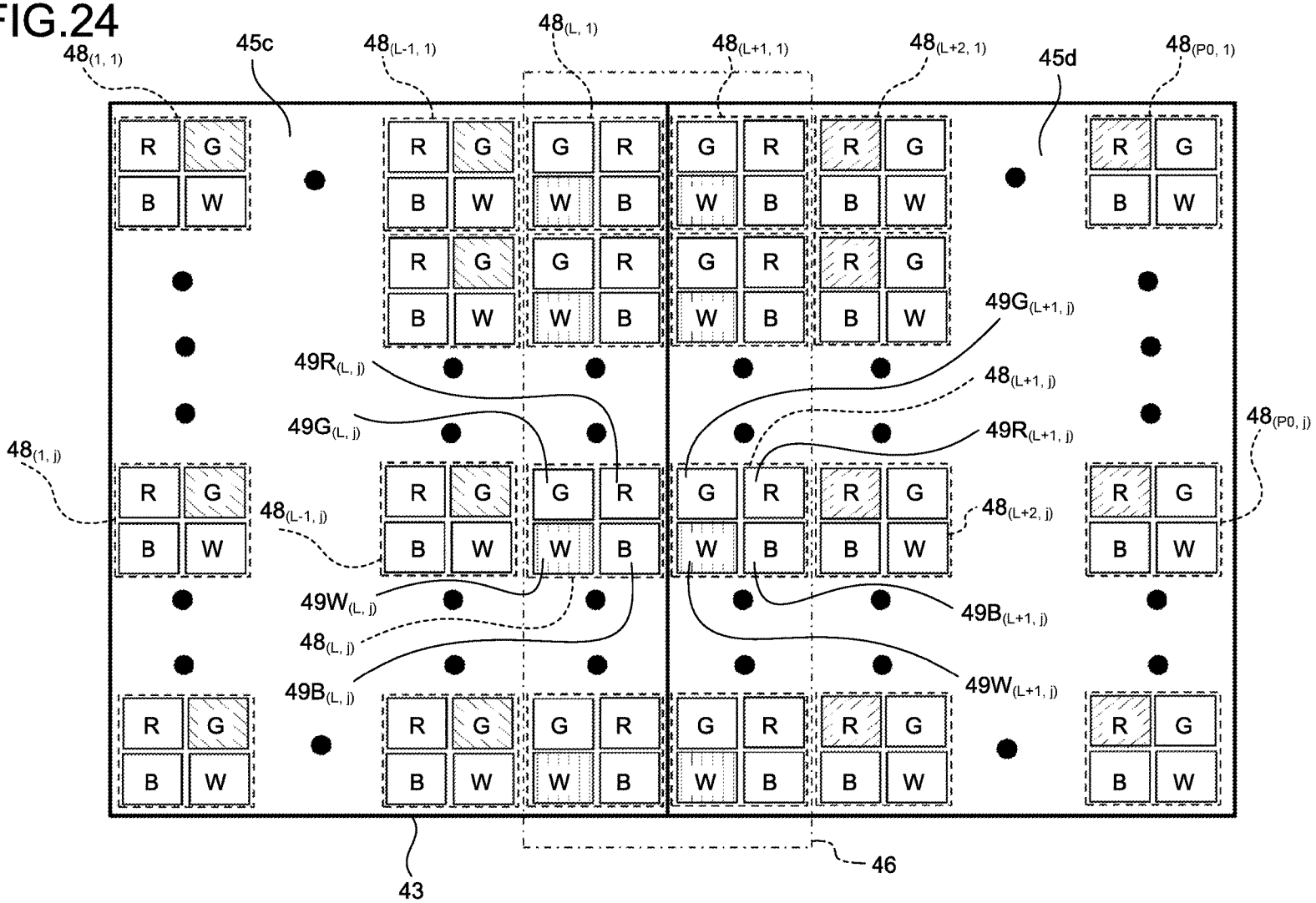
FIG. 24 is a diagram illustrating a modification of the fourth embodiment.

As illustrated in FIG. 24, in the present modification, in regions other than the boundary section 46, the first sub-pixel 49R, the second sub-pixel 49G, the third sub-pixel 49B, and the fourth sub-pixel 49W are arranged at positions of upper left, upper right, lower left, and lower right, respectively, in the pixel 48. In the present modification, the second sub-pixel 49G, the first sub-pixel 49R, the fourth sub-pixel 49W, and the third sub-pixel 49B in the pixel 48 in the boundary section 46 are arranged at positions of upper left, upper right, lower left, and lower right, respectively. That is, the sub-pixels in a pixel $\mathbf{48}_{(L,\ j)}$ and a pixel $\mathbf{48}_{(L+1,\ j)}$ in the boundary section 46 are symmetrically arranged to the sub-pixels in the pixels 48 in the regions other than the boundary section 46.

Figure 32:
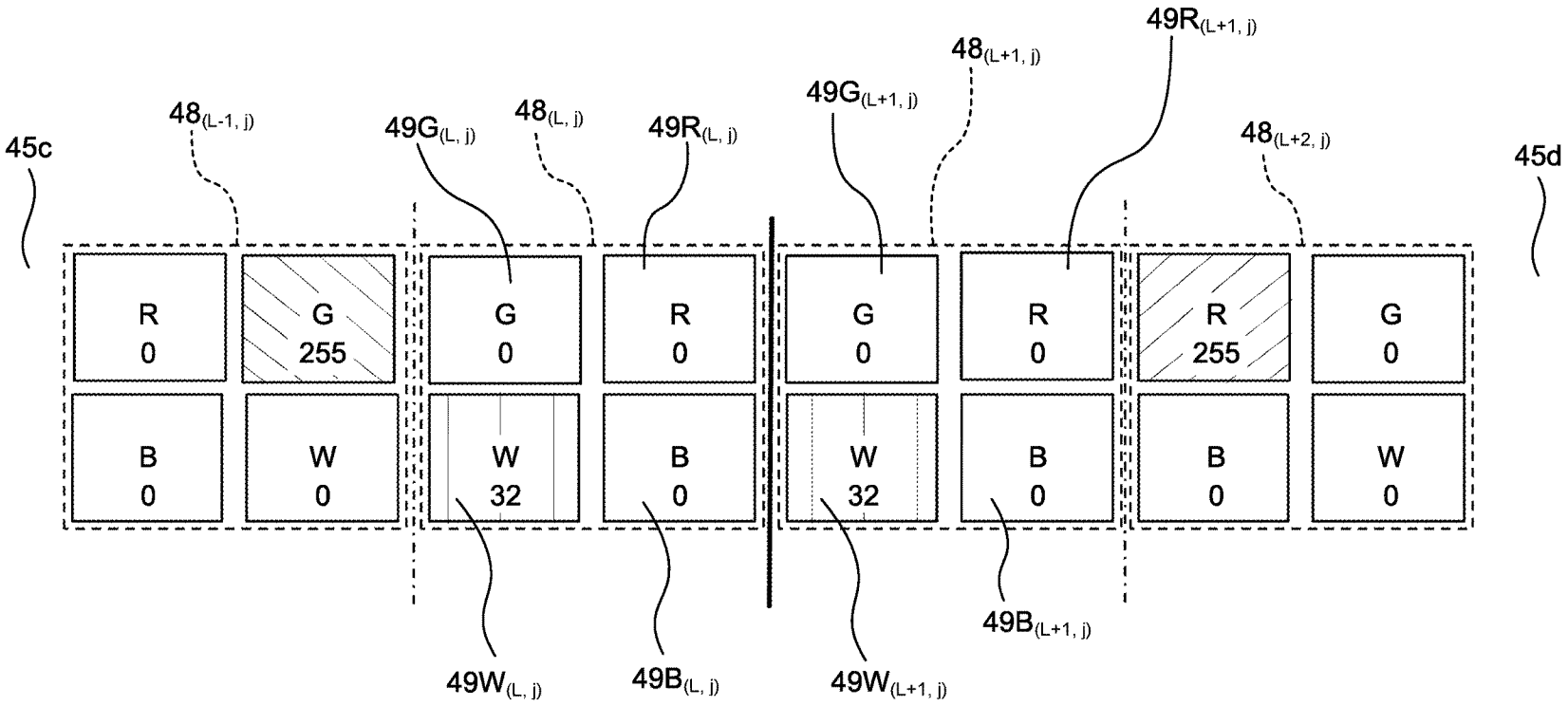
FIG. 32 is a diagram illustrating a modification of the fourth embodiment.

FIG. 32 is an enlarged view of the pixels on a j-th row near the boundary section 46 of FIG. 24. Input signal values x to be input to the respective sub-pixels 49 are the same as those in FIG. 24.

According to the present modification, by arranging the fourth sub-pixels 49W in a distributed manner, white displayed by the fourth sub-pixels 49W is not emphasized.

As described above, according to the present modification, occurrence of a streak can be prevented, and the visibility of a display image can be improved.

The modification of the fourth embodiment is applicable to the case of displaying the single colors as primary colors adjacent to each other, described in the first modification of the first embodiment, the case of displaying the single colors as complementary colors of primary colors adjacent to each other, described in the second modification of the first embodiment, and the case of displaying the single colors as a primary color and its complementary color, described in the third modification of the first embodiment.

The modification of the fourth embodiment can be applied to the second embodiment. That is, the sub-pixels that display white are lighted in a halftone manner in either one of the adjacent display regions that display the single colors, whereby occurrence of the streak is prevented, and the visibility of a display image can be improved.

Fifth Embodiment

In a fifth embodiment, an example of using pixels in different shapes, in place of the square pixels in the first embodiment and the modifications thereof, and the third and fourth embodiments, will be described.

The present embodiment will be described with reference to FIGS. 25 and 26.

Figure 25:
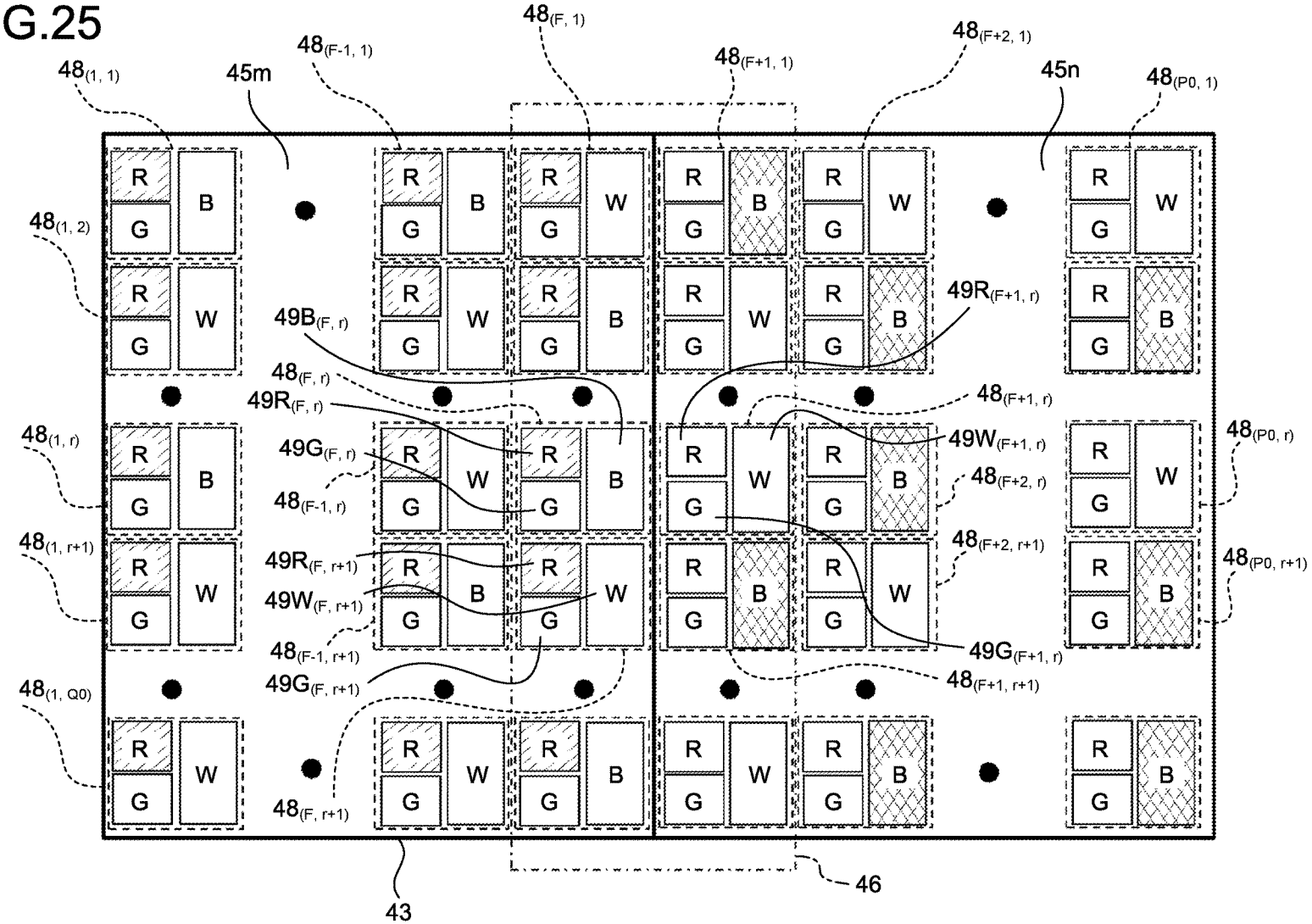
FIG. 25 is a diagram illustrating a fifth embodiment.

FIG. 25 illustrates the shapes of the pixels 48 of the present embodiment. A first sub-pixel $\mathbf{49}\mathrm{R}_{(F,\ r)}$, a second sub-pixel $\mathbf{49}\mathrm{G}_{(F,\ r)}$, and a third sub-pixel $\mathbf{49}\mathrm{B}_{(F,\ r)}$ are arranged at positions of upper left, lower left, and right, respectively, in a pixel $\mathbf{48}_{(F,\ r)}$ on an F-th column and an r-th row (F is an odd number of 1 or more and an integer of $(P_0-1)$ or less, and r is an integer of 2 or more, and $(Q_0-2)$ or less). The area of the third sub-pixel $\mathbf{49}\mathrm{B}_{(F,\ r)}$ is the same as a total of the area of the first sub-pixel $\mathbf{49}\mathrm{R}_{(F,\ r)}$ and the area of the second sub-pixel $\mathbf{49}\mathrm{G}_{(F,\ r)}$.

In a pixel $\mathbf{48}_{(F+1,\ r)}$ on an (F+1)-th column, adjacent to an arbitrary pixel $\mathbf{48}_{(F,\ r)}$, a first sub-pixel $\mathbf{49}\mathrm{R}_{(F+1,\ r)}$, a second sub-pixel $\mathbf{49}\mathrm{G}_{(F+1,\ r)}$, and a fourth sub-pixel $\mathbf{49}\mathrm{W}_{(F+1,\ r)}$ are arranged at positions of upper left, lower left, and right, respectively. The area of the fourth sub-pixel $\mathbf{49}\mathrm{W}_{(F+1,\ r)}$ is the same as a total of the area of the first sub-pixel $\mathbf{49}\mathrm{R}_{(F+1,\ r)}$ and the area of the second sub-pixel $\mathbf{49}\mathrm{G}_{(F+1,\ r)}$.

Arrangement of sub-pixels in a pixel $\mathbf{48}_{(F,\ r+1)}$ on a (r+1)-th row, adjacent to an arbitrary pixel $\mathbf{48}_{(F,\ r)}$, is the same as that of the pixel $\mathbf{48}_{(F+1,\ r)}$. That is, in the pixel $\mathbf{48}_{(F,\ r+1)}$, a first sub-pixel $\mathbf{49}\mathrm{R}_{(F,\ r+1)}$, a second sub-pixel $\mathbf{49}\mathrm{G}_{(F,\ r+1)}$, and a fourth sub-pixel $\mathbf{49}\mathrm{W}_{(F,\ r+1)}$ are arranged at positions of upper left, lower left, and right. The area of the fourth sub-pixel $\mathbf{49}\mathrm{W}_{(F,\ r+1)}$ is the same as a total of the area of the first sub-pixel $\mathbf{49}\mathrm{R}_{(F,\ r+1)}$ and the area of the second sub-pixel $\mathbf{49}\mathrm{G}_{(F,\ r+1)}$.

As described above, the pixel 48 of the present embodiment includes the third sub-pixel 49B or the fourth sub-pixel 49W having the area that is the total of the area of the first sub-pixel 49R and the area of the second sub-pixel 49G. To be more specific, the first sub-pixel 49R and the second sub-pixel 49G have the same shape and the same area, and each of the third sub-pixel 49B and the fourth sub-pixel 49W has a shape obtained by vertically arranging the first sub-pixel 49R and the second sub-pixel 49G in plan view. The third sub-pixel 49B and the fourth sub-pixel 49W are alternately arranged in pixel rows and in pixel columns, in other words, different colors are adjacent to each other. The pixels having the shapes of the present embodiment are called modified square pixels.

FIG. 25 illustrates a case of performing display in display regions 45*m* and 45*n* in different single colors adjacent to each other in a display panel 43. In FIG. 25, for example, red is displayed in the display region 45*m* and blue is displayed in the display region 45*n*.

In the display panel 43 in FIG. 25, in a pixel $\mathbf{48}_{(1,\ r)}$ to a pixel $\mathbf{48}_{(F,\ r)}$ in the display region 45*m*, the first sub-pixels 49R are fully lighted, and the second sub-pixels 49G, the third sub-pixels 49B, and the fourth sub-pixels 49W are unlighted. In a pixel $\mathbf{48}_{(F+1,\ r)}$ to a pixel $\mathbf{48}_{(P0,\ r)}$ in the display region 45*n*, the third sub-pixels 49B are fully lighted, and the first sub-pixels 49R, the second sub-pixels 49G, and the fourth sub-pixels 49W are unlighted.

If the sub-pixels are lighted as described above, a black streak may occur in the boundary section 46, similarly to the description of FIGS. 4 to 6.

Such occurrence of the streak can be prevented by application of the first embodiment and the modifications thereof, and the second to fourth embodiments.

Figure 26:
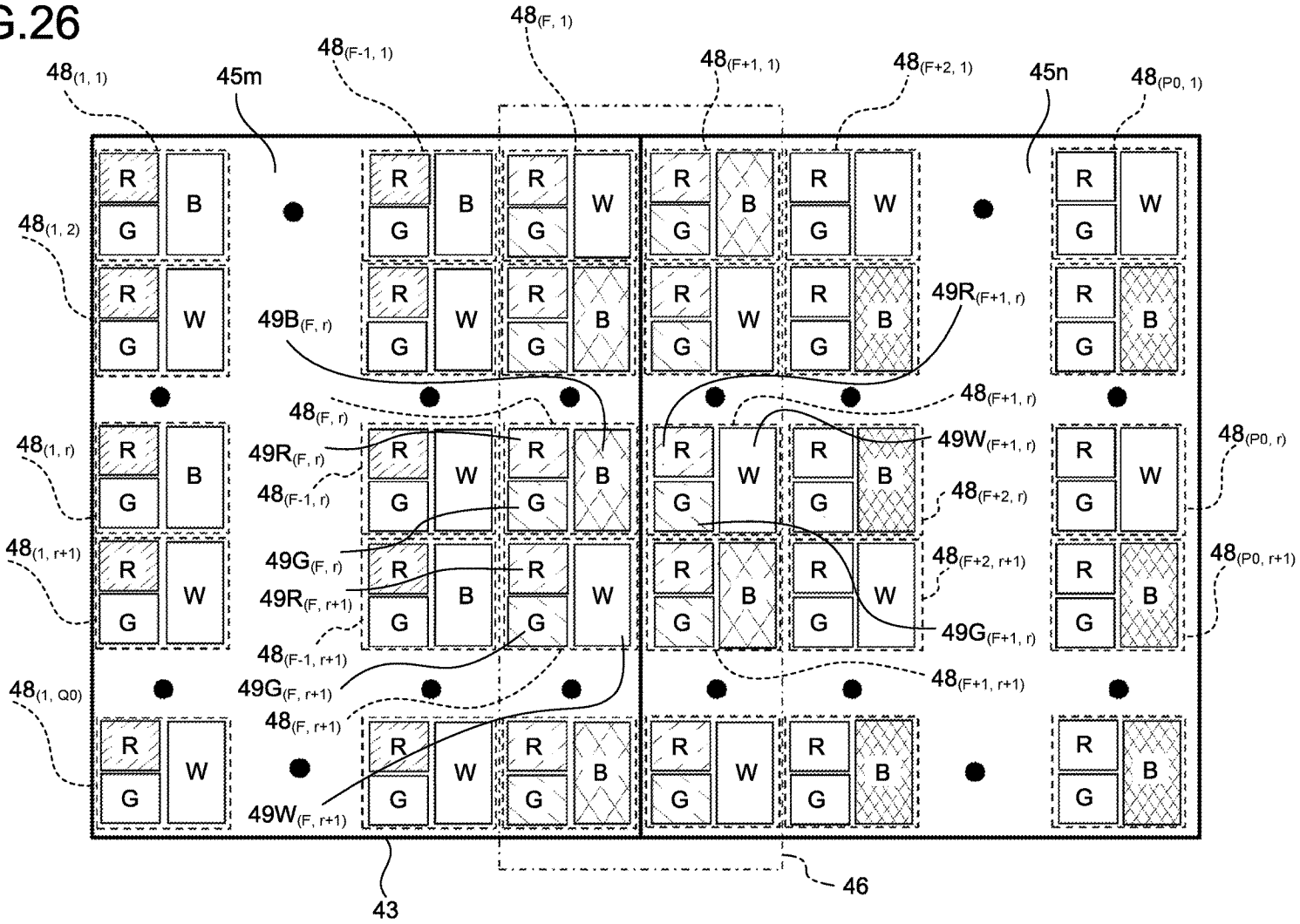
FIG. 26 is a diagram illustrating the fifth embodiment.

FIG. 26 illustrates an example of applying the first embodiment to FIG. 25. In FIG. 26, the first sub-pixels 49R, the second sub-pixels 49G, and the third sub-pixels 49B are lighted in a halftone manner, and the fourth sub-pixels 49W are unlighted in the pixel 48 on the display region 45*m* side and the pixel 48 on the display region 45*n* side in the boundary section 46.

The first sub-pixels 49R, the second sub-pixels 49G, and the third sub-pixels 49B are lighted in halftone luminance according to their original lighted and unlighted states. For example, in FIG. 26, in the pixel $\mathbf{48}_{(F,\ r)}$ on the r-th row on the display region 45*m* side, by setting an input signal value x to be input to the first sub-pixel $\mathbf{49}R_{(F,\ r)}$ that is originally supposed to be fully lighted larger than input signal values x to be input to the second sub-pixel $\mathbf{49}G_{(F,\ r)}$ and the second sub-pixel $\mathbf{49}B_{(F,\ r)}$ that are originally supposed to be unlighted, the pixels can be lighted in luminance according to their original lighted and lights-out states.

Similarly, for example, in FIG. 26, in the pixel $\mathbf{48}_{(F,\ r+1)}$ on the (r+1)-th row on the display region 45*m* side, by setting the input signal value x to be input to the first sub-pixel $\mathbf{49}R_{(F,\ r+1)}$ that is originally supposed to be fully lighted larger than the input signal value x to be input to the second sub-pixel $\mathbf{49}G_{(F,\ r+1)}$ that is originally supposed to be unlighted, the pixels can be lighted in luminance according to their original lighted and lights-out states.

The fifth embodiment can be applied to the first to third modifications of the first embodiment, and the second to fourth embodiments.

Sixth Embodiment

In a sixth embodiment, an example of using pixels in different shapes, in place of the square pixel in the first embodiment and the modifications thereof, and the third and fourth embodiments, and the modified square pixel in the fifth embodiment, will be described.

The present embodiment will be described with reference to FIGS. 27 and 28.

Figure 27:
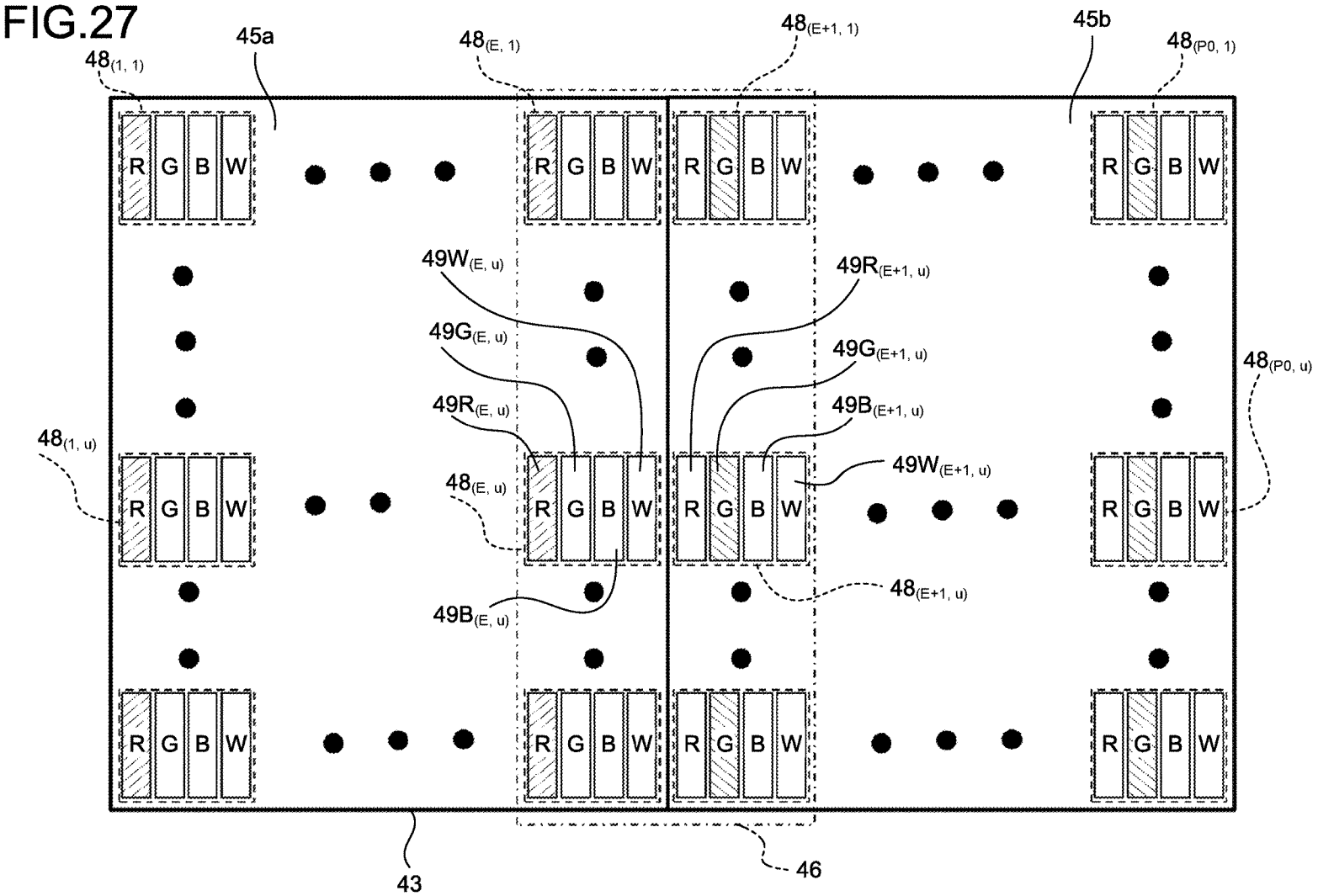
FIG. 27 is a diagram illustrating a sixth embodiment.

FIG. 27 illustrates the shapes of pixels 48 in the present embodiment. In an arbitrary pixel $\mathbf{48}_{(E,\ u)}$ on an E-th column and a u-th row, a first sub-pixel $\mathbf{49}R_{(E,\ u)}$, a second sub-pixel $\mathbf{49}G_{(E,\ u)}$, a third sub-pixel $\mathbf{49}B_{(E,\ u)}$, and a fourth sub-pixel $\mathbf{49}W_{(E,\ u)}$ having the same shape and an equal area are laterally arranged (E is an integer of $(P_0-1)$ or less and u is an integer of $(Q_0-1)$ or less). The pixel having the shape of the present embodiment is called a stripe pixel.

FIG. 27 illustrates a case of performing display in display regions 45*a* and 45*b* in different single colors laterally adjacent to each other in a display panel 43. In FIG. 27, for example, red is displayed in the display region 45*a* and green is displayed in the display region 45*b*.

In the display panel 43 in FIG. 27, the first sub-pixels 49R are fully lighted, and the second sub-pixels 49G, the third sub-pixels 49B, and the fourth sub-pixels 49W are unlighted in a pixel $\mathbf{48}_{(1,\ u)}$ to a pixel $\mathbf{48}_{(E,\ u)}$ in the display region 45*a*. The second sub-pixels 49G are fully lighted, and the first sub-pixels 49R, the third sub-pixels 49B, and the fourth sub-pixels 49W are unlighted in a pixel $\mathbf{48}_{(E+1,\ u)}$ to a pixel $\mathbf{48}_{(P0,\ u)}$ in the display region 45*b*.

If the sub-pixels are lighted as described above, a black streak may occur in a boundary section 46 of the adjacent display regions 45*a* and 45*b*.

Such occurrence of the streak can be prevented by application of the first embodiment and the modifications thereof, and the second to fifth embodiments.

Figure 28:
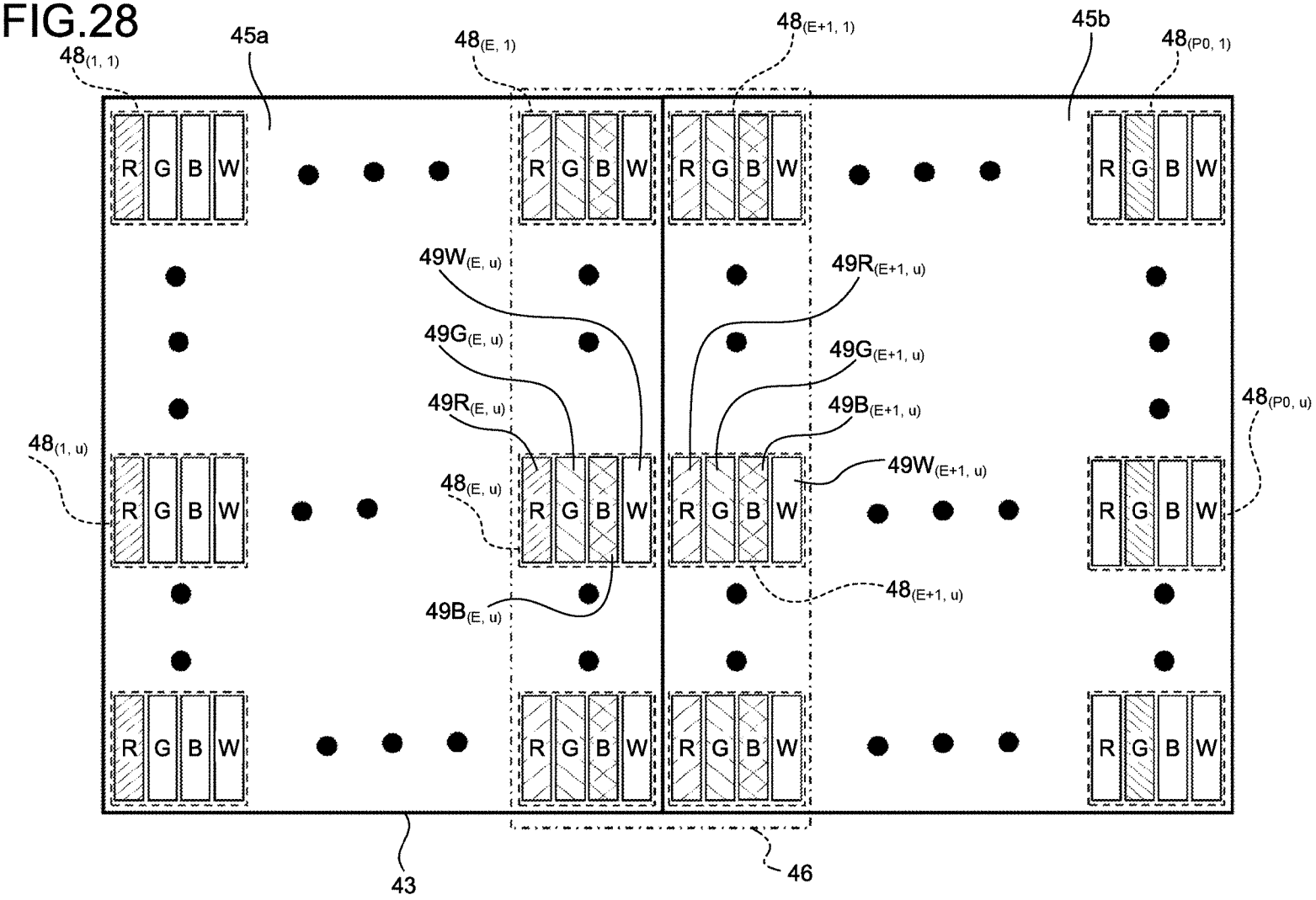
FIG. 28 is a diagram illustrating the sixth embodiment.

FIG. 28 illustrates an example of applying the first embodiment to FIG. 27. In FIG. 28, the first sub-pixels 49R, the second sub-pixels 49G, and the third sub-pixels 49B are lighted in a halftone manner, and the fourth sub-pixels 49W are unlighted in the pixel 48 on the display region 45*a* and in the pixel 48 on the display region 45*b* in the boundary section 46.

The first sub-pixels 49R, the second sub-pixels 49G, and the third sub-pixels 49B are lighted in halftone luminance according to their original lighted and unlighted states. For example, in FIG. 28, in the pixel $\mathbf{48}_{(E,\ u)}$ on the u-th row on the display region 45*a* side, by setting an input signal value x to be input to the first sub-pixel $\mathbf{49}R_{(E,\ u)}$ that is originally supposed to be fully lighted larger than input signal values x to be input to the second sub-pixel $\mathbf{49}G_{(E,\ u)}$ and the second sub-pixel $\mathbf{49}B_{(E,\ u)}$ that are originally supposed to be unlighted, the pixels can be lighted in luminance according to their original lighted and unlighted states.

Similarly, for example, in FIG. 28, in the pixel $\mathbf{48}_{(E+1,\ u)}$ on the (E+1)-th column on the display region 45*b* side, by setting an input signal value x to be input to the second sub-pixel $\mathbf{49}G_{(E+1,\ u)}$ that is originally supposed to be fully lighted larger than input signal values x to be input to the first sub-pixel $\mathbf{49}R_{(E+1,\ u)}$ and the second sub-pixel $\mathbf{49}B_{(E+1,\ u)}$ that are originally supposed be unlighted, the pixels can be lighted in luminance according to their original lighted and unlighted states.

The fifth embodiment can be applied to the first to third modifications of the first embodiment, and the second to fourth embodiments.

The present invention includes the following aspects.

(1) A display device comprising:

a display panel including a plurality of pixels;

at least three of a first sub-pixel in a first color, a second sub-pixel in a second color, a third sub-pixel in a third color, and a fourth sub-pixel in a fourth color, the three sub-pixels being included in each of the pixels; and a controller configured to input an input signal to the first sub-pixel to the fourth sub-pixel, wherein, when display is performed in a plurality of display regions in respective single colors adjacent to each other in the display panel, the controller inputs a signal for lighting a sub-pixel that does not contribute to one of the single colors in a halftone manner, in a pixel included in a boundary section of the adjacent display regions.

(2) The display device according to (1), wherein the controller inputs a signal for lighting a sub-pixel that contributes to one of the single colors in a halftone manner, in the pixel included in the boundary section of the adjacent display regions.

(3) The display device according to (1), wherein the controller inputs a signal for fully lighting a sub-pixel that contributes to one of the single colors, and a signal for lighting a sub-pixel that does not contribute to one of the single colors and that displays white, in a halftone manner, in the pixel included in the boundary section of the adjacent display regions.

(4) The display device according to any one of (1) to (3), wherein the controller inputs a signal for lighting a sub-pixel in a halftone manner, in only one display region of the adjacent display regions in the boundary section.

(5) The display device according to any one of (1) to (4), wherein the single colors displayed in the display regions are primary colors.

(6) The display device according to any one of (1) to (4), wherein the single colors displayed in the display regions are complementary colors of primary colors.

(7) The display device according to any one of (1) to (4), wherein the single colors displayed in the display regions are a primary color and a complementary color of the primary color.

(8) The display device according to any one of (1) to (7), wherein the boundary section of one of the display regions is on a pixel row or a pixel column closest to another one of the display regions adjacent and closest to the one of the display regions.

(9) The display device according to any one of (1) to (8), wherein the first sub-pixel, the second sub-pixel, the third sub-pixel, and the fourth sub-pixel have a same shape and a same area, and the first sub-pixel, the second sub-pixel, the third sub-pixel, and the fourth sub-pixel are arranged at positions of upper left, upper right, lower left, and lower right, respectively, in each of the pixels.

(10) The display device according to any one of (1) to (8), wherein the first sub-pixel and the second sub-pixel have a same shape and a same area, the third sub-pixel and the fourth sub-pixel each have a shape obtained by vertically arranging the first sub-pixel and the second sub-pixel in plan view, and the third sub-pixel and the fourth sub-pixel are alternately arranged in pixel rows and in pixel columns.

(11) The display device according to any one of (1) to (8), wherein the first sub-pixel, the second sub-pixel, the third sub-pixel, and the fourth sub-pixel have a same shape and a same area, and the first sub-pixel, the second sub-pixel, the third sub-pixel, and the fourth sub-pixel are laterally arranged.

(12) A method of driving a display device including a display panel including a plurality of pixels, and at least three of a first sub-pixel in a first color, a second sub-pixel in a second color, a third sub-pixel in a third color, and a fourth sub-pixel in a fourth color, the three sub-pixels being included in each of the pixels, the method comprising:

when display is performed in a plurality of display regions in respective single colors adjacent to each other in the display panel, inputting a signal for lighting a sub-pixel that does not contribute to one of the single colors in a halftone manner, in a pixel included in a boundary section of the adjacent display regions.

What is claimed is:

1. A display device comprising:

a display panel including a plurality of pixels;

at least three of a first sub-pixel in a first color, a second sub-pixel in a second color, a third sub-pixel in a third color, and a fourth sub-pixel in a fourth color, the at least three sub-pixels being included in each of the pixels; and a controller configured to input an input signal to the first sub-pixel to the fourth sub-pixel, wherein, when display is performed in a plurality of display regions in respective single colors, each display region including a boundary section adjacent to another display region, the controller inputs a signal for lighting a sub-pixel that does not contribute to one of the single colors in a halftone manner, only in at least one pixel included in at least one of the boundary sections of the display regions.

2. The display device according to claim 1, wherein the controller inputs a signal for lighting a sub-pixel that contributes to one of the single colors in a halftone manner, in the pixel included in at least one of the boundary sections.

3. The display device according to claim 1, wherein the controller inputs a signal for fully lighting a sub-pixel that contributes to one of the single colors, and a signal for lighting a sub-pixel that does not contribute to one of the single colors and that displays white, in a halftone manner, in the pixel included in at least one of the boundary sections.

4. The display device according to claim 1, wherein the controller inputs a signal for lighting a sub-pixel in a halftone manner, in only the boundary section of one display region.

5. The display device according to claim 1, wherein the single colors displayed in the display regions are primary colors.

6. The display device according to claim 1, wherein the single colors displayed in the display regions are complementary colors of primary colors.

7. The display device according to claim 1, wherein the single colors displayed in the display regions are a primary color and a complementary color of the primary color.

8. The display device according to claim 1, wherein the boundary section of a first one of the display regions is on a pixel row or a pixel column closest to a second one of the display regions adjacent and closest to the first one of the display regions.

9. The display device according to claim 1, wherein the first sub-pixel, the second sub-pixel, the third sub-pixel, and the fourth sub-pixel have a same shape and a same area, and the first sub-pixel, the second sub-pixel, the third sub-pixel, and the fourth sub-pixel are arranged in one of the pixels such that the first sub-pixel and the second sub-pixel are adjacent to each other in a first direction, the third sub-pixel and the fourth sub-pixel are adjacent to each other in the first direction, the first sub-pixel and the third sub-pixel are adjacent to each other in a second direction perpendicular to the first direction, and the second sub-pixel and the fourth sub-pixel are adjacent to each other in the second direction.

10. The display device according to claim 1, wherein the pixels include a plurality of first pixels, and a plurality of second pixels, each of the first pixels including the first sub-pixel, the second sub-pixel, and the third sub-pixel, and each of the second pixels including the first sub-pixel, the second sub-pixel, and the fourth sub-pixel, the first pixels and the second pixels are alternately arranged in a first direction, and the first pixels and the second pixels are alternately arranged in a second direction different from the first direction, the first sub-pixel and the second sub-pixel have a same shape and a same area, the third sub-pixel and the fourth sub-pixel have a larger area than the first sub-pixel, in each of the first pixels, the first sub-pixel and the third sub-pixel are adjacent to each other in the first direction, the second sub-pixel and the third sub-pixel are adjacent to each other in the first direction, and the first sub-pixel and the second sub-pixel are adjacent to each other in the second direction, and in each of the second pixels, the first sub-pixel and the fourth sub-pixel are adjacent to each other in the first direction, the second sub-pixel and the fourth sub-pixel are adjacent to each other in the first direction, and the first sub-pixel and the second sub-pixel are adjacent to each other in the second direction.

11. The display device according to claim 1, wherein the first sub-pixel, the second sub-pixel, the third sub-pixel, and the fourth sub-pixel have a same shape and a same area, and the first sub-pixel, the second sub-pixel, the third sub-pixel, and the fourth sub-pixel are arranged in a first direction.

12. A method of driving a display device including a display panel including a plurality of pixels, and at least three of a first sub-pixel in a first color, a second sub-pixel in a second color, a third sub-pixel in a third color, and a fourth sub-pixel in a fourth color, the three sub-pixels being included in each of the pixels, the method comprising:

when display is performed in a plurality of display regions in respective single colors, each display region including a boundary section adjacent to another display region, inputting a signal for lighting a sub-pixel that does not contribute to one of the single colors in a halftone manner, only in at least one pixel included in at least one of the boundary sections of the display regions.

* * * * *